US006491352B2

(12) United States Patent
Engle

(10) Patent No.: US 6,491,352 B2
(45) Date of Patent: Dec. 10, 2002

(54) SPRING APPLIED PARKING BRAKE FOR RAIL CARS

(75) Inventor: Thomas Engle, Clayton, NY (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/809,703

(22) Filed: Mar. 15, 2001

(65) Prior Publication Data

US 2001/0050027 A1 Dec. 13, 2001

Related U.S. Application Data

(63) Continuation-in-part of application No. 09/255,204, filed on Feb. 22, 1999.

(60) Provisional application No. 60/189,578, filed on Mar. 15, 2000.

(51) Int. Cl.[7] ..... B60T 13/00

(52) U.S. Cl. ..... 303/8; 303/127; 188/107; 188/170

(58) Field of Search ..... 303/7, 8, 9, 127; 188/107, 170, 166, 3 R, 112 R, 3 H

(56) References Cited

U.S. PATENT DOCUMENTS

| | | | | | |
|---|---|---|---|---|---|
| 2,270,431 | A | * | 1/1942 | Freeman | 188/170 |
| 2,568,722 | A | * | 9/1951 | Dewandre | 303/2 |
| 3,612,619 | A | * | 10/1971 | Hayes | 180/286 |
| 3,621,956 | A | * | 11/1971 | Suckow | 188/170 |
| 3,635,317 | A | * | 1/1972 | Crabb et al. | 137/596 |
| 3,650,568 | A | * | 3/1972 | Poplawski | 188/170 |
| 3,842,950 | A | * | 10/1974 | Fontaine | 188/170 |
| 3,926,282 | A | * | 12/1975 | Tanaka et al. | 188/106 F |
| 4,052,109 | A | * | 10/1977 | Nagase et al. | 303/15 |
| 4,456,413 | A | | 6/1984 | Pavlick | |
| 4,607,729 | A | * | 8/1986 | Staltmeir et al. | 188/106 F |
| 4,652,057 | A | | 3/1987 | Engle et al. | |
| 4,718,351 | A | | 1/1988 | Engle | |
| 4,718,800 | A | | 1/1988 | Engle | |
| 4,746,171 | A | * | 5/1988 | Engle | 188/107 |
| 4,973,206 | A | | 11/1990 | Engle | |
| 4,978,178 | A | * | 12/1990 | Engle | 188/107 |
| RE34,040 | E | * | 8/1992 | Rains | 188/107 |
| 5,172,958 | A | * | 12/1992 | Sell | 188/170 |
| 5,216,956 | A | | 6/1993 | Adams | |
| 5,222,443 | A | | 6/1993 | Engle | |
| 5,246,081 | A | | 9/1993 | Engle | |
| 5,564,341 | A | | 10/1996 | Martin | |
| 5,722,736 | A | | 3/1998 | Cook | |
| 5,738,416 | A | * | 4/1998 | Kanjo et al. | 303/7 |
| 6,039,158 | A | * | 3/2000 | Fox et al. | 188/162 |

* cited by examiner

*Primary Examiner*—Christopher P. Schwartz
*Assistant Examiner*—Devon Kramer
(74) *Attorney, Agent, or Firm*—Buchanan Ingersoll, P.C.

(57) ABSTRACT

An integral intermodal train is provided for carrying standard over-the-highway semi-trailers. Each segment can have a plurality of platforms and may be loaded or unloaded independently of any other segment using a self contained, roll-on/roll-off system. Several sub-systems to speed performance and enhance reliability, such as an electronic assisted air brake, health monitoring, trailer tie-down and locomotive interface subsystems, can be provided on each segment. A spring applied parking brake is provided for the segments and operably connected to the train pneumatic brake systems. In a preferred embodiment the brake is automatically applied when brake pipe pressure falls below 40 psi nominal. The pneumatic valving for the parking brake prevents application of the valve in an emergency braking situation, until the pressure has bled off in normal system leakage, preventing wheel damage. A handle is provided for manual application and release of the parking brake when desired.

17 Claims, 43 Drawing Sheets

62
60
62

62
54
62

54
80
51
51
5c
44

A-end
B-end
80
80
44
54
59
5c
VI
VI
VII
VII 230
232
234
236
238
240

300
318
328
315
324
303
321
327
330
433
SEE FIG 44

340

340

300

SPRING APPLIED PARKING BRAKE FOR RAIL CARS

This application is a continuation-in-part of application Ser. No. 09/255,204, filed on Feb. 22, 1999 and is based on provisional patent application Ser. No. 60/189,578, filed on Mar. 15, 2000.

BACKGROUND

The present invention relates generally to rail cars for an integral/semi-integral intermodal train employing a segmented roll-on/roll-off system. More particularly, the rail cars can be connected together to form segments of an integral train for carrying freight, such as semi-trailers, wherein each train segment has an integrated arrangement composed of different types of rail car platforms, including an adapter platform, intermediate platforms and a loading ramp platform. The present invention relates, in particular, to an apparatus for the automatic application and release of parking brakes for the rail cars. An intermodal train platform system is described in applicants co-pending application Ser. No. 09/252,204 filed Feb. 22, 1999, which is hereby incorporated by reference herein in its entirety.

SUMMARY

Adapter, intermediate and ramp platform rail car platforms are provided for forming an intermodal train for carrying standard over-the-highway semi-trailers. The intermodal train can have a standard locomotive pulling one or more identical train segments. Each segment can have eleven or more platforms and may be loaded or unloaded independently of any other segment using a self contained, roll-on/roll-off system. This system can have an integral ramp on at least one end of each segment, for use by a hostler tractor and/or the semi-trailers as they are being loaded or unloaded. The platforms which make up each segment can be connected by articulated joints so as to eliminate longitudinal slack and reduce costs. At least one platform should be equipped with a standard knuckle coupler at standard height to permit the segments to be pulled by any existing locomotive.

In order to permit carriage of non-railroad trailers, a very good ride quality is required; and this can be provided by premium trucks and a low 36½ inch deck height, both of which combine to permit stable operation at high speed. High speed operation is also made possible by a brake system providing actual train average braking ratios of eighteen percent nearly double that available with standard equipment. Use of this braking system can permit the Steel Turnpike to operate at speeds thirty percent higher than AAR standard freight trains, while stopping within the same distance.

Several sub-systems intended to speed performance and enhance reliability can be provided on each segment. These are the "Electronic Assisted Air Brake," "Health Monitoring" and "Trailer Tie-Down" subsystems. A "Locomotive Interface Unit" subsystem is also required if former subsystems are to be used to best effectiveness.

In a preferred embodiment of the present invention a spring applied, air released parking brake is provided for the intermodal train. The parking brake is only permitted to apply when normal air brake cylinder pressure is lost, and preferably only to a degree approximating the loss of normal full service brake cylinder pressure. Manual release of the parking brake is provided should it become necessary or desirable to move a rail car without first charging the brake pipe.

Other details, objects, and advantages of the invention will become apparent from the following detailed description and the accompanying drawing Figures of certain embodiments thereof.

BRIEF DESCRIPTION OF THE DRAWINGS

A more complete understanding of the invention can be obtained by considering the following detailed description in conjunction with the accompanying drawings, wherein:

FIGS. 40*a* and 40*b* show a top and side plan view, respectively, of a preferred embodiment of the spring applied, air released parking brake of the present invention.

DESCRIPTION OF CERTAIN PREFERRED EMBODIMENTS

Figure 1:
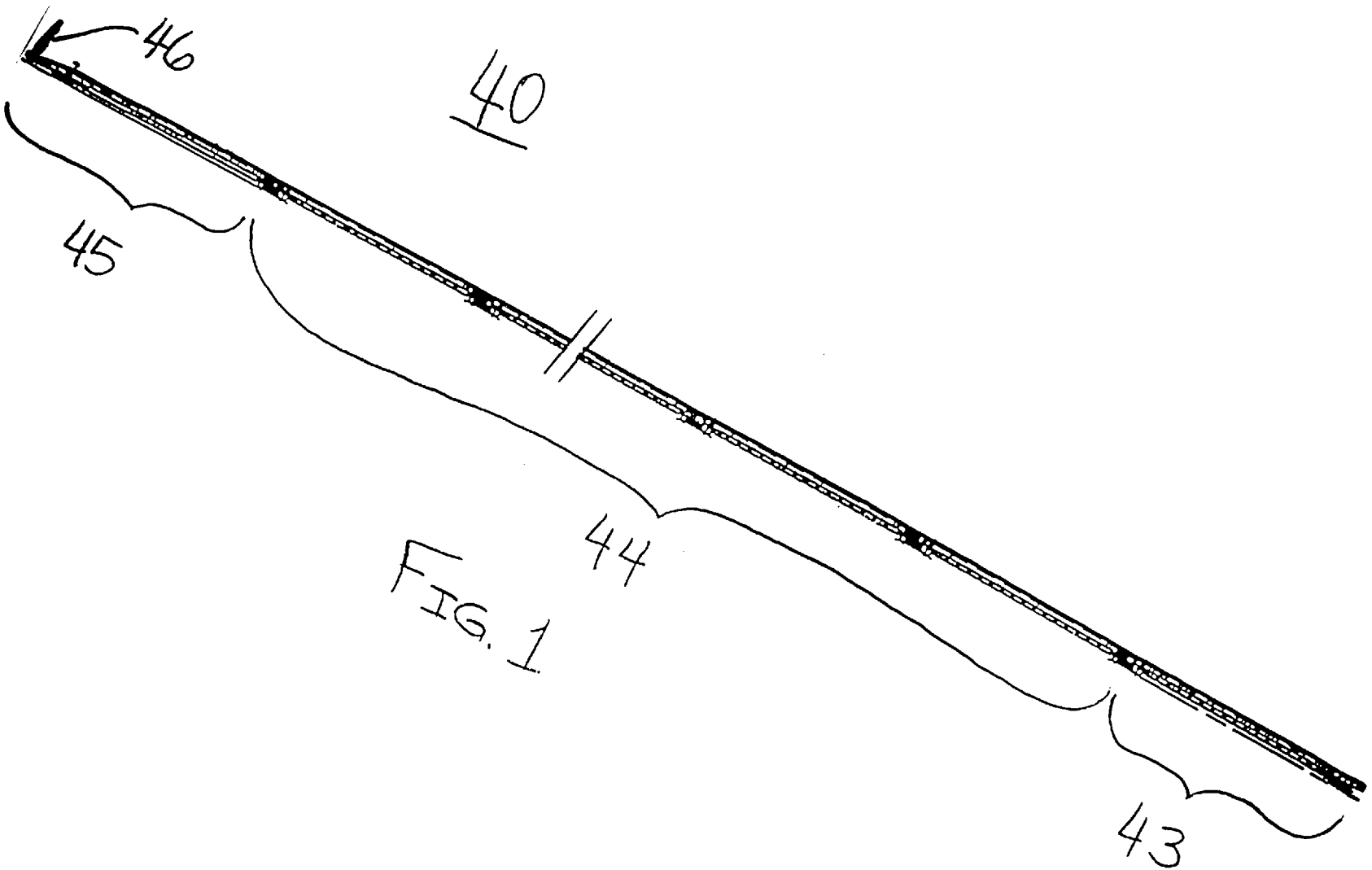
FIG. 1 is a side view of a presently preferred embodiment of an intermodal train segment.

A semi-integral, intermodal train segment 40, intended to carry standard over-the-highway (non-AAR) semi-trailers is shown in FIG. 1. An intermodal train may consist of a standard locomotive pulling one or more identical train segments 40. Each segment 40 includes at least three, and preferably eleven or more platforms 43, 44, 45 and may be loaded or unloaded independently of any other segment 40 using a self contained, roll-on/roll-off system. This system includes an integral ramp 46 on an end ramp loader platform 45 of each segment 40, for use by the special hostler tractor and the semi-trailers as they are being loaded or unloaded. The platforms 43, 44, 45 which make up each segment 40 are connected by articulated joints so as to eliminate longitudinal slack and reduce costs, but at least one platform is equipped with a standard knuckle coupler 47 at standard height to permit the segments to be pulled by any existing locomotive. No terminal infrastructure is required other than an area at least 75 feet long, whose surface is graded to approximately the height of the top of rail. Such a system is also generally referred to as the Steel Turnpike.

In order to permit carriage of non-railroad trailers, a very good ride quality is required; and this can be provided by premium trucks and a low 36½ inch deck height, both of which combine to permit stable operation at high speed. High speed operation is also made possible by a brake system providing actual train average braking ratios of eighteen percent nearly double that available with standard equipment. Use of this braking system permits the Steel Turnpike to operate at speeds thirty percent higher than AAR standard freight trains, while stopping within the same distance. High speed operation is worthless in the service sensitive trailer market, however, if extremely high reliability is not possible. In order to provide this reliability, a continuously operating health monitoring system is provided. This system signals potential problems to the operator as soon as they arise, thus permitting timely maintenance to correct defects that would otherwise cause delays, damage or equipment out-of-service problems. The continuous monitoring system is capable of absolutely eliminating two of the most significant causes of derailment, namely broken wheels and burned off journal bearings.

It is envisioned that such intermodal trains will normally consist of several segments 40 to produce trains 40 of over one hundred trailer capacity. In operation, it can be advantageous to use the segments 40 in pairs with two ramp platforms 45 connected to each other end-to-end, as will be further described.

Each intermodal train segment 40 includes three platform types 43, 44, 45, articulated together. Each end of each platform type is, for purposes of description, assigned one of two names, referred to previously as the A-end and the B-end. The forward end of such platform will be referred to as the A-end while the rearward end will be called the B-end.

The first of the three types of platforms is the adapter platform 43, which is shown in more detail in FIGS. 2–5. The adapter platform 43 has a 28 inch low conveyance truck 48, a conventional knuckle coupler 46, hydraulic draft gear 49, standard carbody bolster 60 shown best in FIG. 15, and a centerplate 61 at the A-end. At the B-end, the adapter platform 43 has a 33 inch truck 51 with high capacity bearings and a female half spherical articulated connector 50 with combined center plate, which can be a standard Cardwell SAC-1 type connector. The adapter platform 43 is intended to be coupled behind a standard locomotive. The construction of the carbody bolster 28 inch truck 48 mounting at the A-end is shown in more detail in FIG. 15, and is more fully described in connection with that figure. Similarly, the structure of the B-end is shown in more detail in FIG. 16 and is described more fully in connection with that figure.

Figure 3:
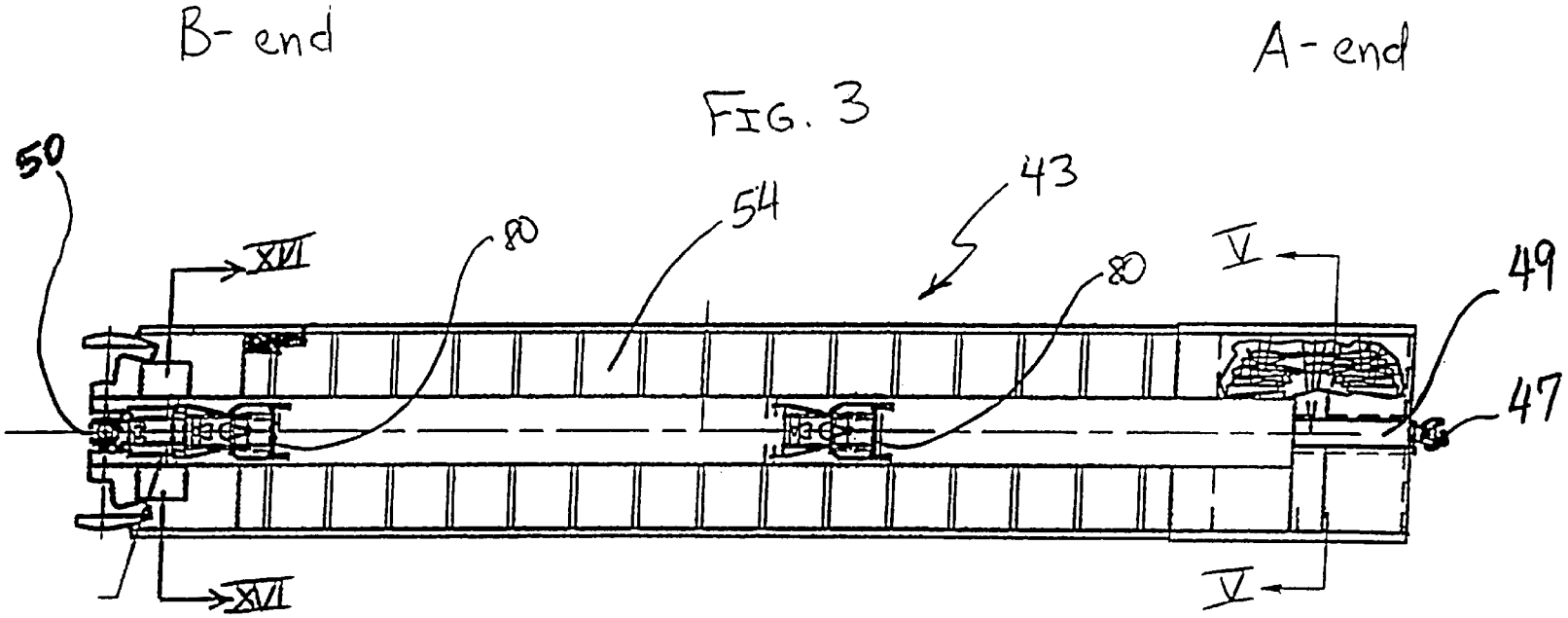
FIG. 3 is a top view of the adapter platform shown in FIG. 2.

The second platform type is the intermediate platform 44, shown in FIG. 3, also having a female articulated (SAC-1) connection 50 and a 33 inch truck 51 at its B-end which is identical to the truck 51 on the B-end of the adapter car 43. A male articulated connection 52 without a truck is provided at the A-end of the intermediate platform 44. The A-end is of the intermediate platform 44 is supported by the mating female articulation connector 50 and truck 51 at the B-end of an adjacent platform.

The third type platform is the ramp loader platform 45, shown in FIGS. 11–14. The ramp platform 45 is similar to the intermediate platform 43 in that it too has a truck 48 only at the B-end. However, the truck 48 at the B-end of the ramp platform 45 differs in that a 28 inch low conveyance type truck 48, as on the adapter platform 43, is used. Since this truck 48 supports only about half the weight borne by the 33 inch trucks 51 of the intermediate platforms 43, the wheels can be smaller without danger of overloading the wheels, axles or bearings. The A-end of the ramp platform 45 also has a male articulated connection 52 which is supported by the truck 51 at the B-end of an adjacent platform, in like manner as the intermediate platforms 44, and mates with a female articulated connector 50. At the B-end of the ramp platform 45, the deck 54 has an extended, sloped portion 56 which protrudes beyond the truck 48, and is supported by a conventional carbody bolster 60 and centerplate rather than an articulated connection. Use of the 28 inch truck at this location allows the deck 56 height of the end of the ramp platform 45 to be reduced from the 36½ inch height of the other platforms 43, 44 down to 31½ inches at the B-end truck centerline of the ramp platform 45. Consequently, the height that the loading ramp 46 must rise to allow roll-on loading can be significantly reduced. This height is further reduced between the truck centerline and the ramp platform end sill by angling the sloped portion 56 toward the ground, resulting in a final deck height at the end sill of only 17¼ inches. This low height is easily reached by a short, lightweight ramp assembly 46 which is hinged to the ramp platform 45 end sill. The ramp can be raised to a stored position for travel, or lowered to a loading position by a ramp positioning device, such as, for example, an air cylinder under the control of an attendant at the terminal.

Since the B-end of the ramp platform 45 is so much lower than the normal 34½ inch coupler height, an unconventional coupler arrangement is required, particularly if the ramp platform 45 is to be coupled to a conventional locomotive or car. Presently, there are two preferred configurations, shown in FIGS. 22–27. One configuration, shown in FIGS. 24–27, uses a standard knuckle coupler 47 carried in an elevating draft gear 49, similar in concept to the retractable couplers used on passenger train locomotives through the 1950's. The other configuration, shown in FIGS. 22–23 and 28–33, is useful if, in operation, the ramp platform 45 is only to be coupled to a similar ramp platform 45 of a different train segment 40. In this latter case, a simple rapid transit type coupler 107 carried well below the normal 34½ inch height will suffice. Both constructions are described in more detail below in connection with FIGS. 22–33.

Several unique sub-systems, intended to speed performance and enhance reliability are provided on each segment. These include an Electronic Assisted Air Brake, Health Monitoring, and Trailer Tie-Down subsystems. A locomotive interface system is also required if these are to be used to best effectiveness. A brief description of each sub-system is included below, as well as more detailed descriptions of each of the three platform types.

Platform Types

Figure 2:
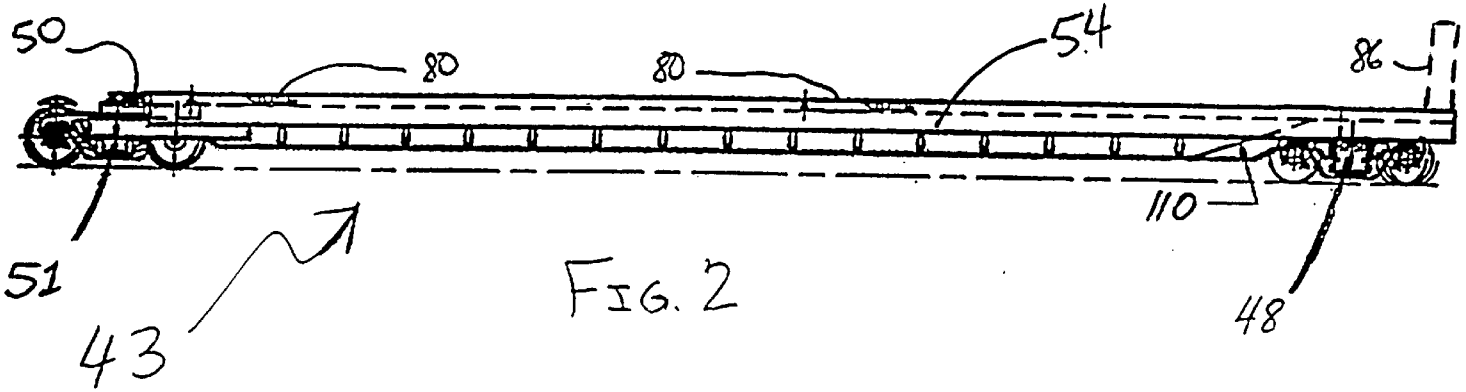
FIG. 2 is an enlarged side view of an embodiment of an adapter platform for the intermodal train shown in FIG. 1.

Each platform can have the same basic structure except for the ends. The intermediate platform 44 can serve as the "standard" platform from which the adapter and ramp platforms can be created. The economics are thus greatly improved because the standard platform can be mass produced and the other two platforms can be constructed simply by modifying the ends of the standard platform. For example, the adapter platform 43 is constructed by basically cutting the A-end off an intermediate platform 44 and welding on the modified A-end of an adapter platform 43. In FIG. 2, a splice line 110 indicates generally where the A-end of the intermediate platform 44 is cut off and the A-end configuration of the adapter platform 43 is welded on.

Figure 11:
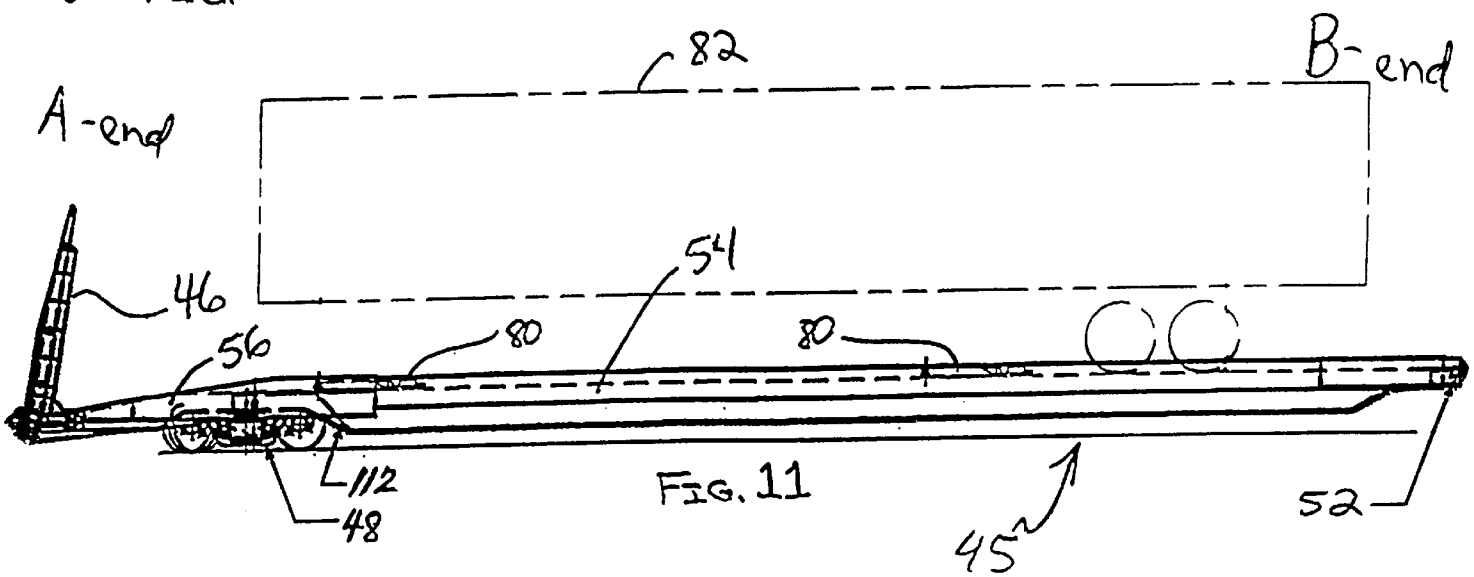
FIG. 11 is a side view of the ramp platform shown in FIG. 1.

Referring to FIG. 11, another splice line 112 indicates generally where the B-end of the intermediate platform 44 is cut off for the attachment of the B-end configuration for the ramp platform 45. Making the intermediate platform 44 the "standard" makes sense because each segment 40 of the intermodal train has preferably at least nine intermediate platforms 44 and only one each of the adapter 43 and ramp 45 platforms.

Adapter Platform

The adapter platform 43, as mentioned, has one conventional knuckle coupler 47 on its A-end, and one truck at each of the A- and B-ends. The coupler 47 is carried by a 15 inch travel "buff only" hydraulic draft gear 49, while the trucks proposed are both of the swing motion type. The A-end truck 48 is a 28 inch low conveyance model with normal seventy ton bearings and axles, while the B-end truck 51 is a 33 inch wheel model equipped with oversize bearings. These trucks 48, 51 provide improved ride and tracking characteristics as compared to a standard three-piece truck. Constant contact "teks pac" type side bearings are proposed in order to control truck hunting at high speed. Use of this type truck is required if conventional (non-AAR) trailers are to be carried, because general service trailers should not be lifted, have softer springs and lack the longitudinal strength specified by AAR for conventional piggyback service.

Figure 15:
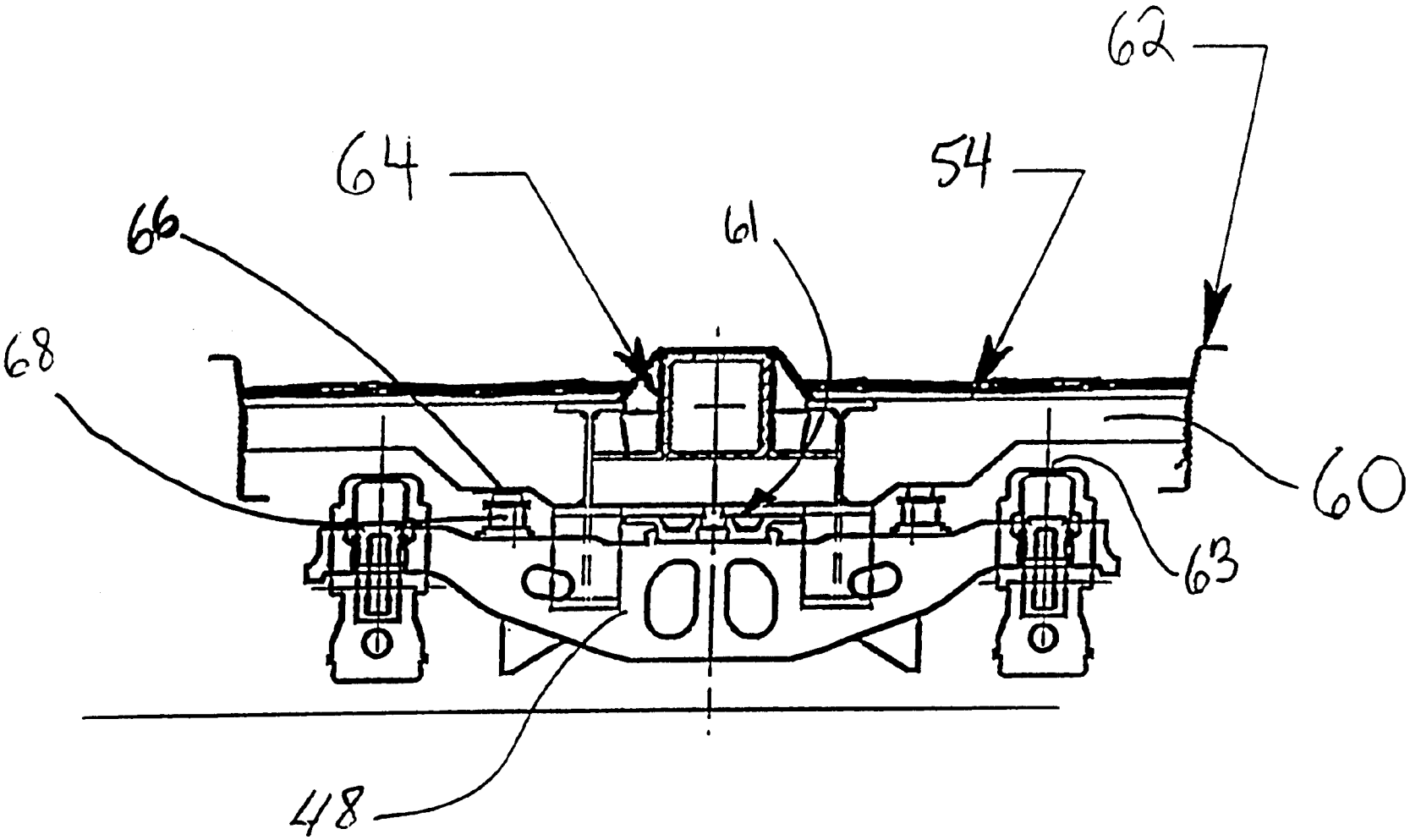
FIG. 15 is an enlarged view of the section view in FIG. 5.
Figure 16:
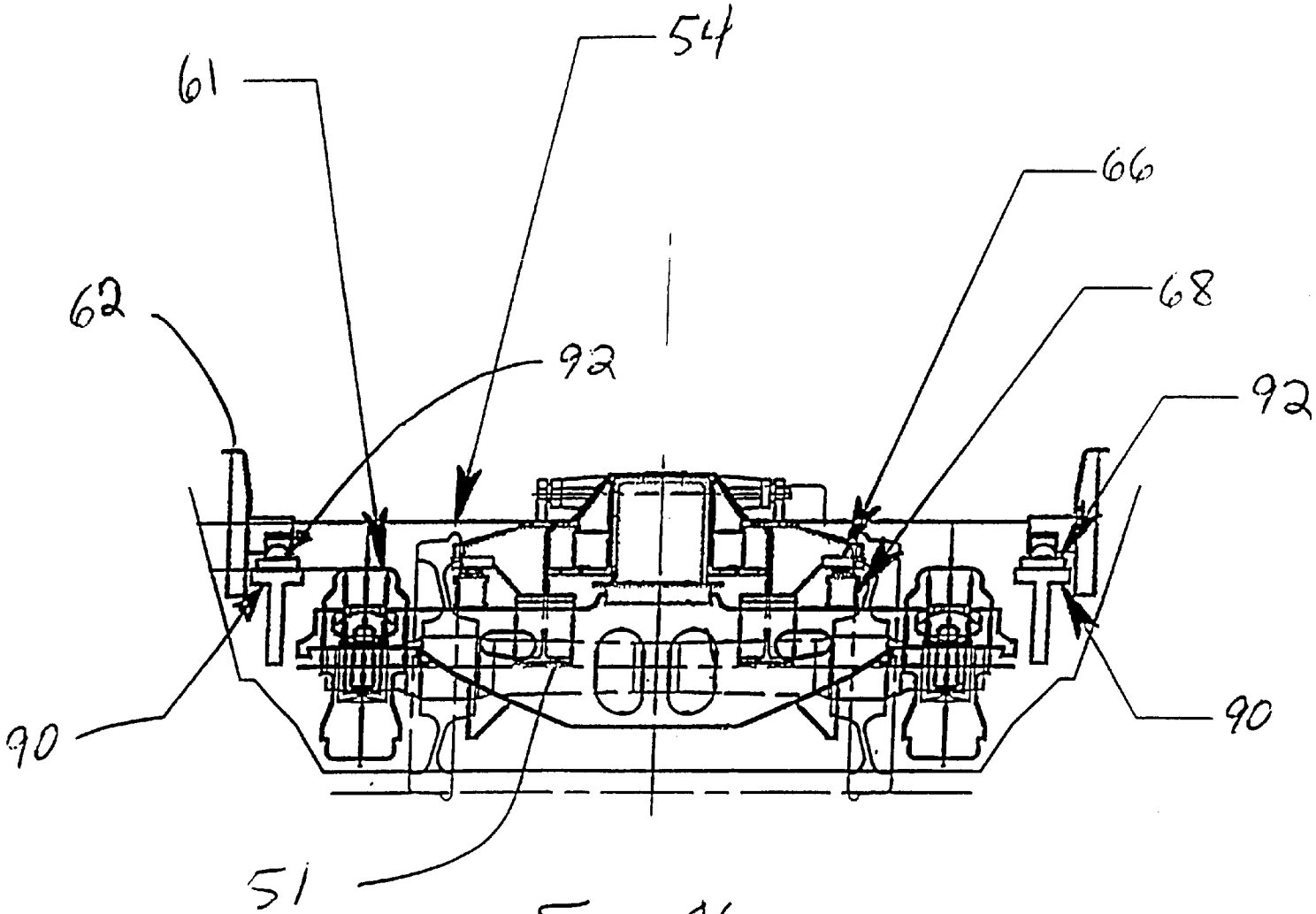
FIG. 16 is a sectional view through line XVI—XVI in FIG. 3.

An enlarged cross sectional view of the construction of the carbody bolster 60 and 28 inch truck 48 mounting at the A-end is shown in FIG. 15, while FIG. 16 shows a similar view taken at the B-end. FIG. 16 illustrates the unique construction of the platform over the B-end 33 inch trucks 51 which is common to all of the intermediate platforms 44. Of particular importance is the fact that there is no carbody bolster 60 over the truck side frame 63. This allows the deck 54 to be brought down to the desired height with only a minimum deck thickness above the side frame 63, as shown in FIG. 16.

The A-end of the adapter car 43 uses a conventional carbody bolster 60 and center plate 61 as well as the previously mentioned 15 inch hydraulic draft gear 49 and F-type knuckle coupler 47. Use of this draft gear 49 is recommended because of the slack-free nature of the segment 40 and is particularly important when coupling to a locomotive or conventional equipment, as the long articulated train structure would otherwise act as a huge single mass, and if coupled to at any but the lowest speed, could cause damage to the couplers and other parts of the conventional equipment.

Figure 17:
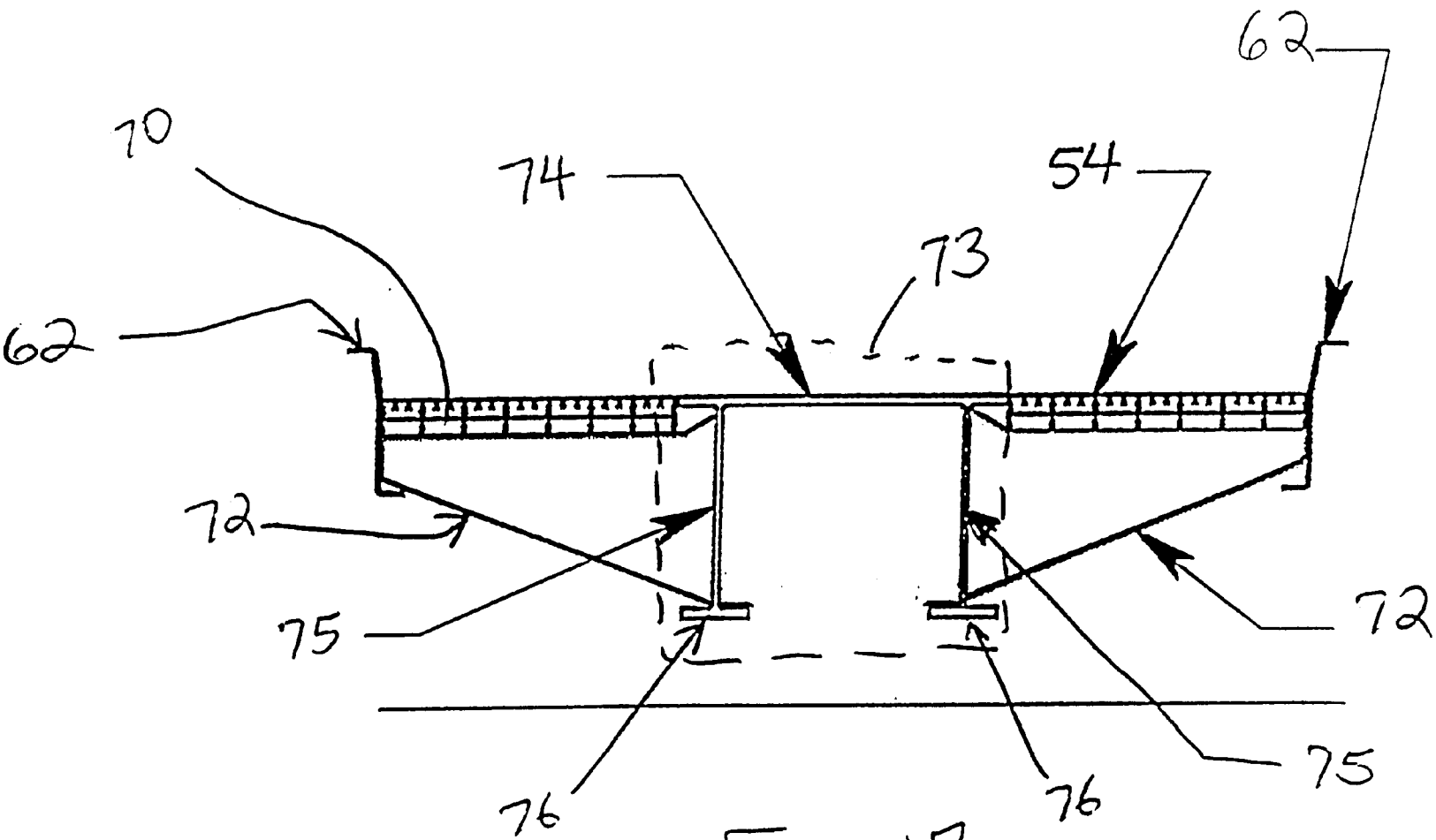
FIG. 17 is an enlarged view of the section view in FIG. 9.

The deck 54 of each platform 43, 44, 45 is preferably made from steel gratings 70 supported by formed gussets 72 running from the center sill 73 of the platform to the side sills 62, as shown best in FIG. 17. The side sills 62 are formed channels and are set above the height of the deck 54 so as to provide curbs which aid in preventing a trailer from being inadvertently pushed off of the deck when backing into loading position.

The use of grating 70 for the deck 54 is aimed primarily at making the deck 54 self-clearing of snow and ice, as precipitation dropping on it can simply fall through to the rail or track bed below and need not be removed by snow blowers, plows or other apparatus. The center sill 73 is not a conventional AAR construction, but instead is constructed from a wide box beam, open at the bottom and fabricated with relatively light weight webs 75, and having a top plate 74 and bottom flanges 76 of differing thickness along the length of the structure so as to properly resist vertical bending, which is maximum at the center. This "tapered flange" approach reduces weight where bending stresses are not as high. Use of a relatively thin web 75 could allow buckling, but this is prevented by reinforcing the webs 75 by welding the grating support gussets 72 to the full height of the webs 75, as shown in FIG. 17.

Figure 18:
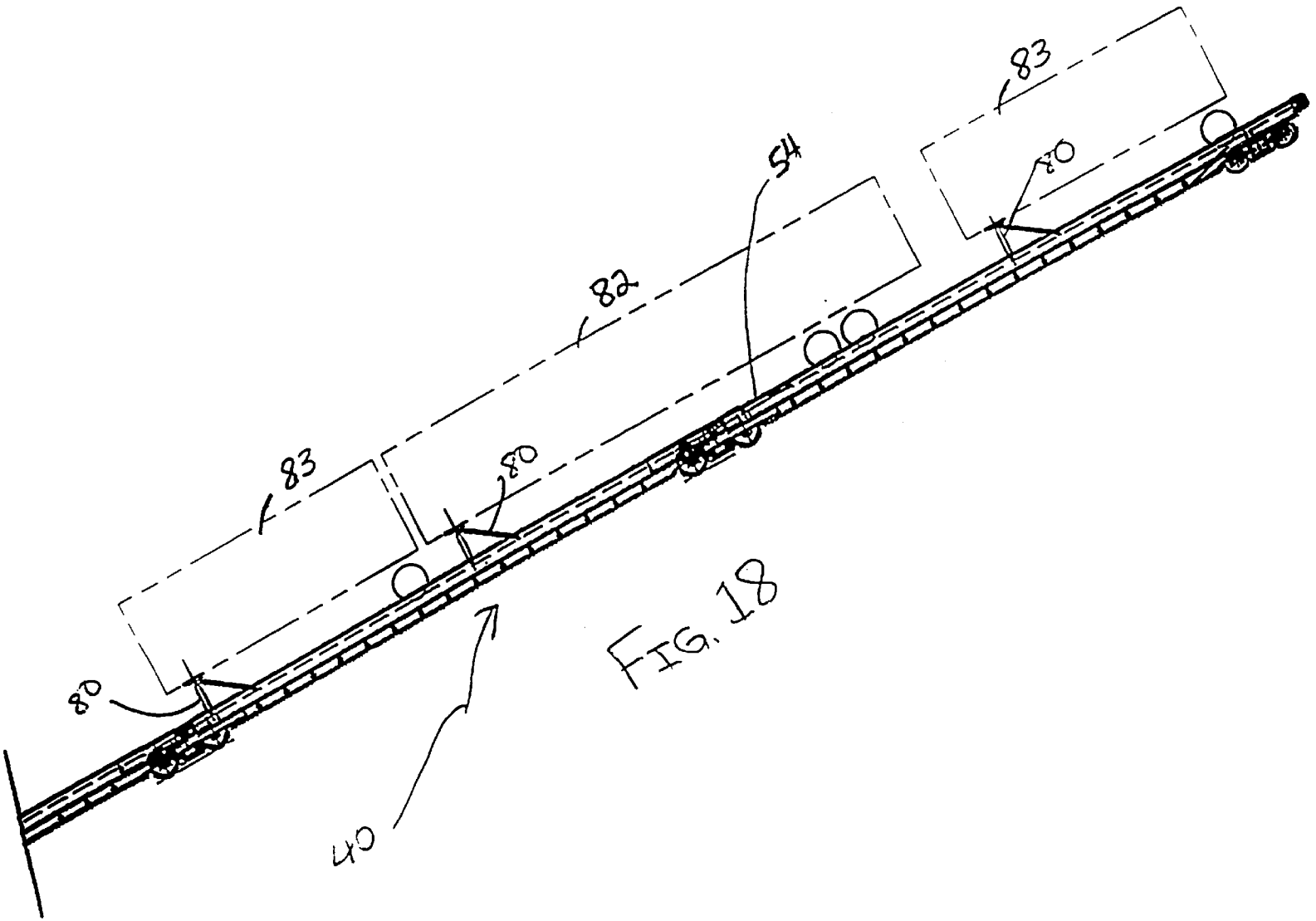
FIG. 18 is a side view of the intermodal train segment in FIG. 1 showing a random loading arrangement of trailers.

The top of the center sill 73 is also used to support the legs of the folding or "pull-up" hitches 80 which are used to secure the nose of a trailer 82 to the deck 54 by attaching to the trailer's king pin. These hitches are well known in the railway industry, but a modified version is used on the steel turnpike because the platforms will never be humped, thus sparing the design the extreme longitudinal forces imposed by trainyard impacts during switching operations. Two such hitches are secured to the outer sill 73, one near the B-end and another 29 feet away, near the center of the platform. This hitch spacing permits any presently legal trailer 82, including the extra long 57 foot trailers (legal in only 5 western states), to be efficiently carried. At the same time, the 29 foot hitch spacing allows 28 foot long "pup" trailers 83 to be loaded with only a one foot separation between nose and tail. Likewise, as shown in FIG. 18, any combination of trailers 82, 83 can be carried, loaded in random order, with long trailers 82 spanning the articulation if necessary.

The articulating connection is essentially identical at all articulated joints between each platform. At the B-end of the adapter 43 and ramp 44 platforms, upper side bearings 66 are provided to transfer any roll of the platform into the truck bolster and suspension system. Constant contact side bearings are preferably used on the truck bolster in order to both minimize carbody roll relative to the bolster, and to add rotational damping to the truck 51 as an aid to controlling truck "hunting" during high speed operation. FIG. 16 shows the upper 66 and lower 68 side bearing set up, and it can be seen that, unlike normal car building practice, there is no carbody bolster 60 extending beyond the side bearings 66, 68. It is this bolsterless construction that permits the 37 inch deck height, as use of a carbody bolster 60 would add the thickness of this part to the minimum clearance above the truck side frame 63 that is used.

At the B-end side sills, a roll stabilizer bearing shelf 90 is provided which can withstand high vertical loads. This bearing shelf 90 cooperates with a bearing shoe 92 on the A-end side sills 62 of an adjacent platform 44. This construction, shown best in FIG. 16, results in a roll stabilizer bearing which essentially connects adjacent decks 54 torsionally, which will greatly reduce carbody roll on less than perfect track. This is particularly important where trailers 82 are being carried bridging an articulated joint, because this construction reduces racking of the trailer 82 that relative roll could otherwise induce.

Figure 19:
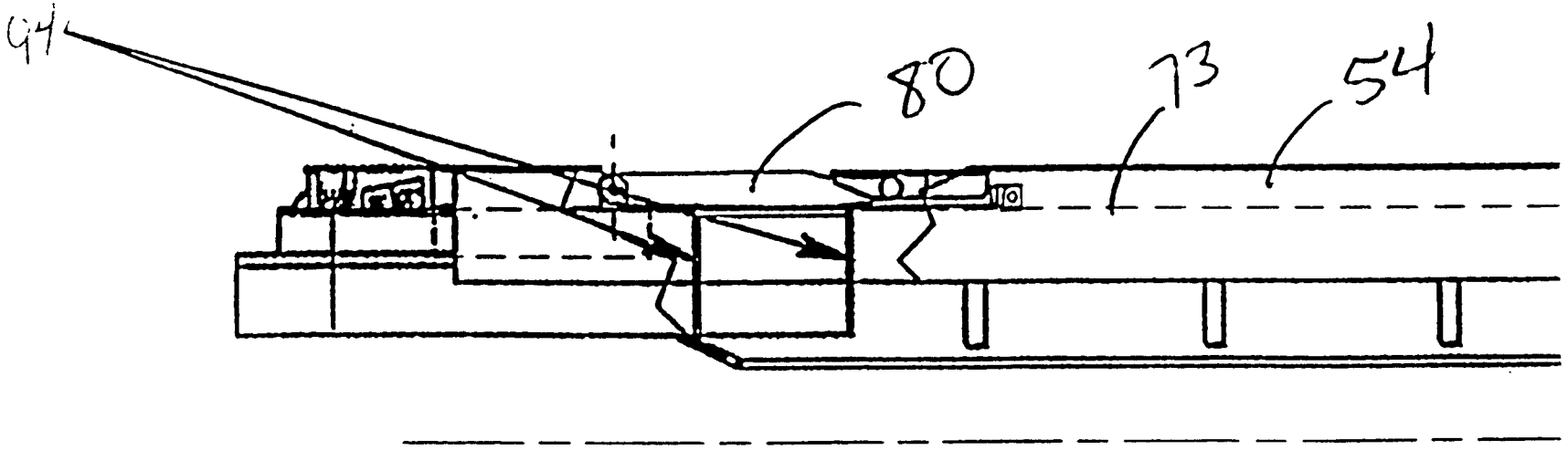
FIG. 19 is a side view partially in section of the B-end of either the adapter platform or intermediate platform illustrating the connections of the side cells to the center cell to resist vertical bending.
Figure 20:
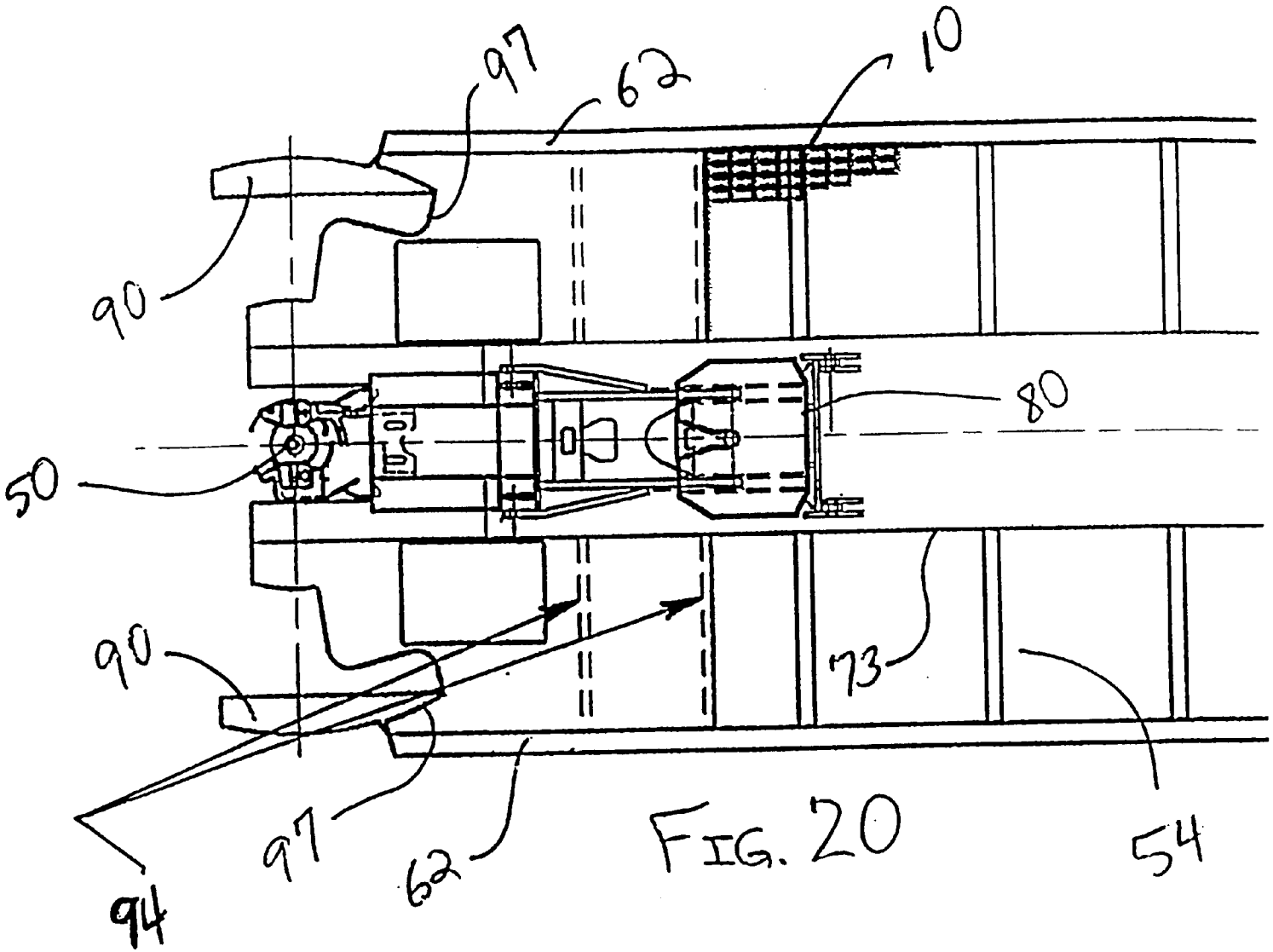
FIG. 20 is a top view partially in section of the B-end of the platform shown in FIG. 19.

Near the B-end of the adapter 43 and intermediate 44 platforms, but inboard of the truck, are a pair of structural connections 94 extending from the left side sill 62 to the left side of the center sill 73 to the right side of the center sill 73 and thence to the right side sill 62, as shown in FIGS. 19 and 20. These connections 94 are made up of the two cross connections 94 and the center sill 73 top cover plate 74 and provides the necessary vertical load carrying capacity to the side sills 62 as would be given by the carbody bolster 60 connection in a conventional carbody construction, but without introducing the additional height of the conventional carbody bolster 60 as previously discussed. That is, these connections 94 support the ends of the side sills 62 and transmit vertical side sill 62 loads into the center sill 73.

Figure 21:
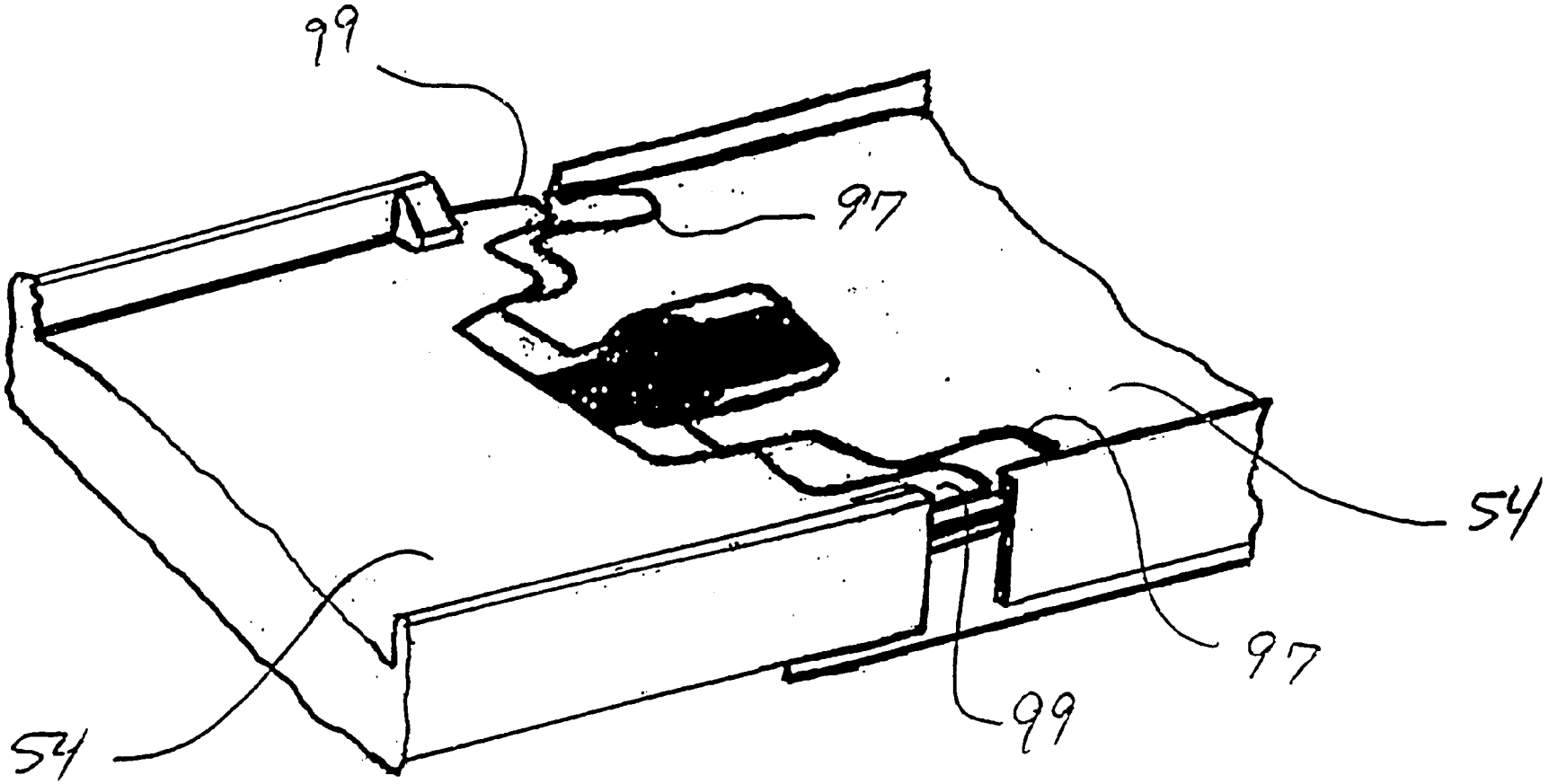
FIG. 21 is a perspective view, partially in section, showing the interleaved deck structure.

An interleaved deck structure, shown best in FIG. 21, is preferably provided where the decks 54 of each articulated platform 43, 44, 45 mate. For example, as shown, at the deck connection of the adapter platform 43 to the first intermediate platform 44, the deck structure 54 is interleaved with its mate in such a way that when the segment 40 rounds a curve there is no scraping of one platform's deck 54 on top of the other, as would be the case for a conventional bridge plate left in the lowered position. An advantage of interlacing the deck end structures in this manner, which is common at all the articulations, is that an uninterrupted platform is provided from end to end of the entire segment, which has been shown to greatly speed the loading process. As shown, the B-end of the deck 54 has a slotted curvature 97 near each side sill 62 into which can be received a correspondingly curved extension 99 of the A-end of an adjacent deck 54 when the articulated platforms round a curve.

Referring back to FIG. 16, the construction at the A-end of the adapter platform 43, is more conventional in that it does have a carbody bolster 60, stub AAR center sill 64, a center plate 61 and draft gear attachments 49. Unlike the intermediate 44 and ramp 45 platforms, however, the adapter platform 43 A-end supports only one end of one platform, thus carrying much less weight than the other trucks 51. This permits the use of the 28 inch diameter wheel truck 48 under the A-end which provides an additional 5 inches over the truck frame 63 and permits the application of the aforementioned wide box beam center sill 73.

One other feature of the adapter platform 43 is that it permits the use of a 36 inch high bulkhead 86 at the A-end which would prevent driving a trailer off platform end of the car in the event of operator error.

Intermediate Platform

Figures 4, 5, 6, 7:
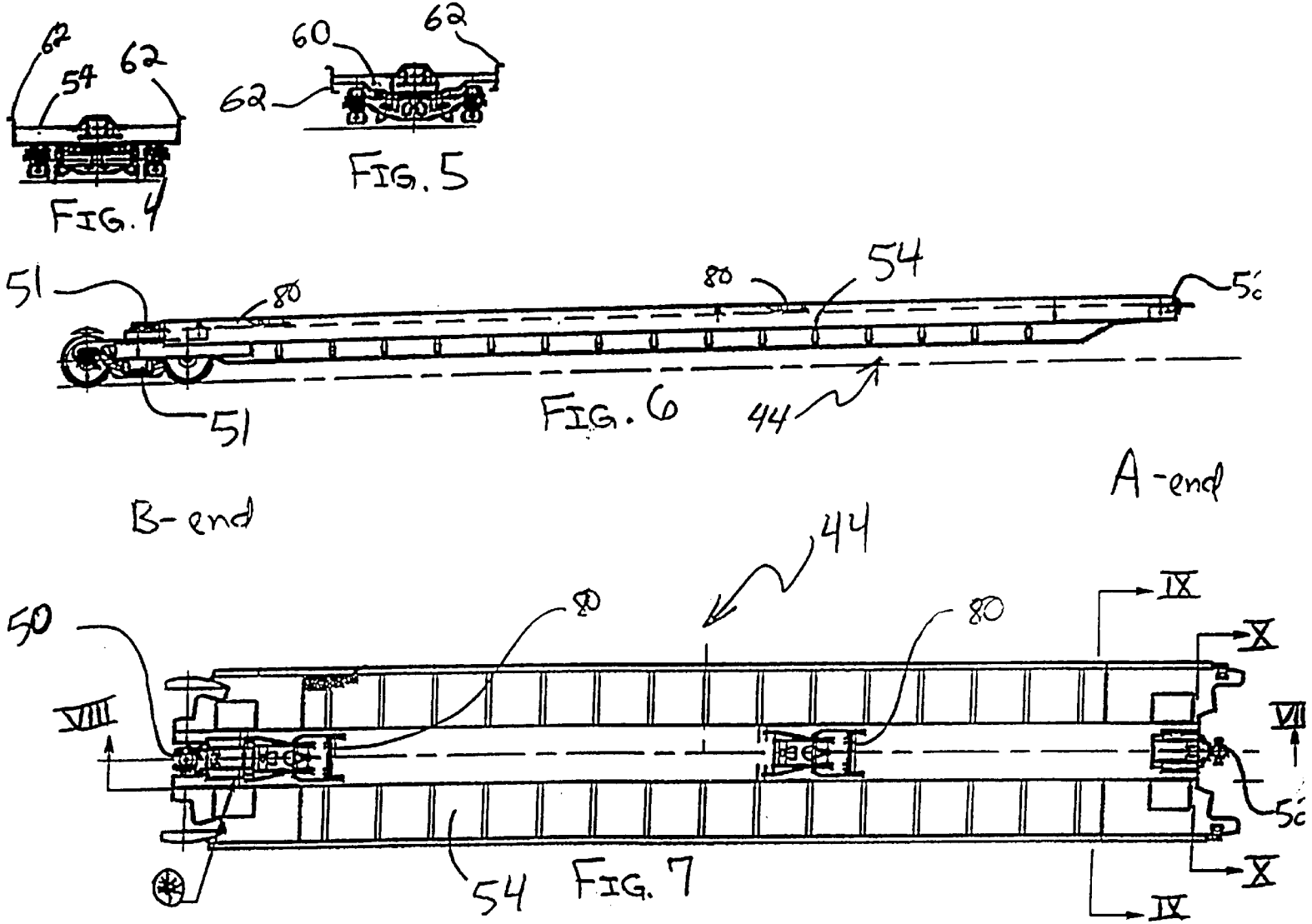
FIG. 4 is an end view of the adapter platform shown in FIG. 2.
FIG. 5 is a section view taken along the line V—V of FIG. 3.
FIG. 6 is a side view of the intermediate platform shown in FIG. 1.
FIG. 7 is a top view of the intermediate platform shown in FIG. 6.
Figure 8:
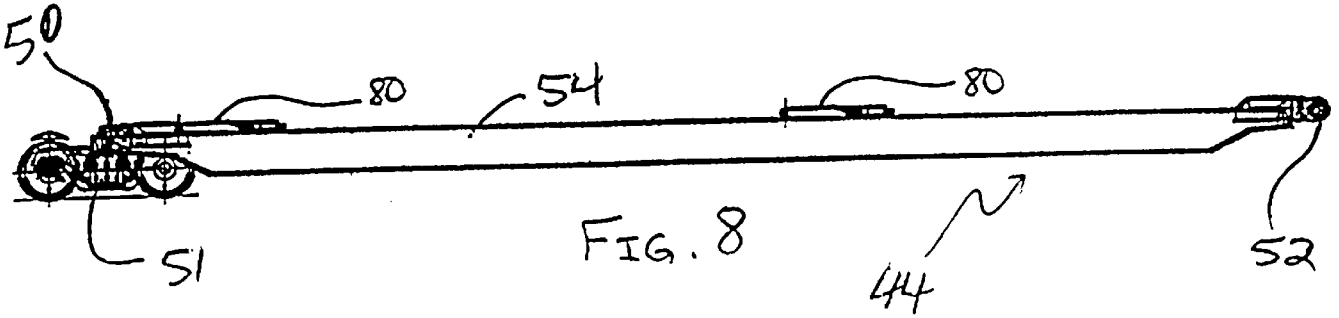
FIG. 8 is a section view taken along the line VIII—VIII in FIG. 7.
Figure 10:
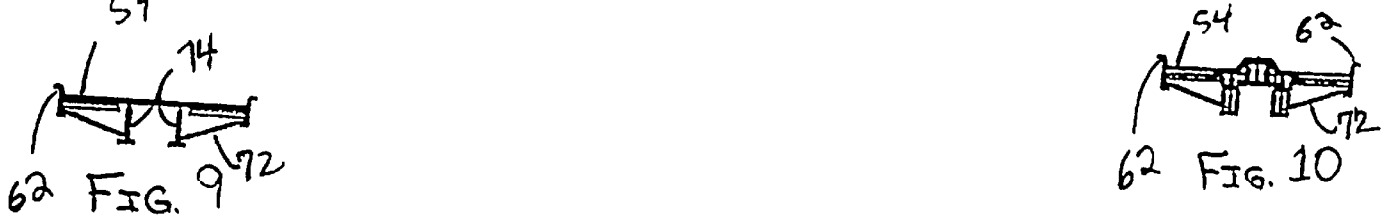
FIG. 10 is a section view taken along the line X—X in FIG. 7.

The intermediate platform 44, shown in FIGS. 6–8, shares almost all of the features above described, except that it has a truck 51 at the B-end only, and the center sill 73 connection to the side sills 62 is essentially identical at both ends. The A-end of the center sill 73 carries a male articulation joint connector 52. The articulated joint proposed, Cardwell Westinghouse SAC-1 type, is designed to take the weight of the platform 44 from the male half 52 into the female half 50 at the B-end of an adjacent platform and thence down into the truck 51 associated with the female connector 50.

Additionally, the A-end has the aforementioned bearing shoes 92 and the B-end has the bearing shelves 90. The side bearings 66, 68 of the truck 51 are used to steady the B-end of the intermediate platform 44 against roll motion, and the bearing shelves 90 cooperate with the bearing shoes 92 on the A-end of an adjacent platform, in the manner same described for the adapter platform 43, to provide roll stability. This coupling of adjacent platform side sills 62 results in the stabilizing of the A-end of the intermediate platform 44 by the B-end of an adjacent platform. This, of course, implies that the B-end of the intermediate platform 44 is stabilized in roll by the side bearings 66, 68 of an associated truck, which is insured by using constant contact side bearings.

Any number of intermediate platforms 44 may thus be assembled into a segment 40 with one adapter platform 43 at the head and one ramp platform at the tail. A presently preferred intermodal train segment 40 would consist of 11 platforms, namely, one adapter platform 43, 9 intermediate platforms 44, and 1 ramp platform 45. This particular combination is preferred primarily to achieve economy in the braking system and easy interchangeability of intermediate platforms 44 in groups of three within a segment 40, so as to produce longer or shorter segments, or effect repairs without unduly withdrawing equipment from service.

Ramp Loader Platform

Figures 12, 13, 14:
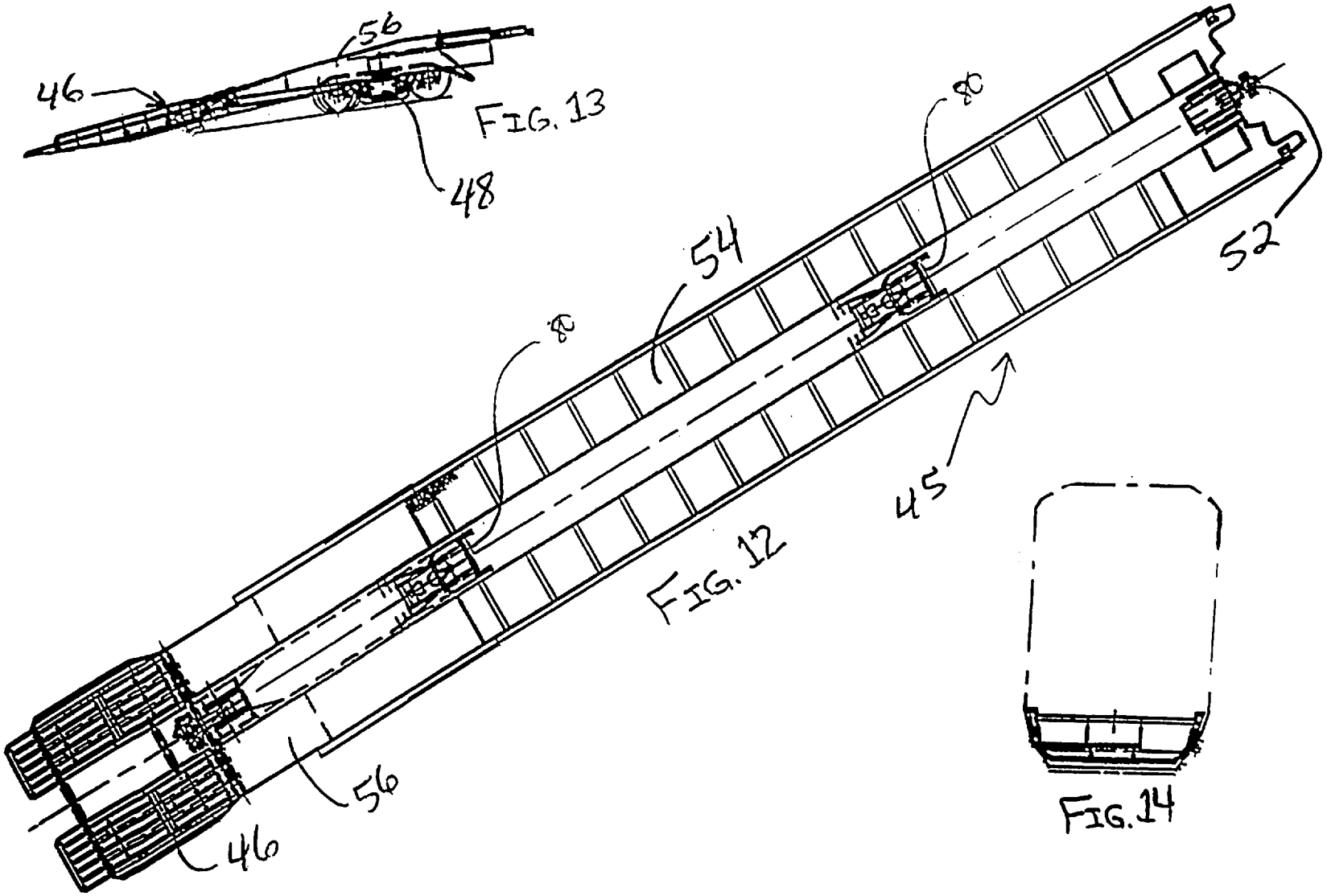
FIG. 12 is a top view of the ramp platform shown in FIG. 11.
FIG. 13 is a side view partially in section of FIG. 11 showing the ramp in a lowered position.
FIG. 14 is an end view of the ramp platform shown in FIG. 11 with the ramp raised.

The ramp platform 45, shown in FIGS. 11–13, is very similar to the intermediate platform 44 in that it has a truck 48 only at the B-end and depends on the sliding connection of the side sills 62 to provide roll stability at the A-end. The aforementioned sliding connection being the frictional engagement of the bearing shoes 92 on the A-end of the ramp platform 45 with the bearing shelves 90 on the B-end of an adjacent platform 44.

Referring to the drawing, the B-end employs a 28 inch wheel diameter truck 48 in a similar manner as the A-end of the adapter platform 44, but does not have a carbody bolster. The lower deck height at the 28 inch truck 48 is instead used to reduce the deck height at the B-end below 32 inches by sloping the length of the ramp platform 45 from 37 inches at the A-end down to 32 inches at the B-end. The ramp platform 45 is otherwise identical to the adapter 43 and intermediate 44 platforms.

The reduction in deck height at the end of the ramp platform 45 where the ramp 46 is attached reduces the length of ramp 46 necessary to climb from ground level to the deck. This length can be further reduced by sloping an extended portion 56 of the deck downward beyond the B-end truck, at the same slope as the ramp 46 will use (approximately 1 in 8) by lowering the end of the ramp platform 45 at its attachment point to the ramp 46. The length, and hence the weight, of the ramp 46 are greatly reduced by this technique, thus allowing simplification of the ramp lifting and stowing mechanism.

As a result, the deck height at the B-end of the ramp platform 45 is only 17¼ inches above top of the rail at the end sill. Hinged to the car structure at this point is the loading ramp 46 which has a length of only about 10 feet 3⅝ inches. This short ramp length can be efficiently counterbalanced throughout its operating angle of over 90 degrees by the use of a spring tensioning device 160, shown in FIGS. 22–33, mounted on the end of the ramp platform 45. At the fall up position, the center of gravity of the ramp 46 is slightly inboard of its pivot points, thus the lever arm is negative and the ramp 46 is producing a torque which would fold it back onto the ramp platform 45. At this point, however, positive stops provided on the ramp 46 sides prevent further folding and hooks, provided adjacent to the stops, can be manually engaged so that the ramp 46 cannot be pulled down until the hooks are manually released.

Operating in parallel with the spring balance mechanisms just described is an air cylinder 162. When the retaining hooks mentioned above have been manually released, air can be introduced into this cylinder 162 to overcome the torque caused by the small negative lever arm and start the ramp 46 down. Once this has occurred, the unbalanced portion of the weight of the ramp 46 will tend to pull the piston out of the cylinder 162 and unfold into its loading position. The speed of this operation can be easily controlled by choking the exhaust of air from the rod end of the cylinder 162. Air for operation of the cylinder 162 can be supplied from a dedicated reservoir charged by main reservoir equalizing pipe when the train is coupled. This reservoir can be sized to permit at least two operations of the ramp 46 from an initial charge of 130 psi. Provision is also preferably made to take air from a hostler tractor for this operation without requiring the hostler to charge any other part of the train's pneumatic system.

The force pulling on the air cylinder piston 162 during the ramp 46 lifting operation could be made either positive or negative. That is to say, the ramp 46 could be designed to be either slightly overbalanced or slightly underbalanced by the spring and cam mechanism 160. Underbalance is preferred as it would allow manual lowering of the ramp 46 in an emergency situation where air was not available for its operation. Likewise, underbalance would prevent the nose of the ramp 46 from bouncing as trailers are rolled up on it.

Figure 22:
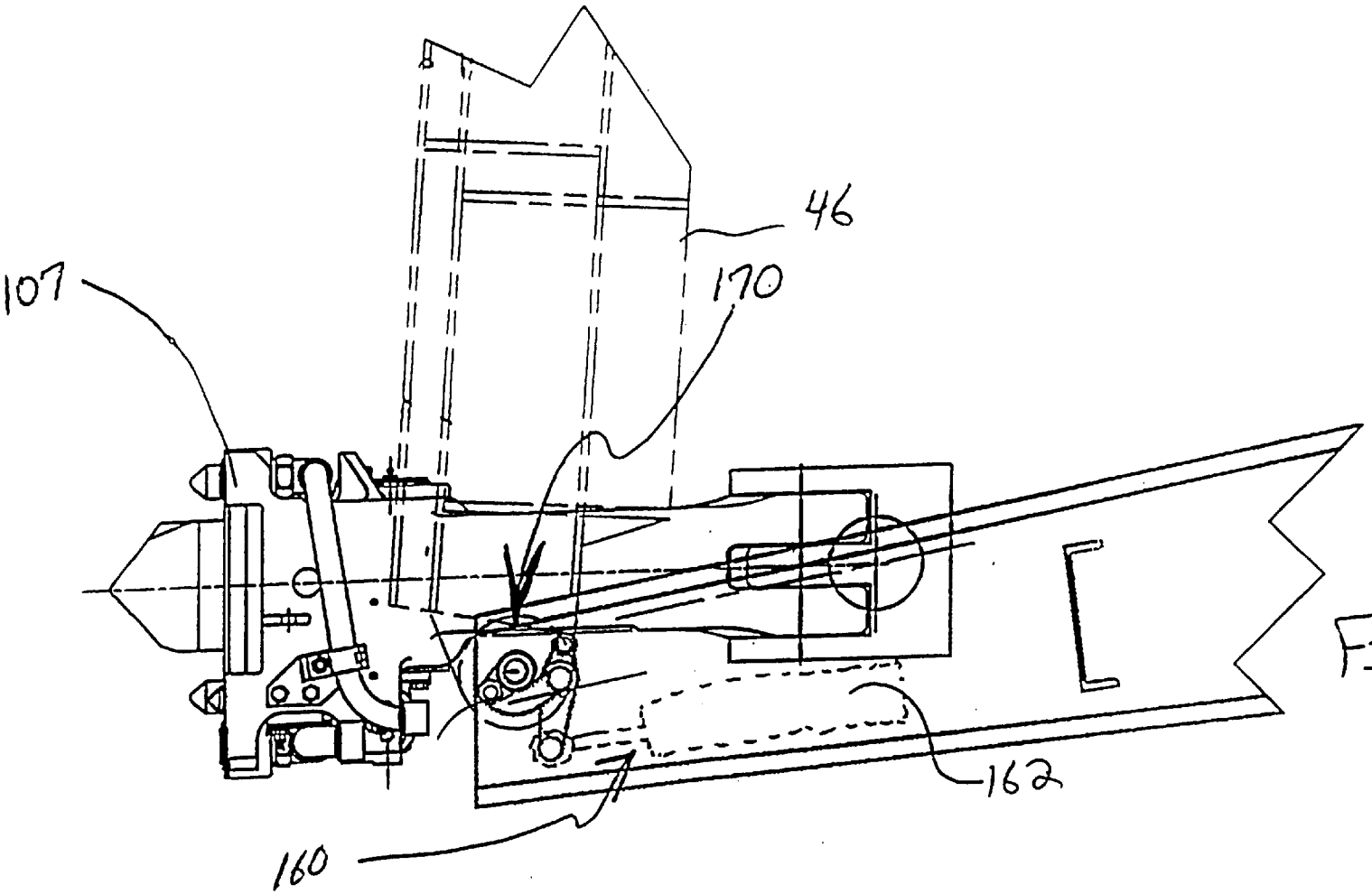
FIG. 22 is a side view partially in section of the B-end of a ramp platform and showing an embodiment of a coupler with the ramp in the raised position.
Figure 23:
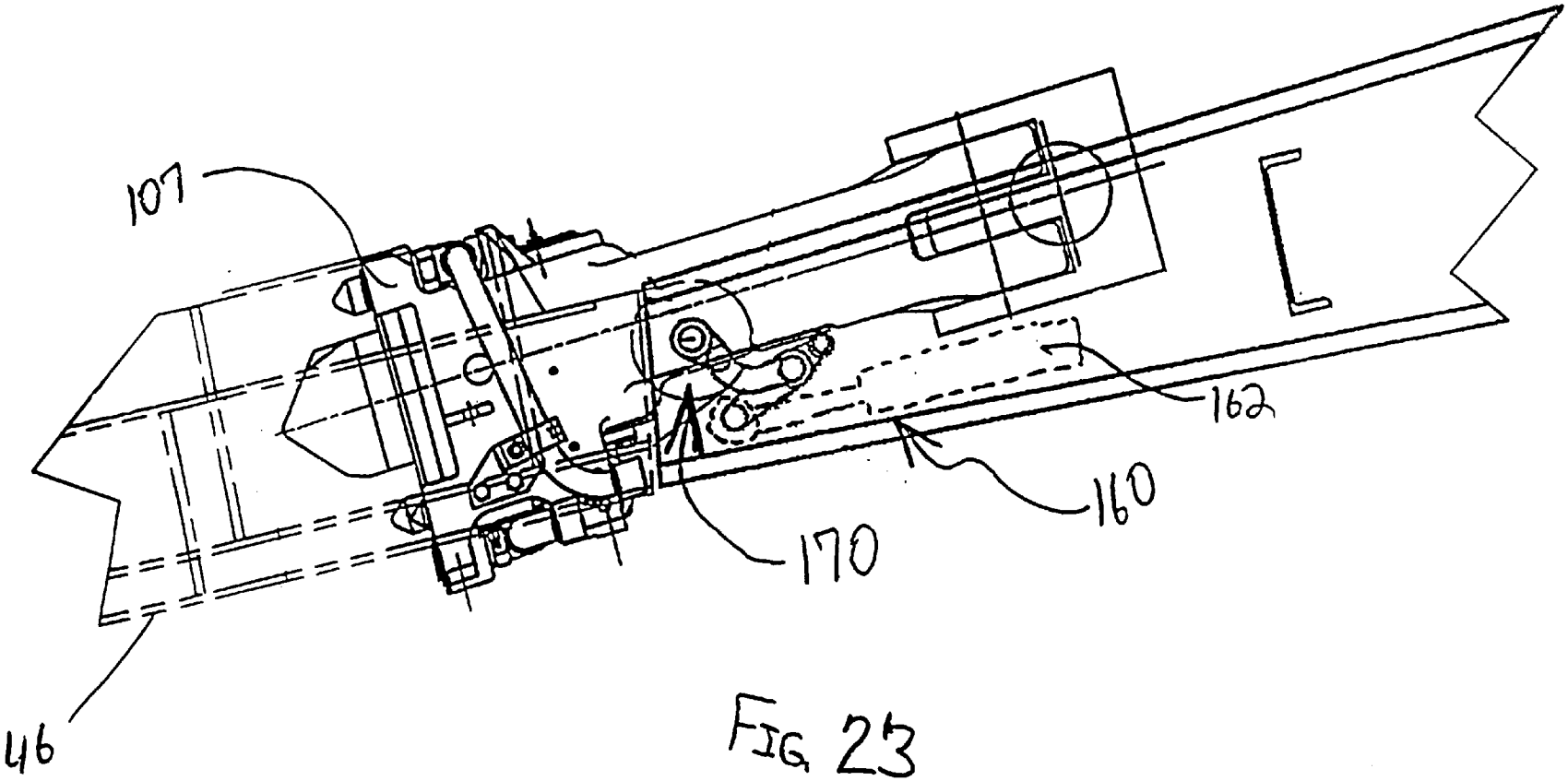
FIG. 23 is the same figure shown in FIG. 22 except showing the ramp in the lowered positioned.
Figure 24:
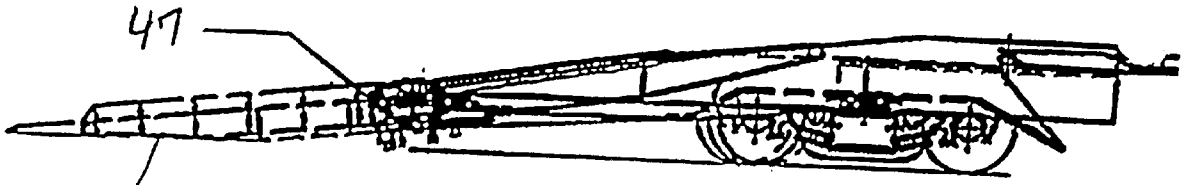
FIG. 24 is a side view partially in section of the B-end of a ramp platform showing a different embodiment of a coupler member.
Figure 25:
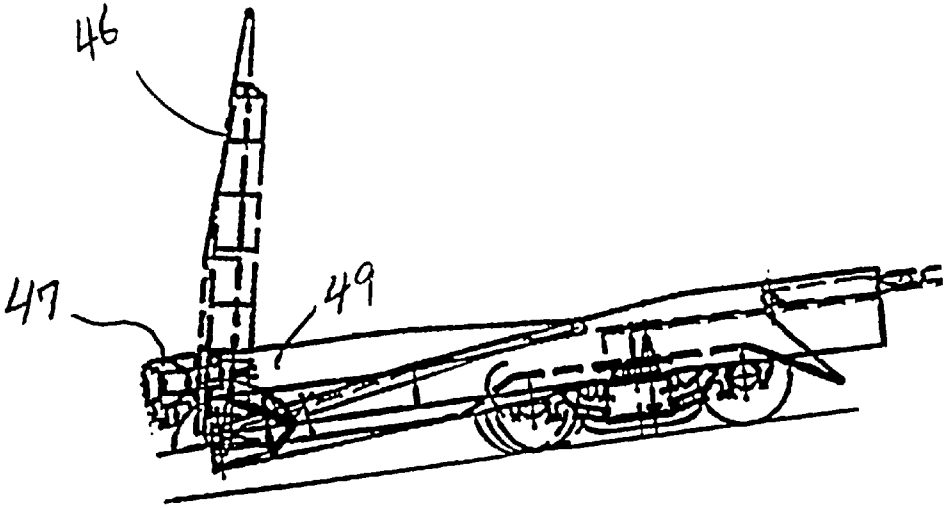
FIG. 25 is the same view as FIG. 24 except showing the ramp in a raised position.
Figure 27:
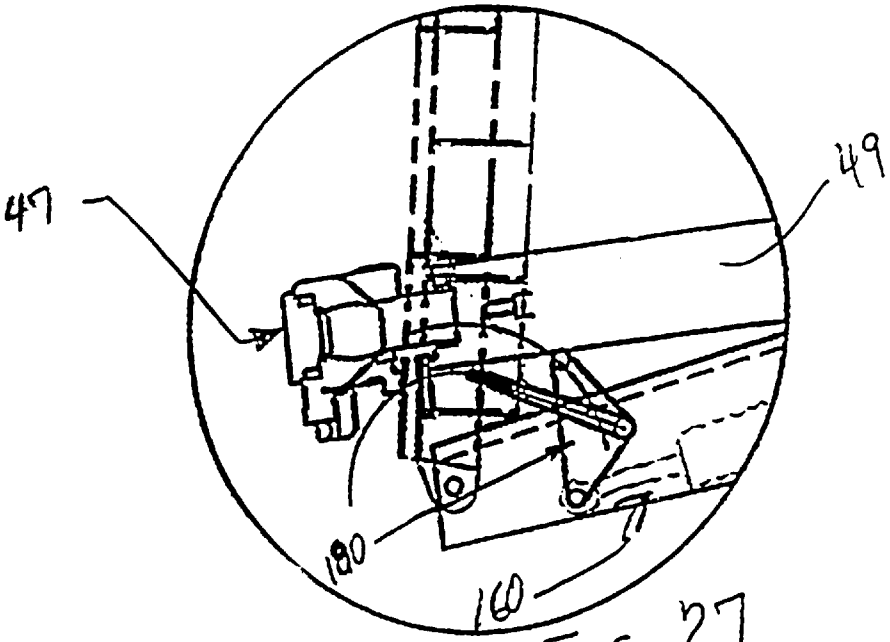
FIG. 27 is a view similar to FIG. 26 except showing the ramp in a raised positioned wherein the coupler is projecting beyond the end of the ramp platform.
Figure 26:
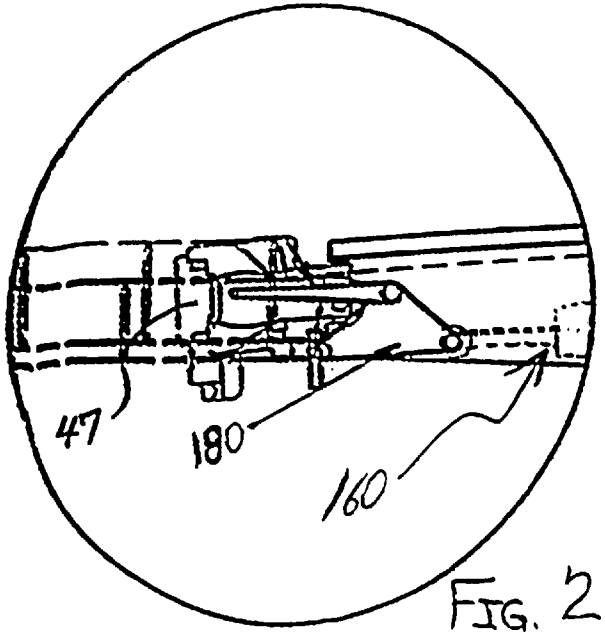
FIG. 26 is a close up view of the coupler in a lowered position as shown in FIG. 24.
Figure 28:
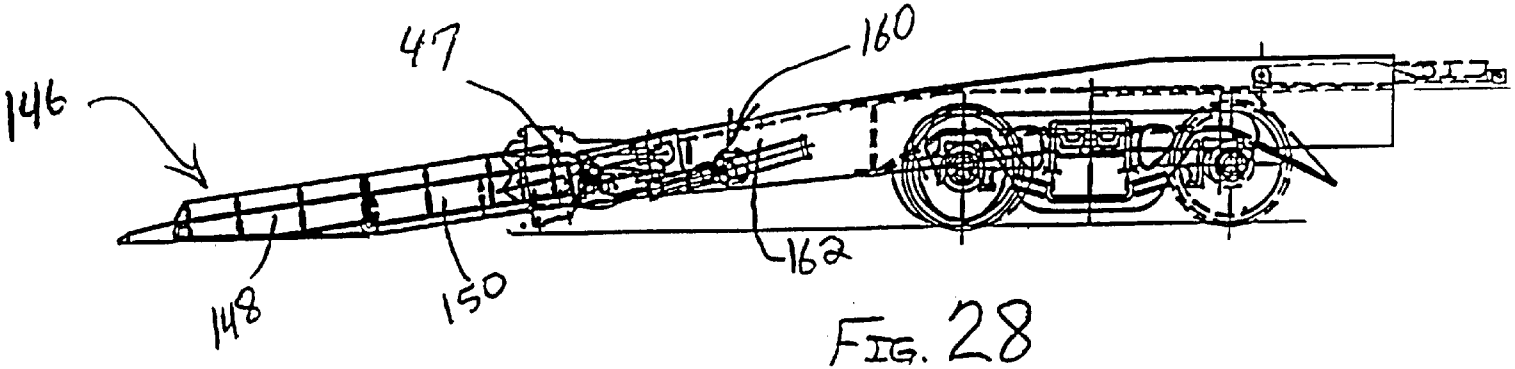
FIG. 28 is a side view partially in section of a jointed ramp member attached to the end of the ramp platform.
Figure 29:
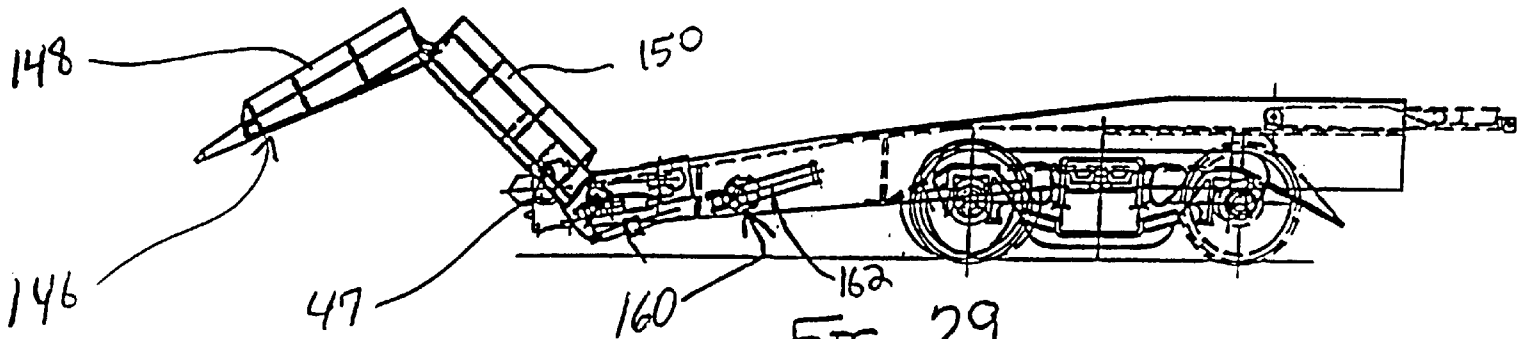
FIG. 29 is the same view as in FIG. 28 except showing the ramp in a position intermediate between the lowered and raised positions.
Figure 30:
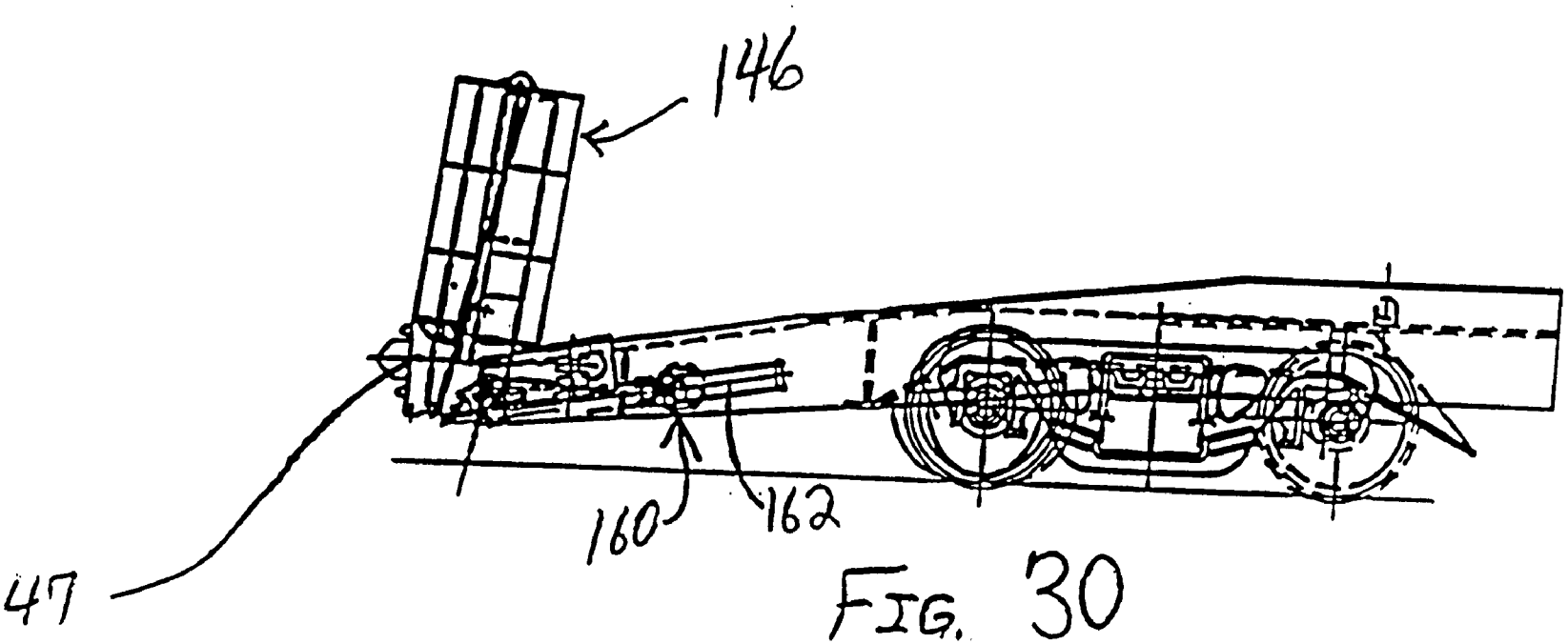
FIG. 30 is the same view as in FIG. 29 except showing the ramp in a fully retracted position.
Figure 31:
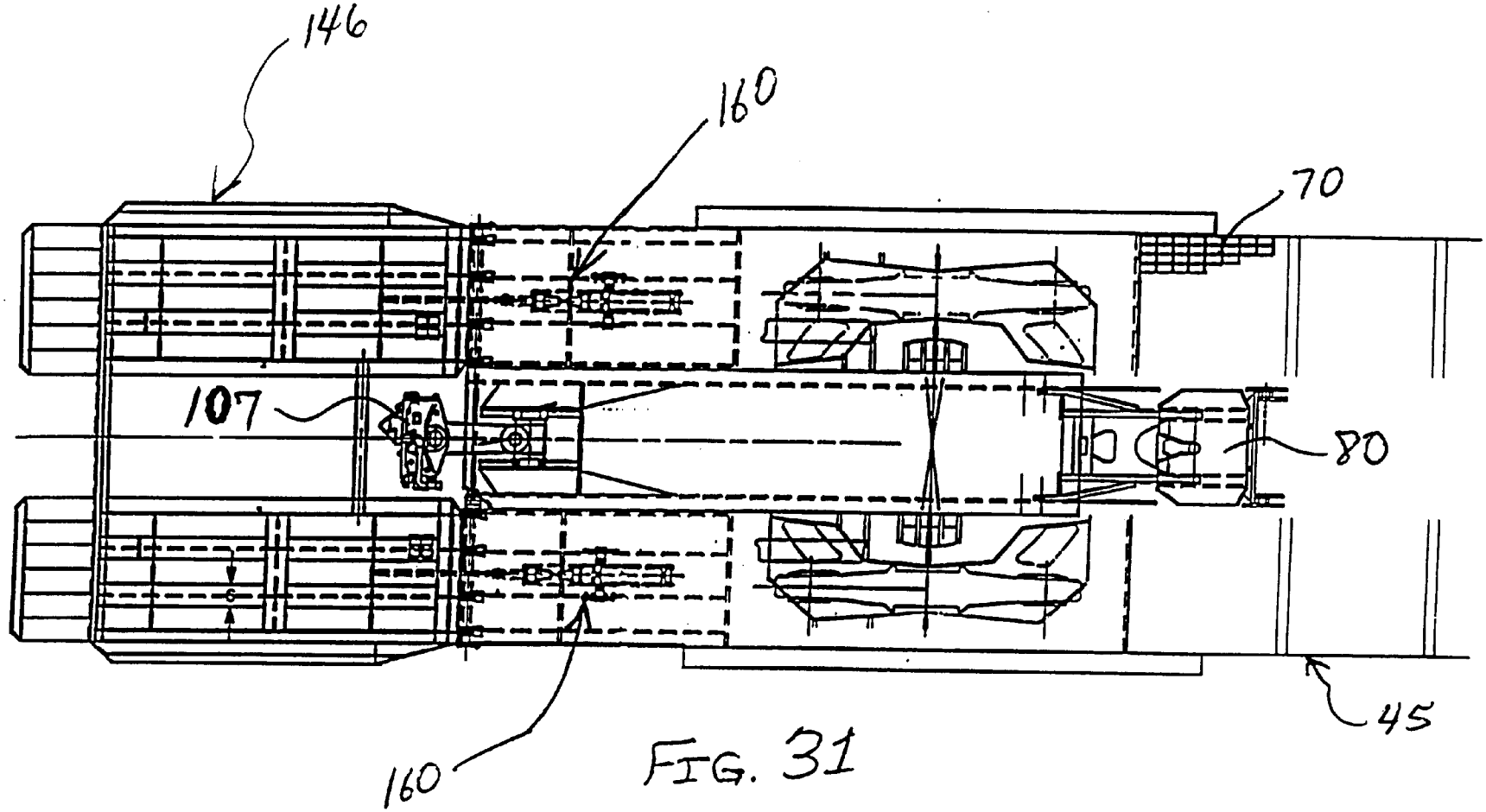
FIG. 31 is a top view, partially in section, of the ramp and ramp platform shown in FIG. 28.
Figure 38:
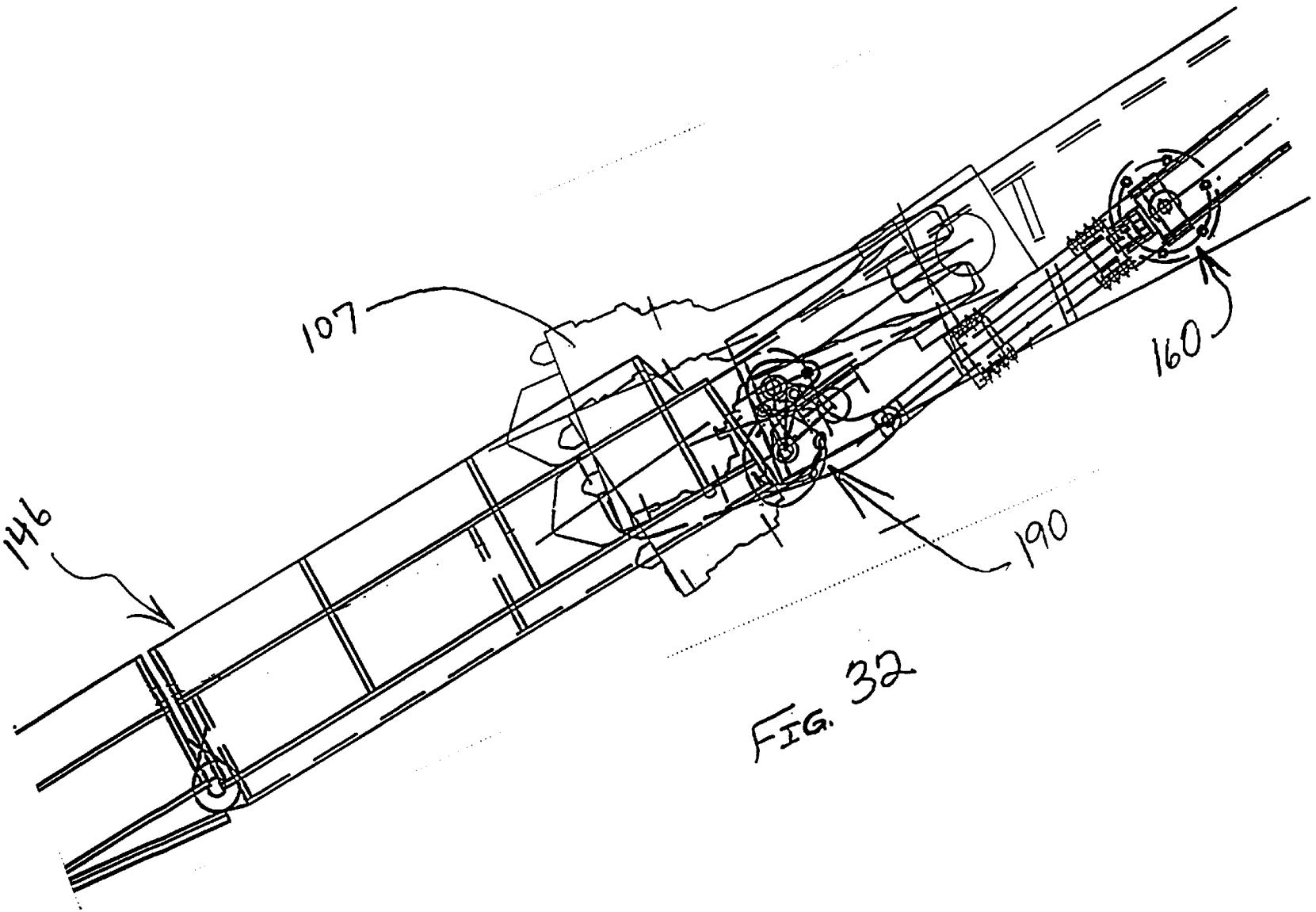
FIGS. 38*a*–38*c* are more detailed, side views, of the operating positions of the spring applied parking brake.

As shown best in the more detailed view of the same platform coupler mechanism in FIGS. 22 and 23, when the ramp 46 is up, the coupler pulling faces extend beyond the actual ramp 46 position so as to prevent interference between the end of the ramp platform 45 and whatever platform it is coupled to. Thus, the ramp end of the platform 45 may be coupled to another ramp platform 45 with no difficulty. Further, if rapid transit type couplers 107 as shown in the drawing are used, this coupling can also effect electrical and air connections.

Two coupler connections are possible. The first, as shown in FIGS. 22–23 and 28–33, uses a transit type coupler 107 at a 20 inches height and would be a very straight forward application, but would not permit the ramp platform 45 end of a segment 40 to be pulled by conventional equipment without some sort of adapter. An alternative coupler connection shown in FIGS. 24–27, uses a standard knuckle coupler 47 and can carry it at standard coupler height In both cases a retractable coupler is preferably used.

Referring back to FIGS. 22 and 23, after the ramp 46 has been swung up, the coupler's elevating mechanism 170 will be operated by the lifting of the ramp 46 and the linkage shown swings the coupler 107 up into operating position. It should be noted that while the coupler 107 is supported from below by the elevating mechanism 170, the flat faces of the two transit couplers will, when brought together, lift their heads a further half inch or so, so as not to have wear and interference between the elevating mechanism 170 and the mated couplers 107 when the train is traveling at speed.

In the alternative coupler 47 shown in FIGS. 24–27, a much more elaborate elevating mechanism 180 is needed because both the coupler 47 and draft gear 49 must be elevated to the standard 34½ inch height. This method permits coupling to conventional equipment with no adapter.

This standard coupler 47, while more universal, would not be particularly advantageous for operations where it was desired to operate trains consisting of two segments 40 coupled ramp platform 45-to-ramp platform 45 for convenience in the terminal, and its construction is typically more complex and expensive.

Figure 33:
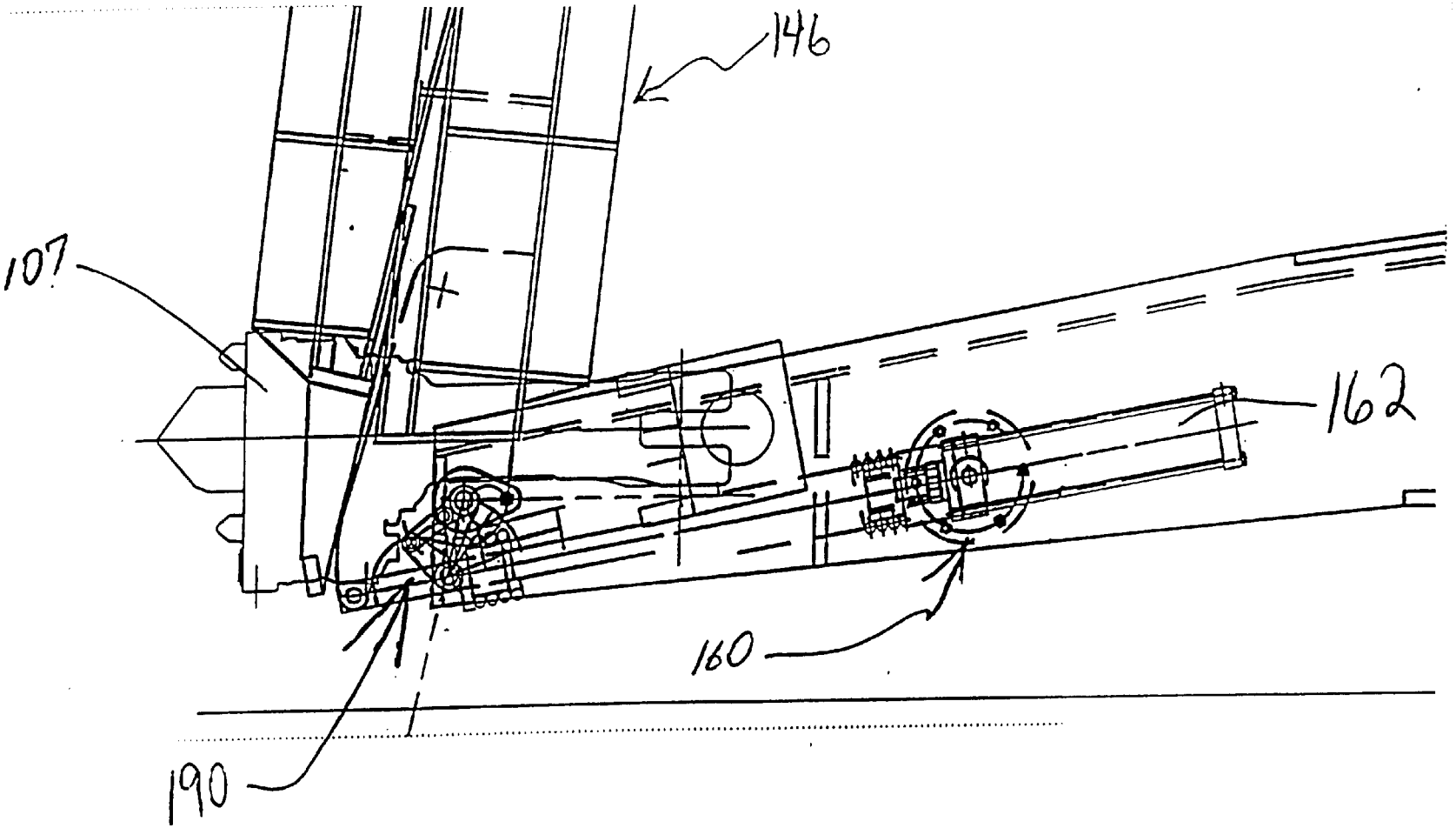
FIG. 33 is the same view as FIG. 32 except showing the ramp in a fully retracted position with the coupler extending beyond the end of the platform.
Figure 32:
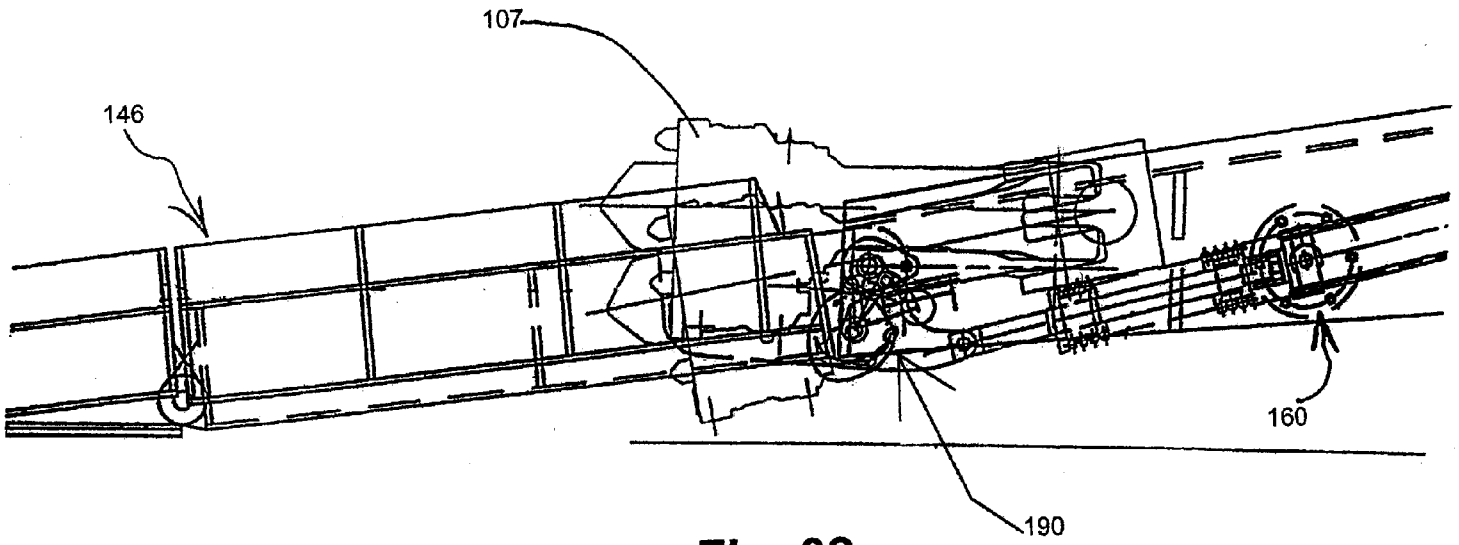
FIG. 32 is a more detailed view of the ramp attachment and coupler in FIG. 28.
Figure 33:
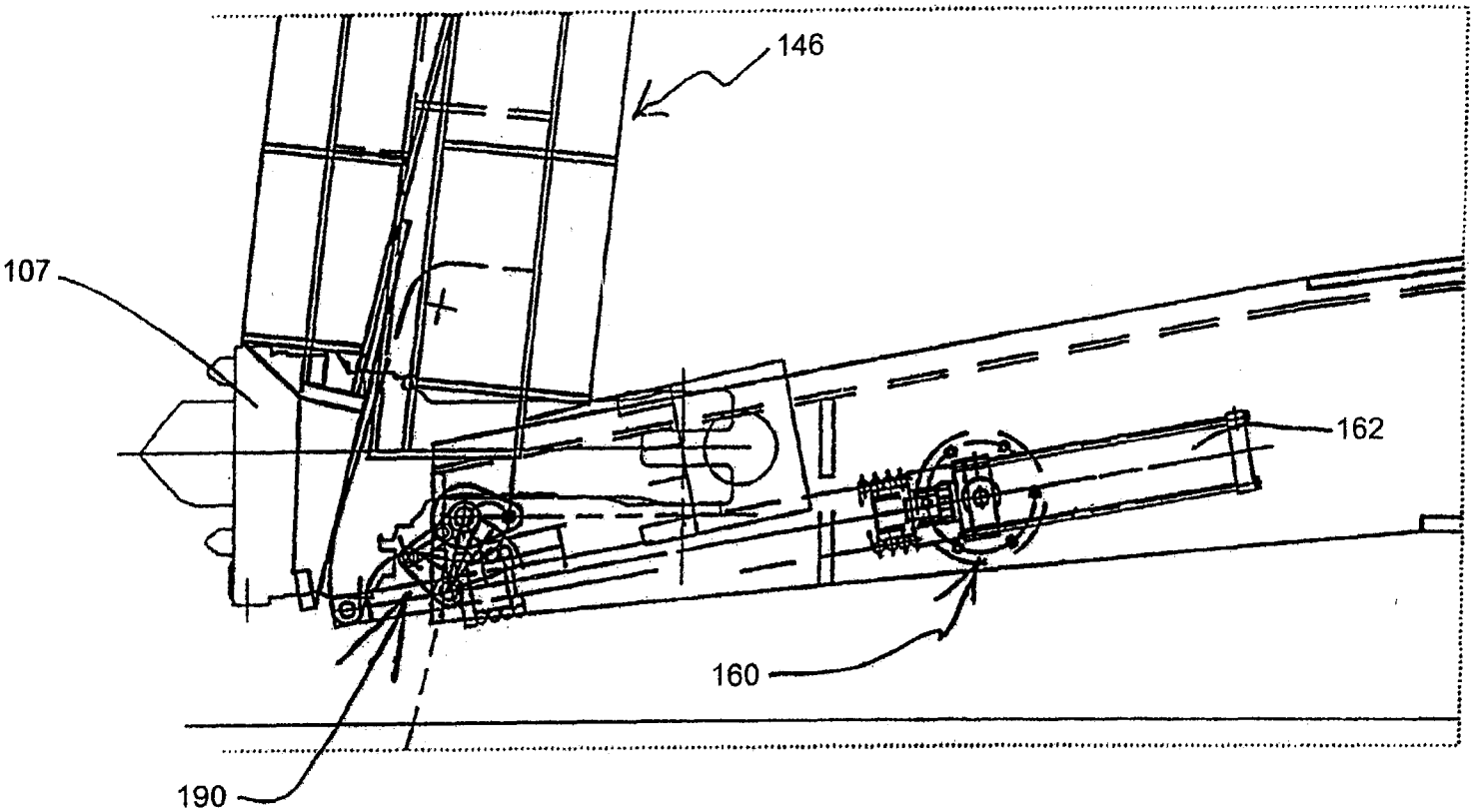
Figure 34:
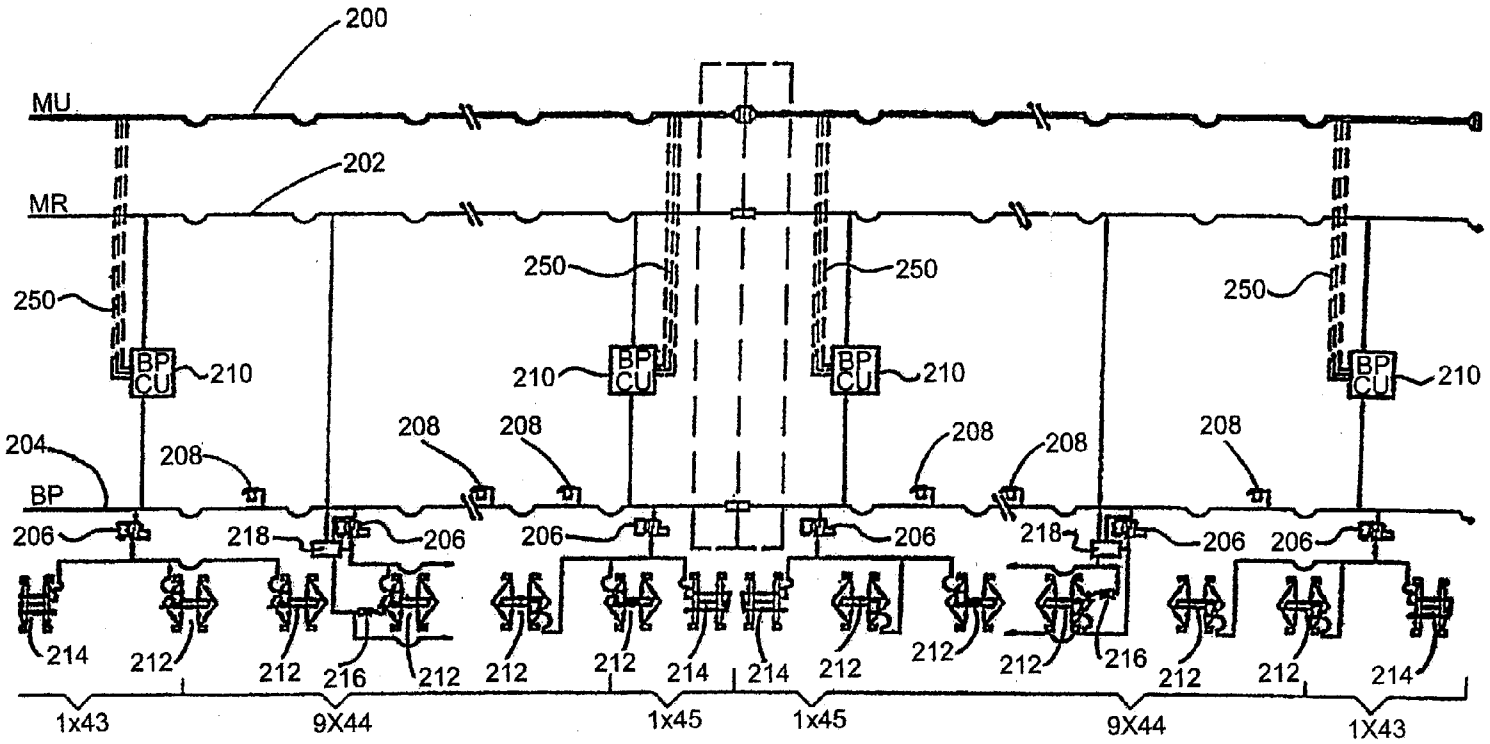
Figure 35:
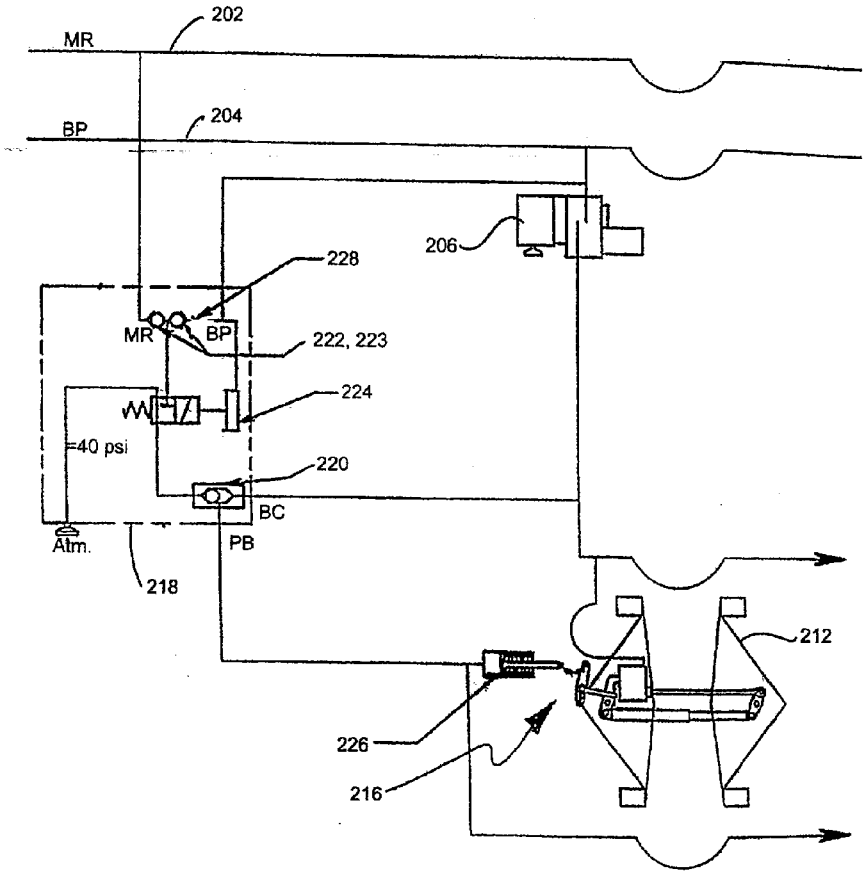
Figures 36A, 36B:
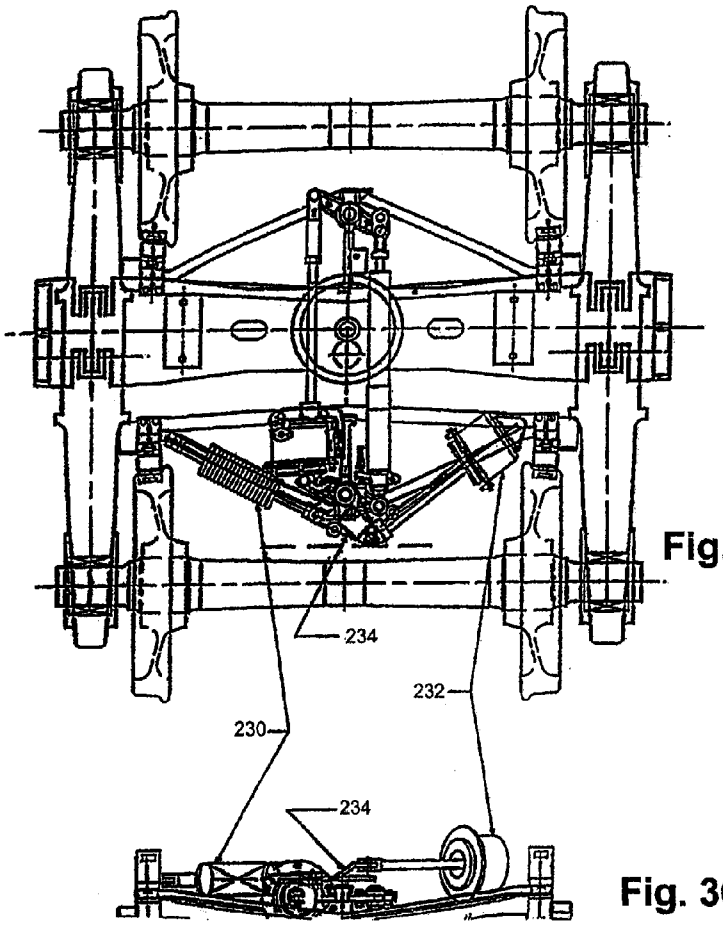
Figure 37A:
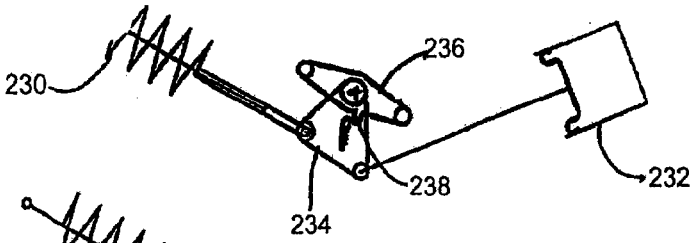
Figure 37B:
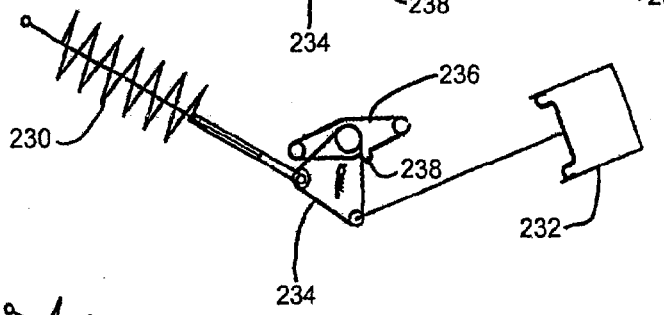
Figure 37C:
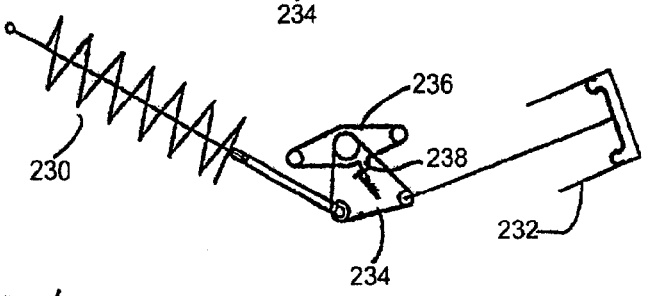
Figure 37D:
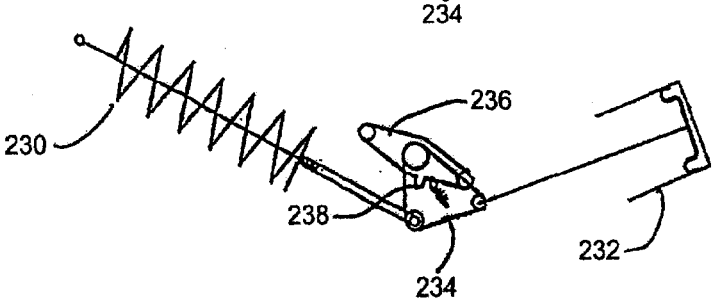
Figure 37E:
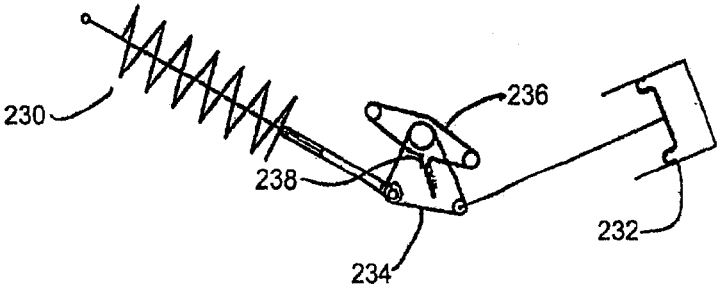
Figures 38A, 38B, 38C, 39:
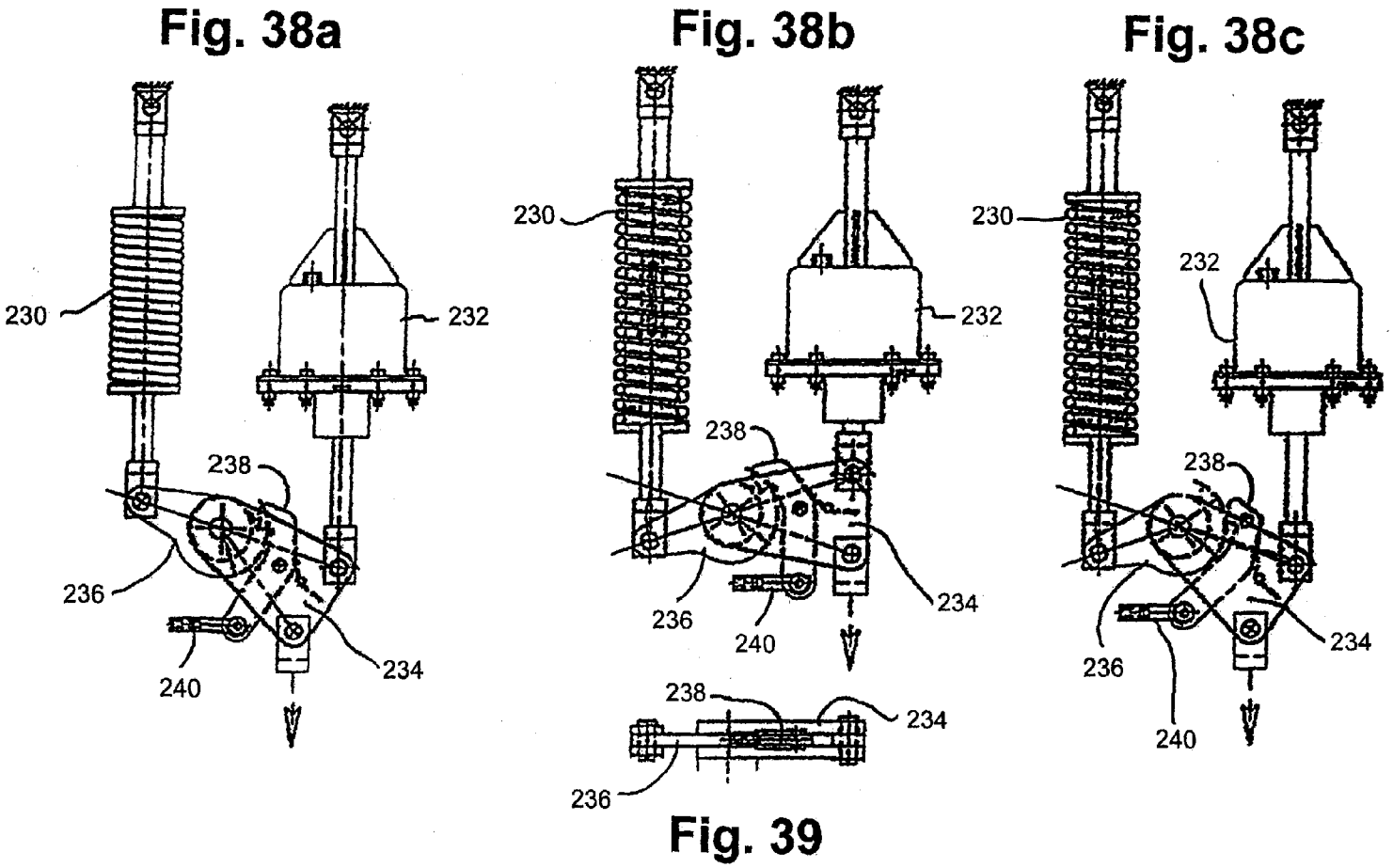
Figure 40A:
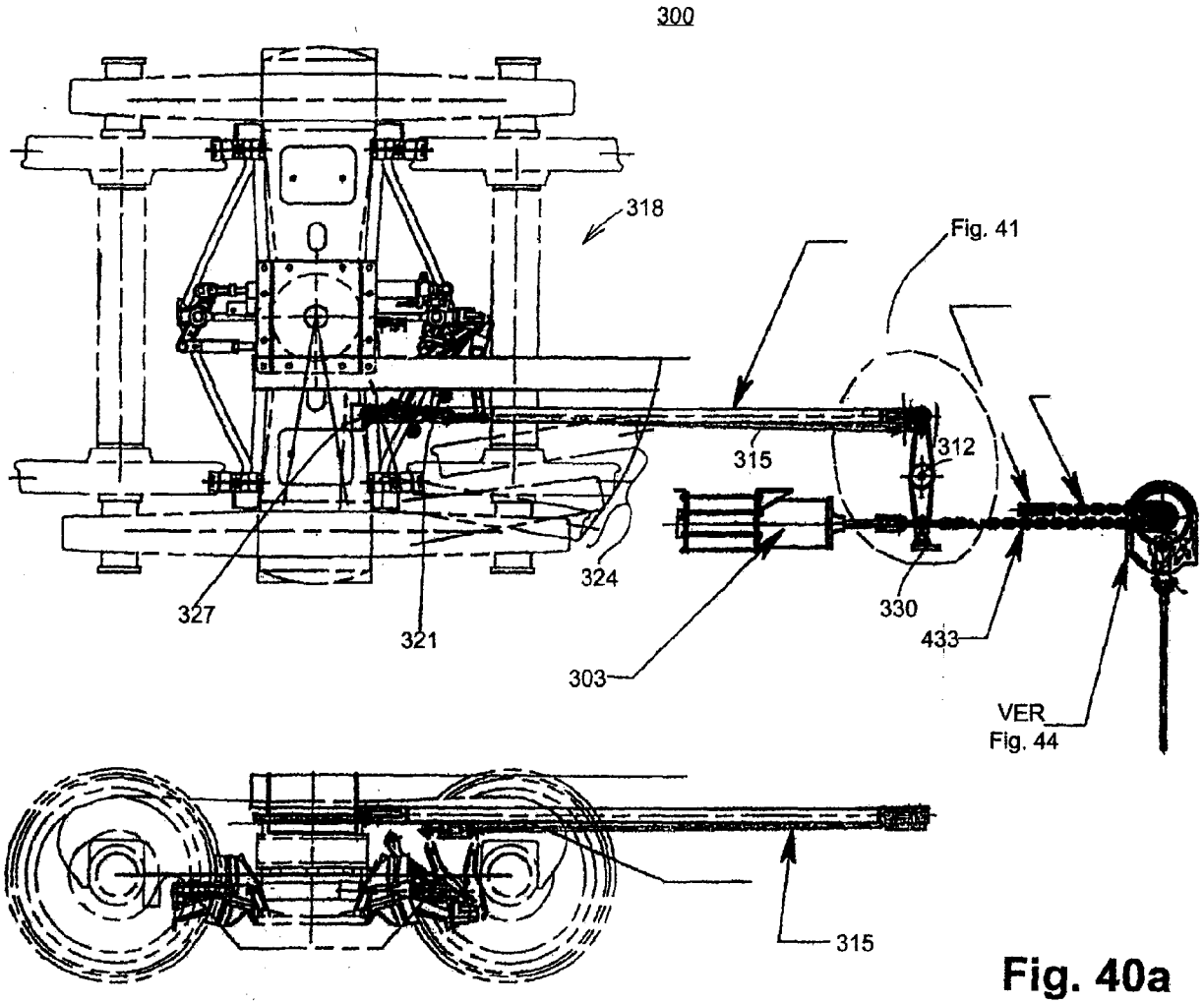
Figure 41:
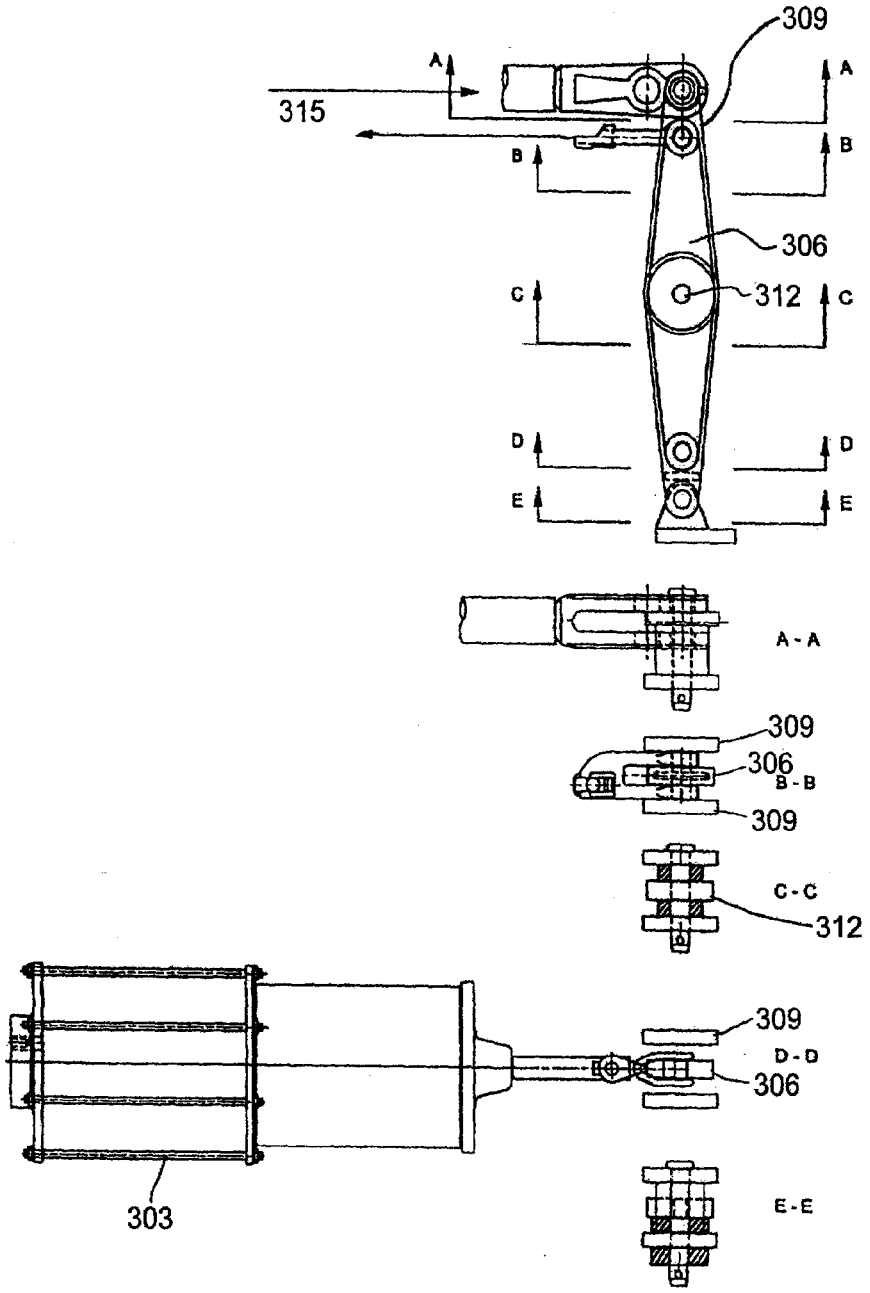
Figure 42:
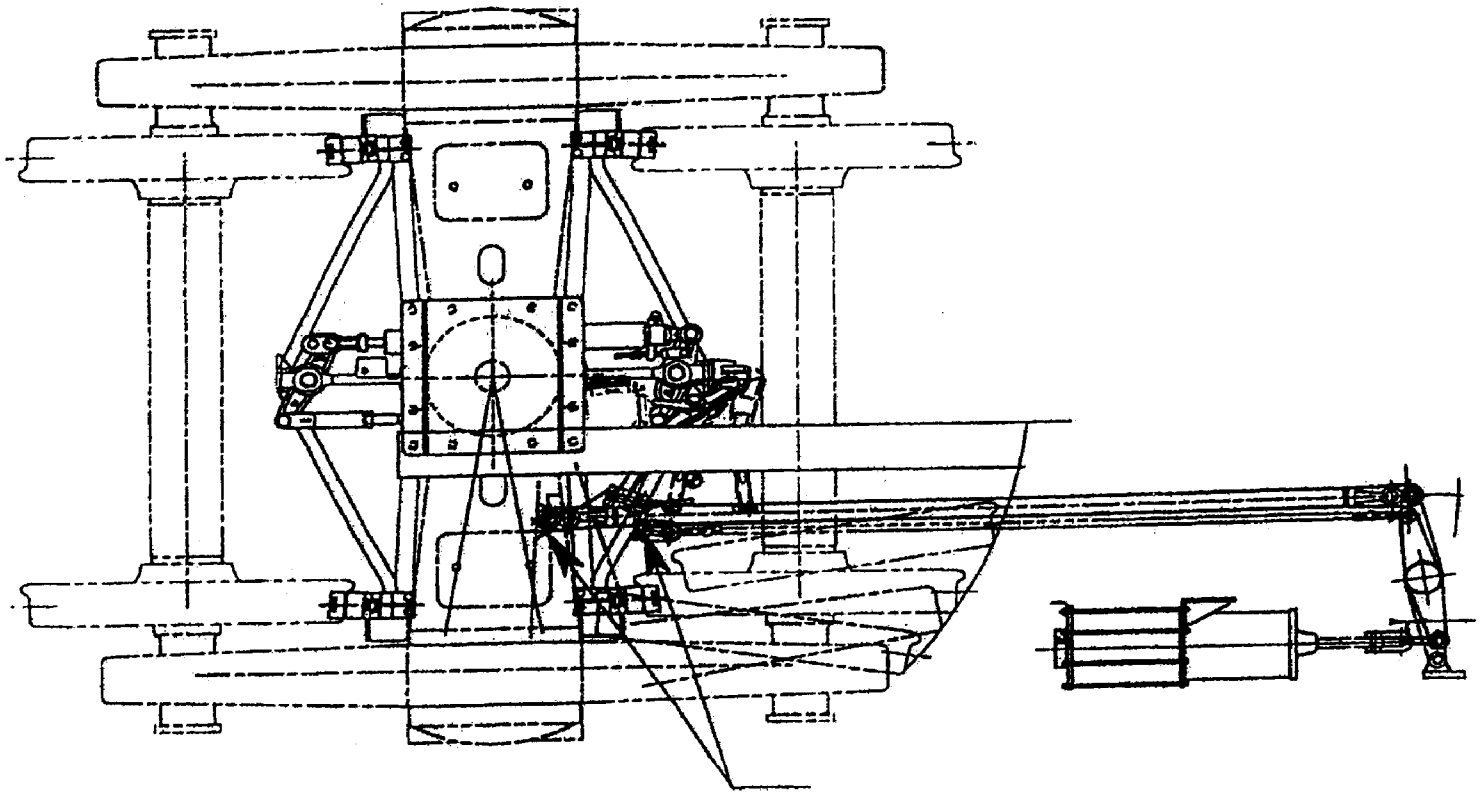
Figure 43:
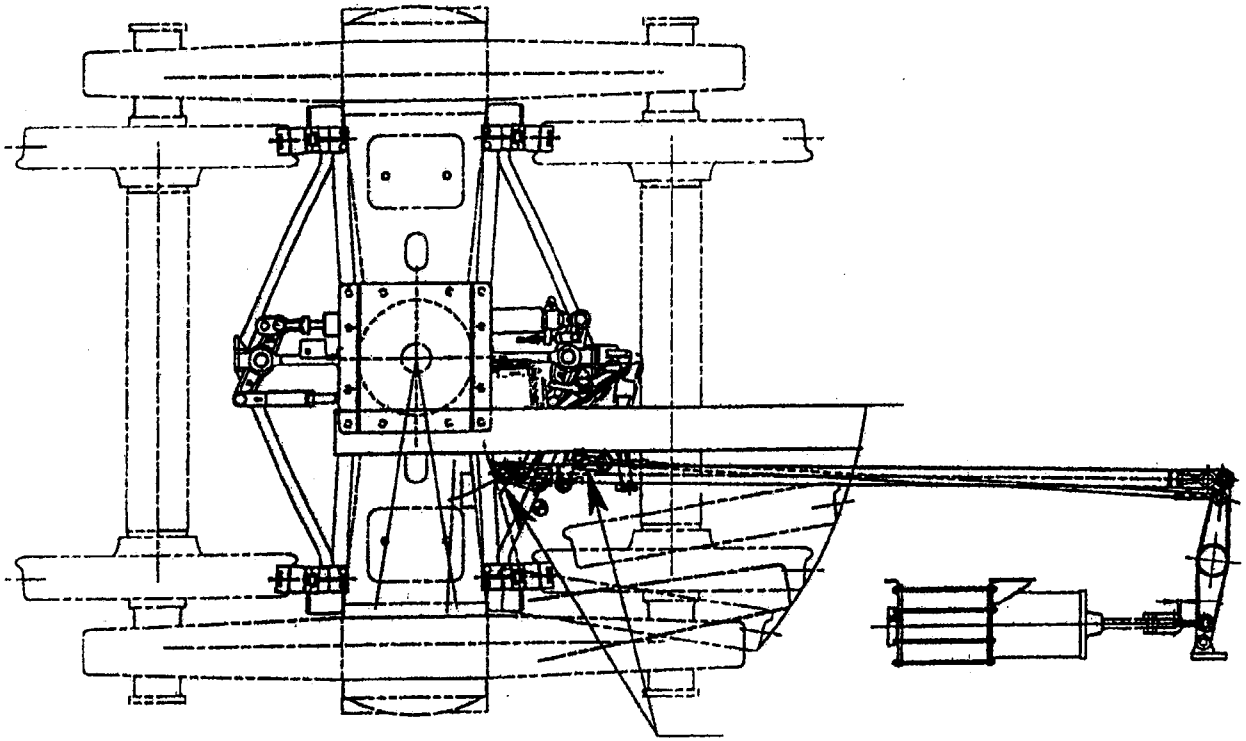
Figure 44A:
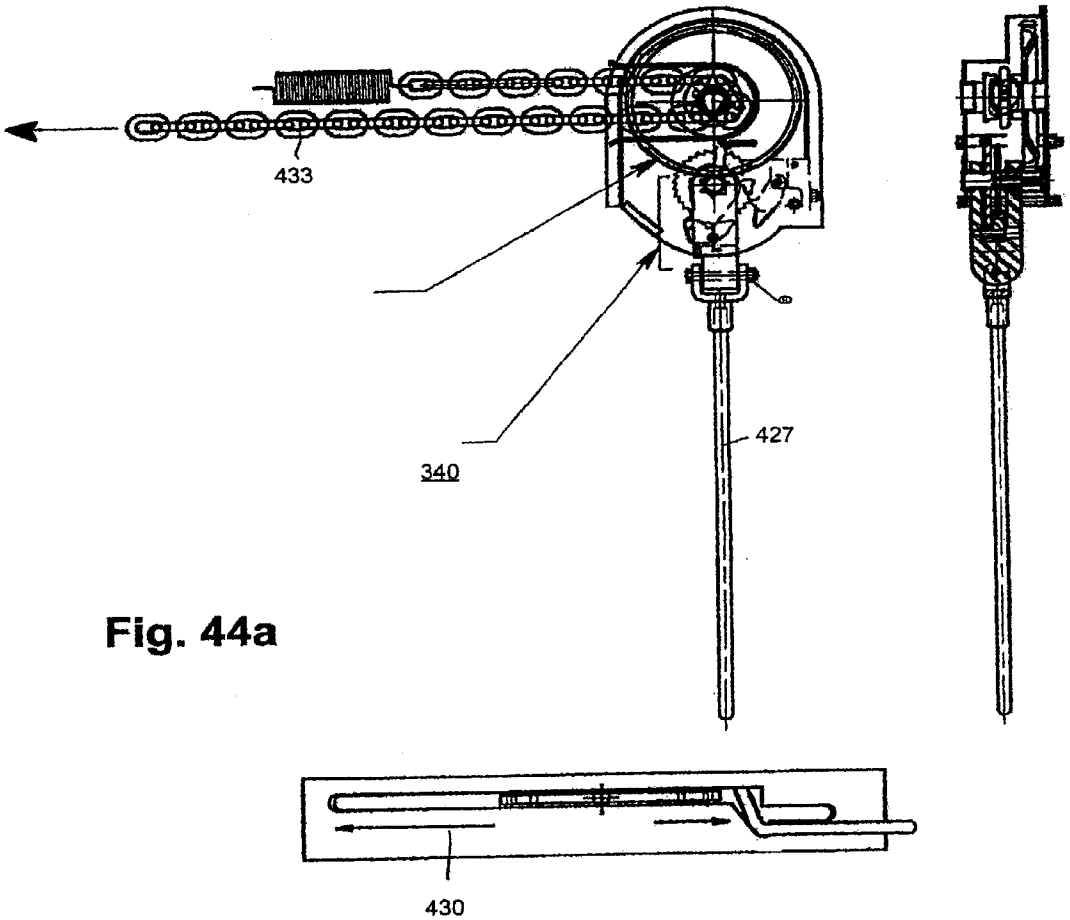
Figure 44B:
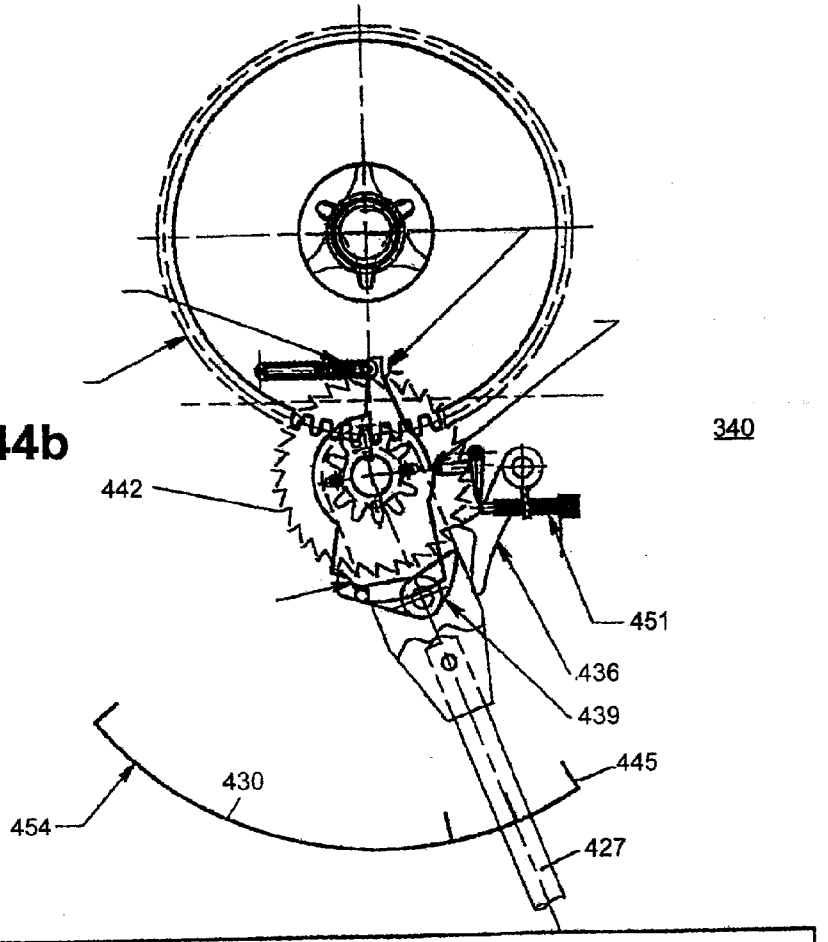
Figure 44B:
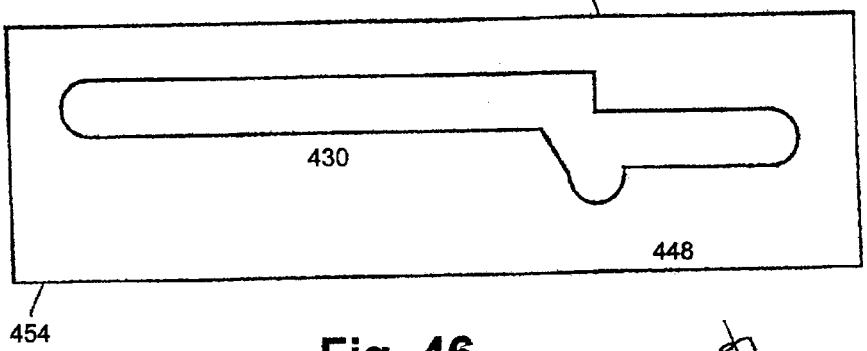
Figure 46:
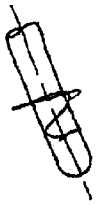
Figure 44C:
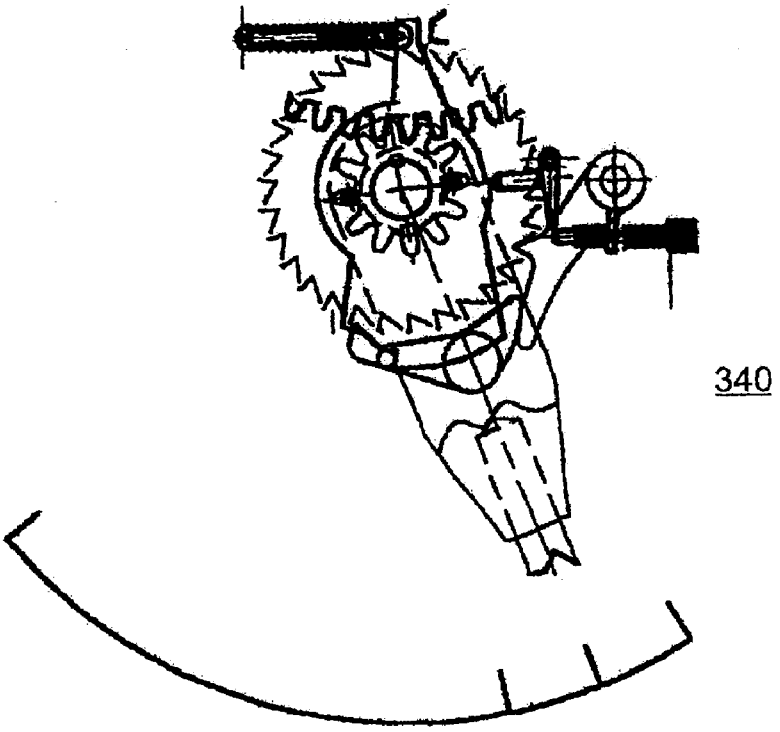
Figure 44D:
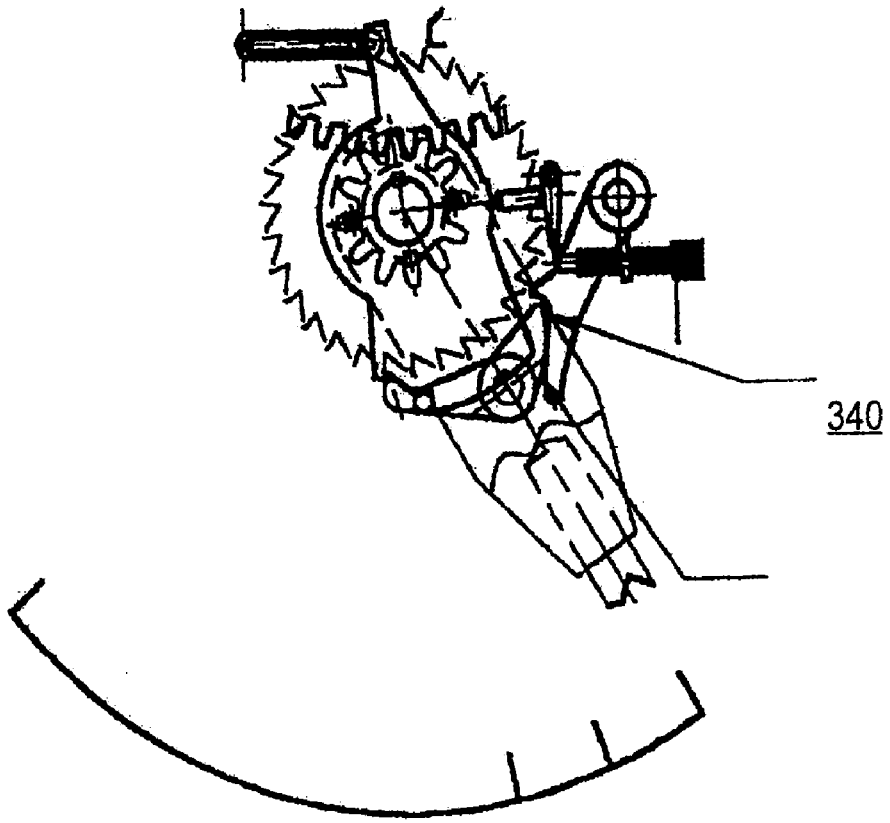
Figure 44E:
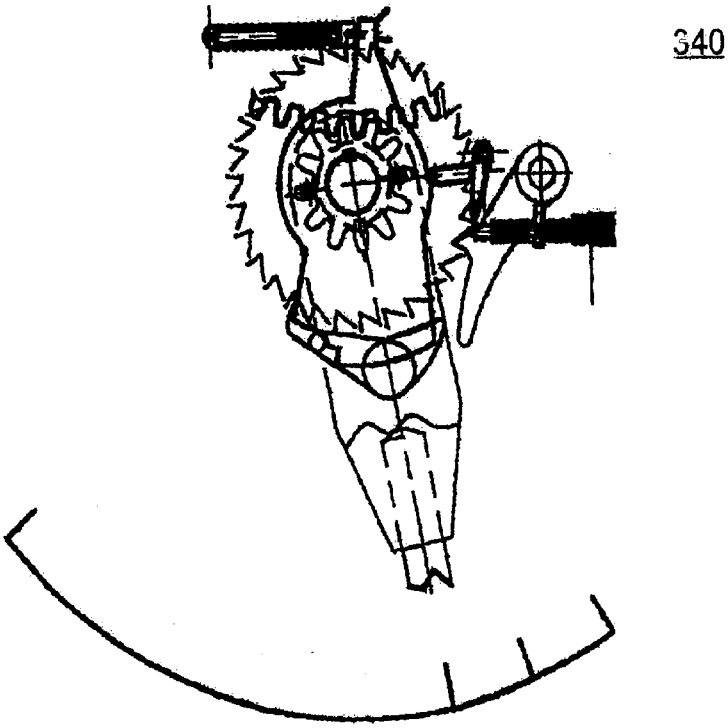
Figure 44F:
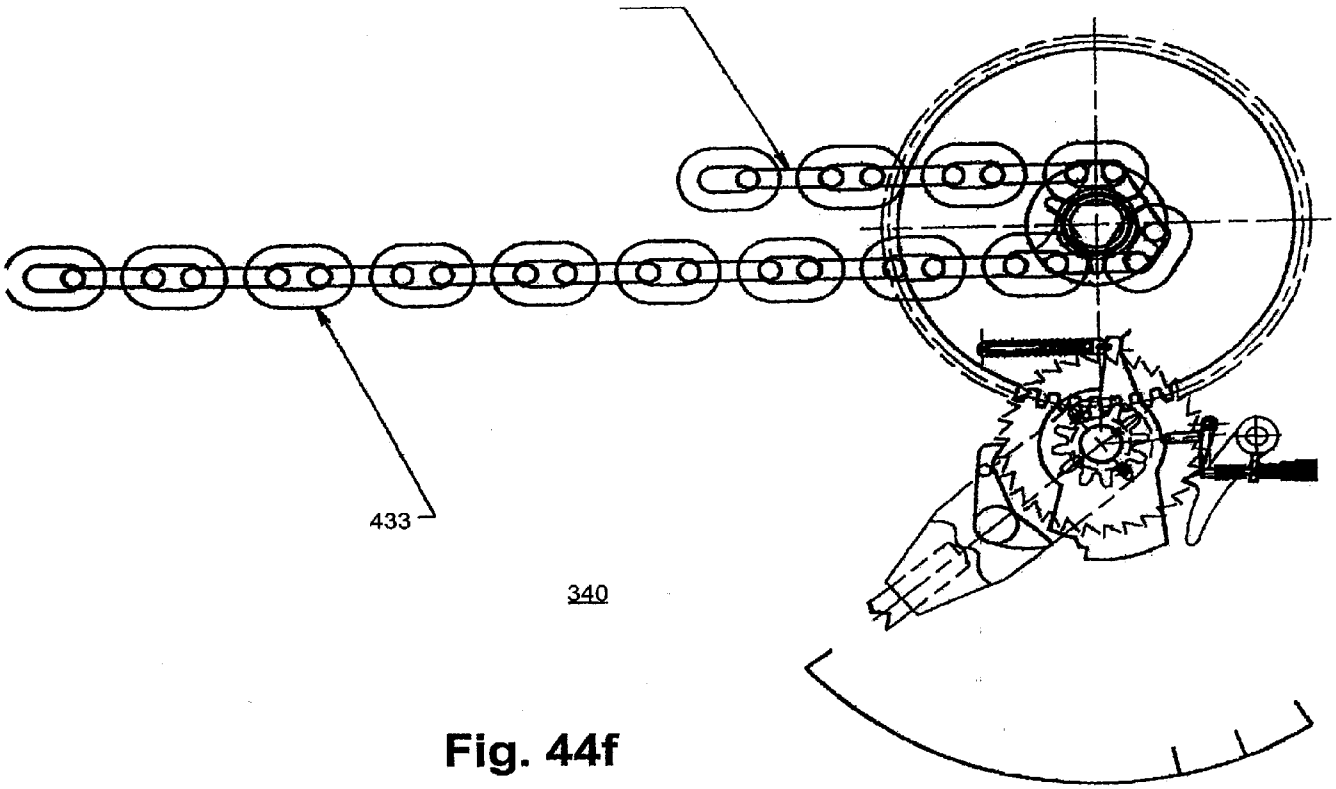

Another preferred embodiment of a ramp is a folding jointed ramp 146, as shown in FIGS. 28–31. The same types of couplers can be used as described above. Similarly, a transit type coupler 207, shown in FIGS. 32–33, is preferably used. Likewise, the spring tension device 160 is used to operate an elevating mechanism 190 to control raising and lowering of the ramp 146.

Sub-Systems

Trailer Tie Down

Each of the three platform types 43, 44, 45 is equipped with two tractor operated pull-up hitches spaced 29 feet apart. This spacing permits loading of all platforms 43, 44, 45 with either two 28 foot "pup" trailers 83 or one 40–57 foot long single trailer 82 to be carried between two trucks. If desirable, a 28 foot pup can also be loaded and be followed by a long trailer 82 spanning the articulated joint between two platforms. The hitch 80 used is modified to increase its width at the vertical strut base, which is necessary to control trailer roll in the non-AAR trailers which are to be carried. Since the segment 40 will never be humped, the normal cast top plate can be eliminated and a lower weight pressed steel design used. Finally, the hostler tractor should be equipped with closed circuit television in order to both improve safety and decrease loading time over systems which depend on communication between a ground man and driver. Another feature proposed for the loading system is an electric hitch lock monitor which can be implemented to indicate proper locking of both the kingpin into the top plate, and of the diagonal strut into the raised position. A hydraulic cushioning system is also proposed both to reduce noise and improve hitch system life as compared to non-cushioned hitches.

Braking

Figure 34:
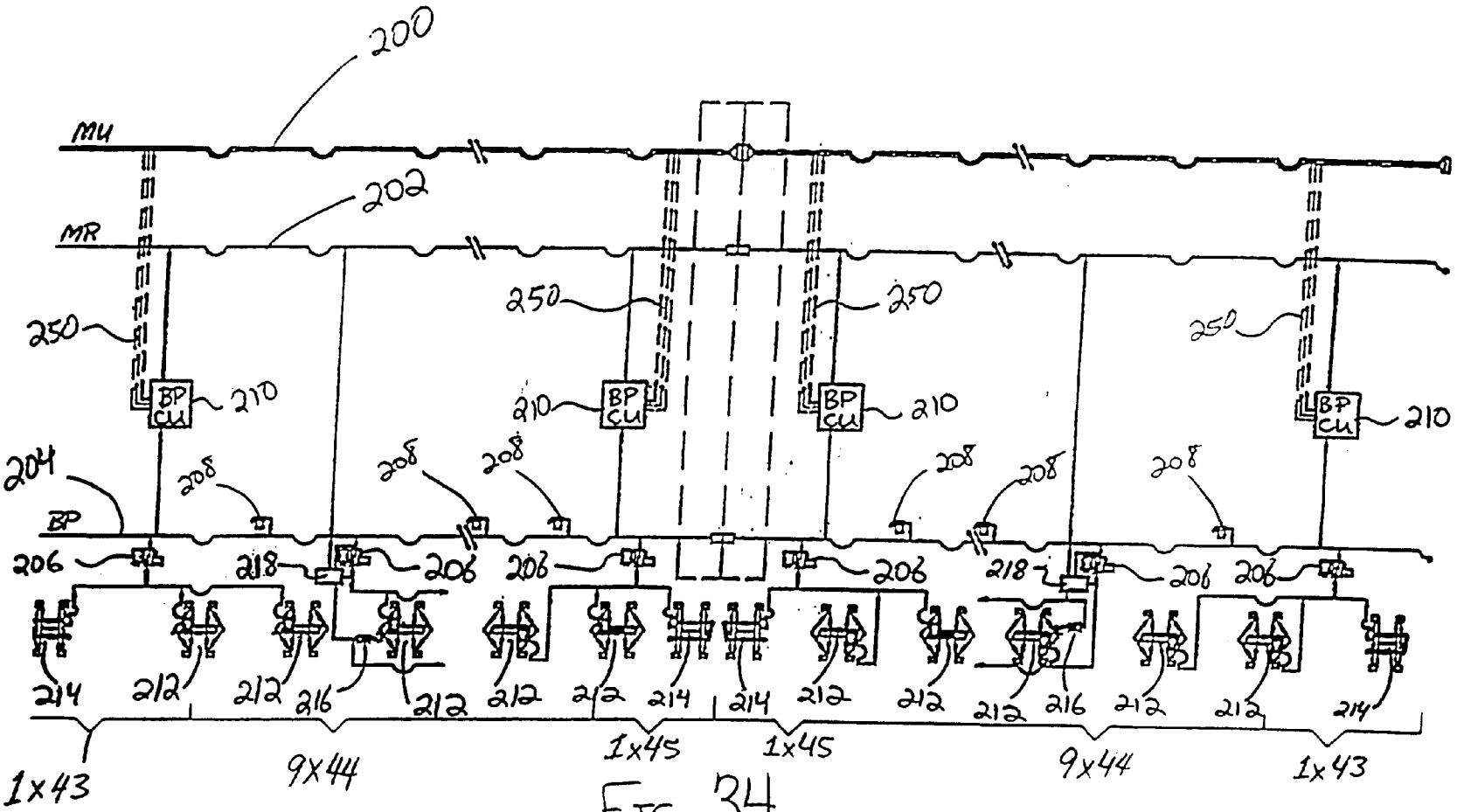
FIG. 34 is a schematic of a first embodiment of a brake system for an intermodal train.

The braking system, shown schematically in FIG. 34 may be the most important of the sub-systems. The basic system is a two-pipe (main reservoir pipe 202 and brake pipe 204) graduated release design in which cylinder pressure is developed in response to brake pipe 204 pressure reduction and graduated off as this pressure is restored. It preferably uses one modified ABDX control valve 206 to supply brake cylinder pressure for each three trucks. The control valves 206 are mounted to the first intermediate platform, third intermediate, sixth and every third platform thereafter. Every platform not equipped with a control valve 206 has a No. 8 vent valve 208 to aid in emergency brake transmission. In addition, the adapter 43 and ramp 45 platforms each carry an electro-pneumatic brake pipe control unit (BPCU) 210 which will be further described.

The use of a second pipe, namely the main reservoir pipe 202, serves three purposes. The first is to permit a trailing locomotive in a long train to provide or receive air from a remote locomotive or control cab at, say, the head of the train, thus enabling double ended operation with power on only one end of the train. The second is to eliminate taper from the brake pipe 204 and speed its response during pressure increases. Finally, the main reservoir pipe 202 can be used to supply air for the release of the spring applied parking brake 212 on those trucks which are so equipped.

Brake Pipe Control

The BPCU 210 on the adapter 43 and ramp 45 platforms of each segment include a pair of magnet valves arranged to be operated by trainline wires, which can be in the locomotive MU cable 200, in concert with the engineer's brake valve, from a CS-1 brake pipe interface unit on the locomotive as will be further discussed in the Locomotive Sub-Systems section of this description. When brake pipe 204 pressure reduction is called for on the locomotive, the application magnet valves on each BPCU 210 in the train will vent pressure locally causing rapid reduction to the pressure set by the brake valve at each point where a BPCU 210 is installed, thus instantaneously applying brakes throughout the train and reducing both in train forces and stop distance. When brake pipe 204 command is satisfied, valves at each BPCU 210 will be de-energized and no brake pipe 204 pressure change will occur.

In like manner, when the engineer changes the brake valve setting to increase brake pipe 204 pressure, the locomotive CS-1 interface will energize supply magnet valves at each BPCU 210. The supply of air to the BPCU 210 comes from the main reservoir equalizing pipe 202, so the brake pipe 204 is rapidly and equally recharged at both ends of each segment in a train, and no taper will exist. This electro-pneumatic brake pipe control will be very effective on trains made up of multiple segments, and since only 4 control valves 206 are required for an 11 platform segment, slight additional cost of the extra pipe 202 and two BPCUs 210 are offset by the reduction in the number of control valves along with greatly improved performance provided.

Other important parts of the brake system are the foundation brake rigging, which is a TMX truck mounted brake 212 on all trucks except the 28 inch truck of the loader which is equipped with a simple WABCOPAC II truck mounted brake 214. The TMX 212 is a special design producing high brake shoe force and a high braking ratio for the train.

Spring Applied Parking Brake

Figure 35:
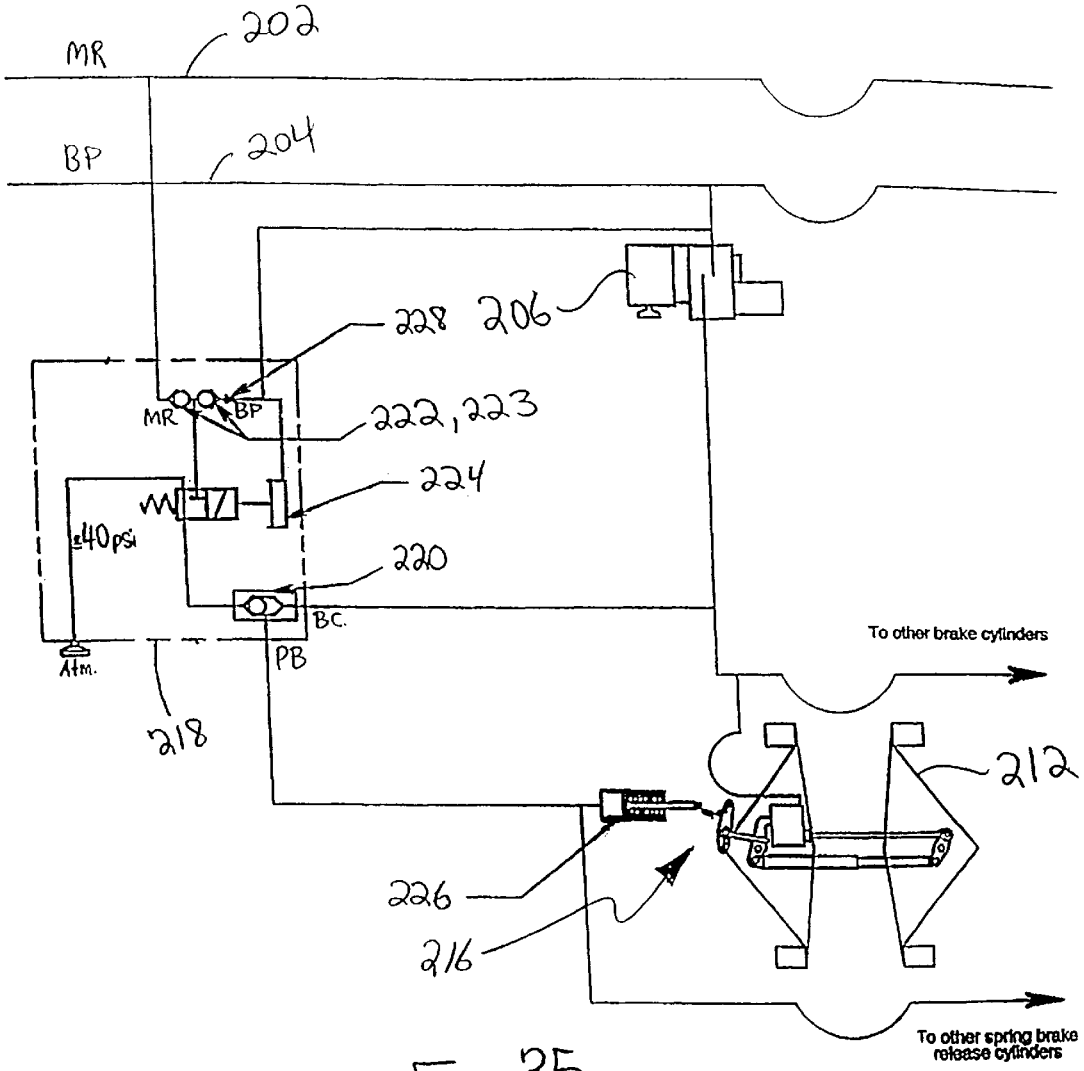
FIG. 35 is a schematic diagram of a first embodiment of a spring applied parking brake control.
Figures 36A, 36B:
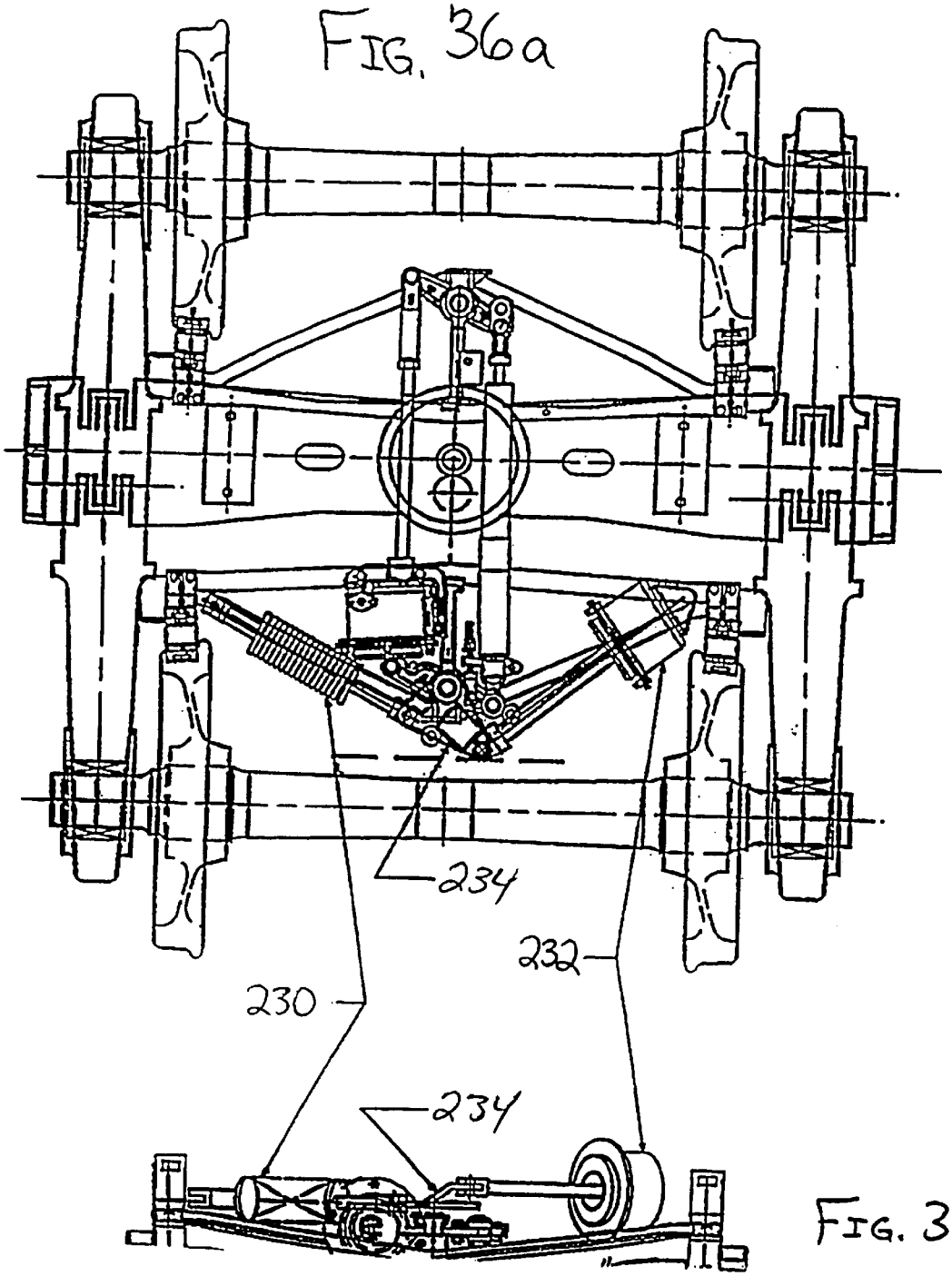
FIG. 36*a* is a top view of a truck equipped with the spring applied parking brake shown in FIG. 34.
FIG. 36*b* is an end view of the truck shown in FIG. 36*a*.
Figure 37A:
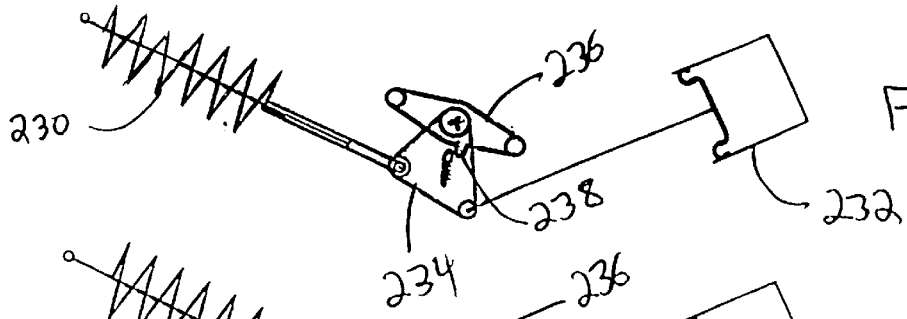
FIGS. 37*a*–37*e* are position diagrams showing the operation of the spring applied air brake shown in FIGS. 34 and 35.
Figure 37B:
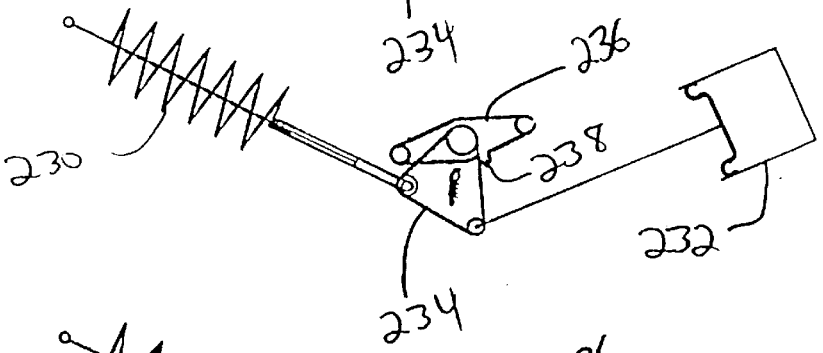
Figure 37C:
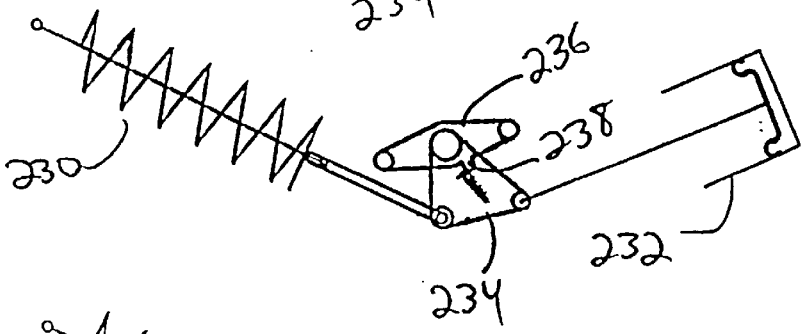
Figure 37D:
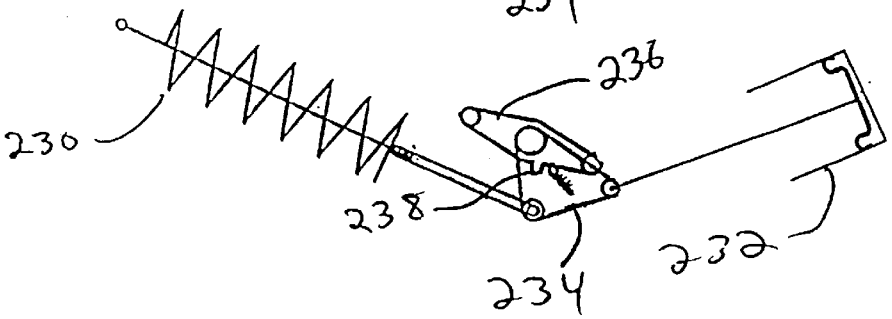
Figure 37E:
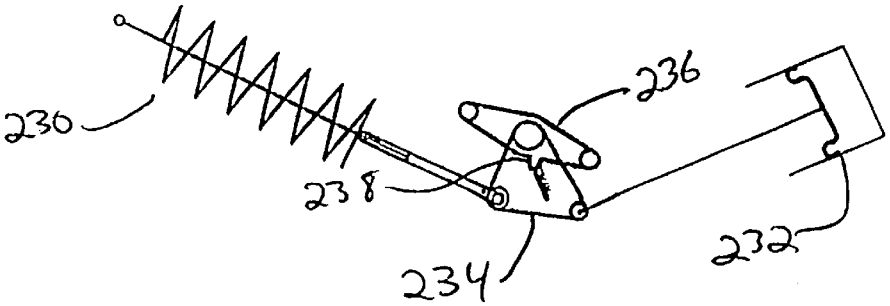
Figures 38A, 38B, 38C, 39:
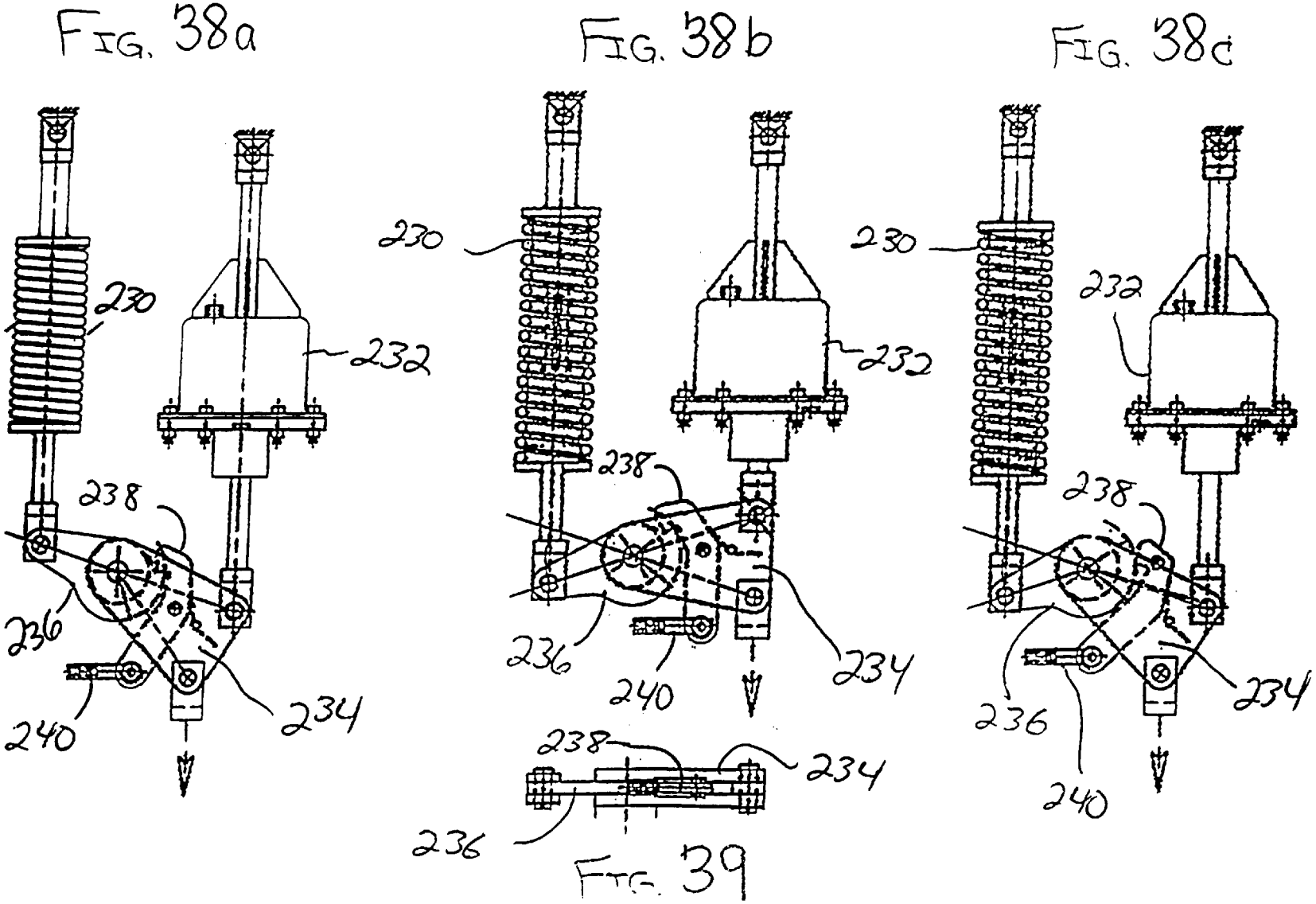
FIG. 39 is an end view of the spring applied brake shown in FIG. 37*b*.

In addition to the simple electro-pneumatic brake pipe control system, a spring applied parking brake 216, as shown best in FIGS. 35–39, can be provided on the fourth fifth and sixth trucks (counting 1 as the 28 inch truck 48 under the adapter platform 43). This parking brake 216 is under the control of a parking brake control valve 218 as shown in FIG. 35, and will be released by the presence of brake pipe pressure above 70 psi.

Parking Brake Control

The parking brake control valve 218 will not, however allow application of the parking brake 216 until brake pipe 204 pressure is reduced below 40 psi nominal, and even then, parking brake 216 operation will be inhibited to the extent that brake cylinder pressure is present by the spring brake double check in the pilot valve 220. This is achieved through the several parts of the parking brake control valve 218 as further described below.

Charging—Normal Operation

During initial charging of the train under normal conditions, the main reservoir pipe 202 pressure will rise quickly to a relatively high value. Further, since all air being supplied to the BP 204 comes from main reservoir, this value will always be higher than brake pipe pressure. Thus air will flow into the parking brake control valve 218 through its MR port, pass through the charging check valve 222, and hold the charging check valve 223 from the brake pipe connection to its seat thus preventing any flow of air from BP 204 into the system and maintaining the BP 204 response as rapid as possible. Since initially the BP 204 will be below 40 psi nominal, the operating valve 224 will be in its application position as shown, such that further flow of air will take place and the parking brake 216 will remain applied. Once brake pipe pressure rises to a value in excess of 40 psi nominal, the operating valve 224 will switch over, and connect the charging check valve 222 output to the spring brake release cylinder 226 via the parking brake interlock double check valve 220, compressing the spring and relieving spring force on the brake shoes of all trucks under the control of the parking brake release valve 218. As train charging continues, the pressure in the spring brake release cylinders 226 will rise to the value of the MR pipe 202.

Charging—Towing Operation

There will be occasions when it will be desirable to tow the intermodal train segments 40 in a conventional train where no MR pipe 202 is available, and the spring applied parking brake 216 will not interfere with this operation. In such a case there is no pressure in the MR pipe 202, and as BP 204 is charged, air will flow through the flow control choke 228 and the BP side charging check 223, holding the MR side charging check 222 to its seat and preventing loss of BP 204 air to the non-pressurized MR pipe 202. Air will then flow to the spool of the operating valve 224 where it will initially be stopped by the fact that the spool does not shift until brake pipe pressure has risen above 40 psi nominal as before. Once brake pipe pressure rises above this level, the operating valve 224 spool will shift (to the left in FIG. 35) connecting brake pipe pressure to the spring brake release cylinders 226 as before. Note however that in this case the air for spring brake release is supplied by the flow control choke 228, whose size has been chosen to prevent the opening of the operating valve 224 spool to the empty spring brake release cylinders 226 from causing any significant drop in brake pipe pressure which might otherwise either cause unstable operation of the operating valve 224, or even put the train brakes into emergency.

Parking Brake Operation During Service Brake Application & Release

When brake pipe pressure is reduced to cause a normal service application of train brakes, the pressure after the reduction will always be greater than 40 psi, and the operating valve 224 will remain in its normal released position (spool shifted to the left in the diagram). The brake pipe side charging check 223 will remain on its seat and no air will flow to BP 204 from the parking brake system 216, 218. The ABDX control valve 206 will supply air to its brake cylinder port, however and this will flow to the brake cylinders in the normal way. This pressure will also enter the parking brake control valve 218 at the brake cylinder port and pressurize the right hand side of the parking brake interlock double check 220, which is held to the right hand seat by the air already present in the fully charged spring brake release cylinder 226. Thus neither BP 204 nor brake cylinder operation is affected in the slightest way by the presence of the spring applied parking brake system 216, 218.

When release of the service brake is commanded, brake pipe pressure will rise as commanded, but no parts of the parking brake control valve 218 will be affected. When the brake cylinder pressure is released, pressure on the right hand side of the interlock double check valve 220 will be reduced but, as this valve 222 remains against its right hand seat at all times in normal braking, there is again no operational difference in the brake equipment as a result of the spring applied parking brake 216.

Parking Brake Operation During Emergency Brake Application & Release

When brakes are applied in emergency, the brake pipe pressure is quickly reduced to zero and the ABDX valve 206 reacts by providing maximum brake cylinder pressure, which must always be about 5 psi lower than the fully charged value that the BP 204 had been. Since the brake pipe pressure is necessarily lower than the 40 psi nominal switch pressure of the operating valve 224, the operating valve 224 device will move to the application position and connect the left hand side of the interlock double check valve 220 to atmosphere and attempt to vent the spring brake release cylinders 226, thus applying the spring brake 216 on top of the normal pneumatic brake which is very undesirable as it could cause slid flats and wheel damage. This circumstance is prevented, however because brake cylinder pressure from the control valve 206 builds up on the right hand port of the interlock valve 220 more quickly than it drops off on the left side, shifting the double check 220 and preventing pressure from being vented by the spring brake cylinder 226. Thus, the excessive brake buildup mentioned above is prevented. As brake cylinder pressure dissipates after the emergency due, for example, to system leakage, the pressure on the right hand side of the interlock valve 220 will reduce with it, and the spring brake 216 will apply as brake cylinder pneumatic force is lost thus guaranteeing that the train will be held in place until brake pipe pressure is restored. In the event that it is desired to manually release the parking brake 216 without air, means are included in the mechanism of the spring brake 216 itself to provide this feature.

Automatic Spring Applied Parking Brake

In a preferred embodiment of the present invention, a novel approach to spring applied, air released parking brakes 300 for use on intermodal trains is disclosed. Although described with respect to use on intermodal trains, this approach is valid for application to most general purpose rail cars as well.

Spring Brake Operation

Figures 40A, 41:
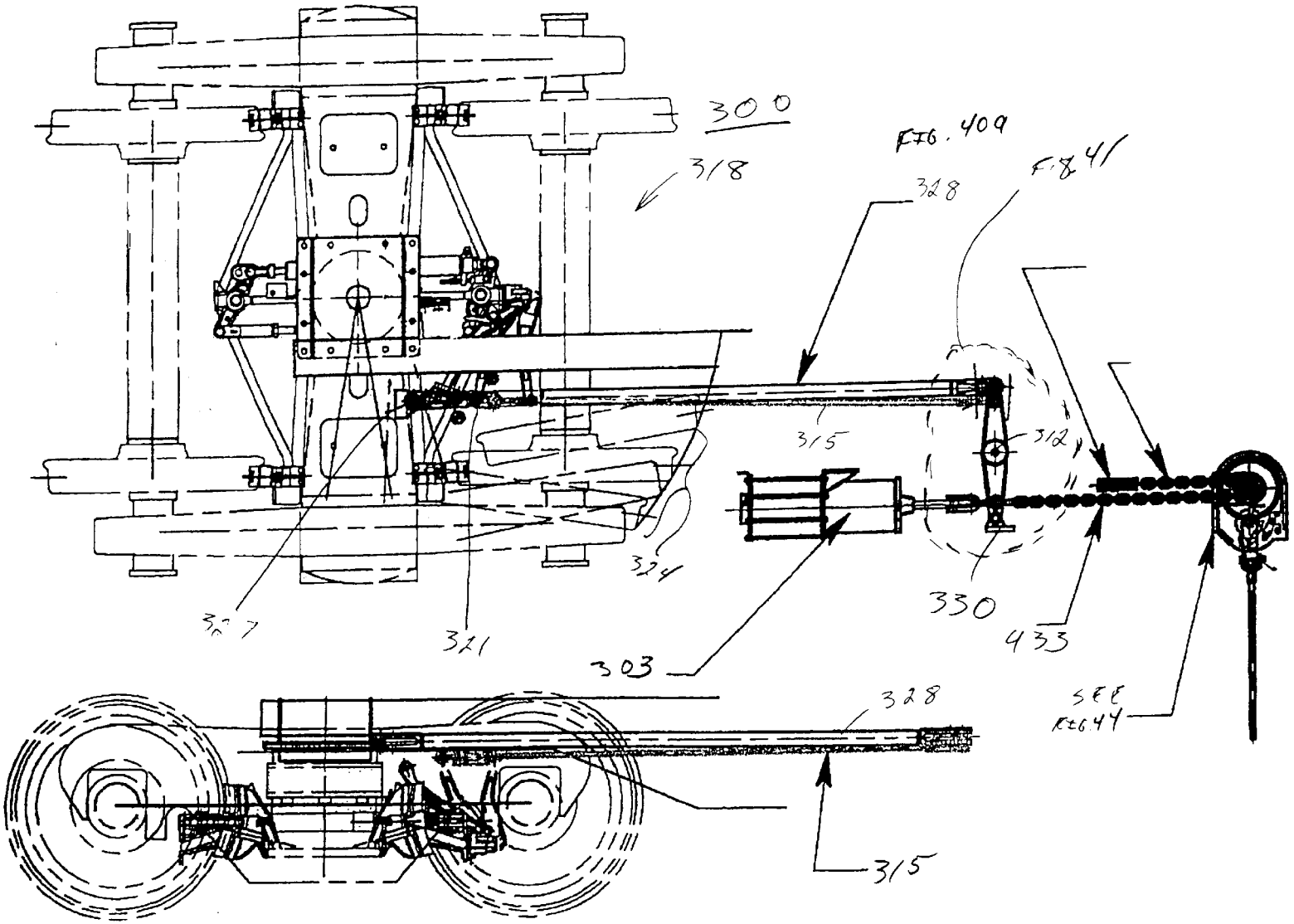
Figure 41:
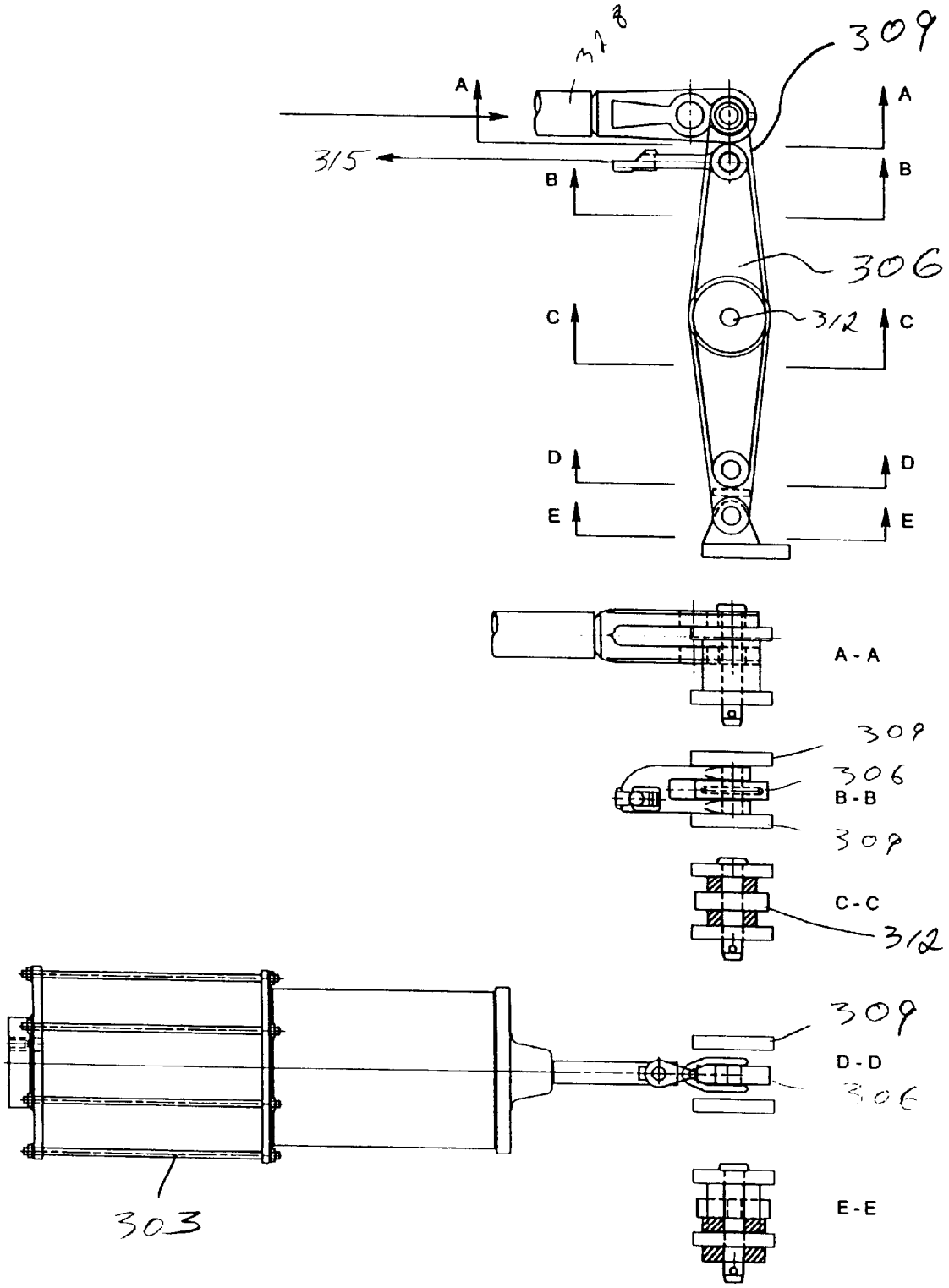
FIG. 41 shows a detailed view of the compensation lever and an actuator lever shown if FIG. 40*a*.
Figure 42:
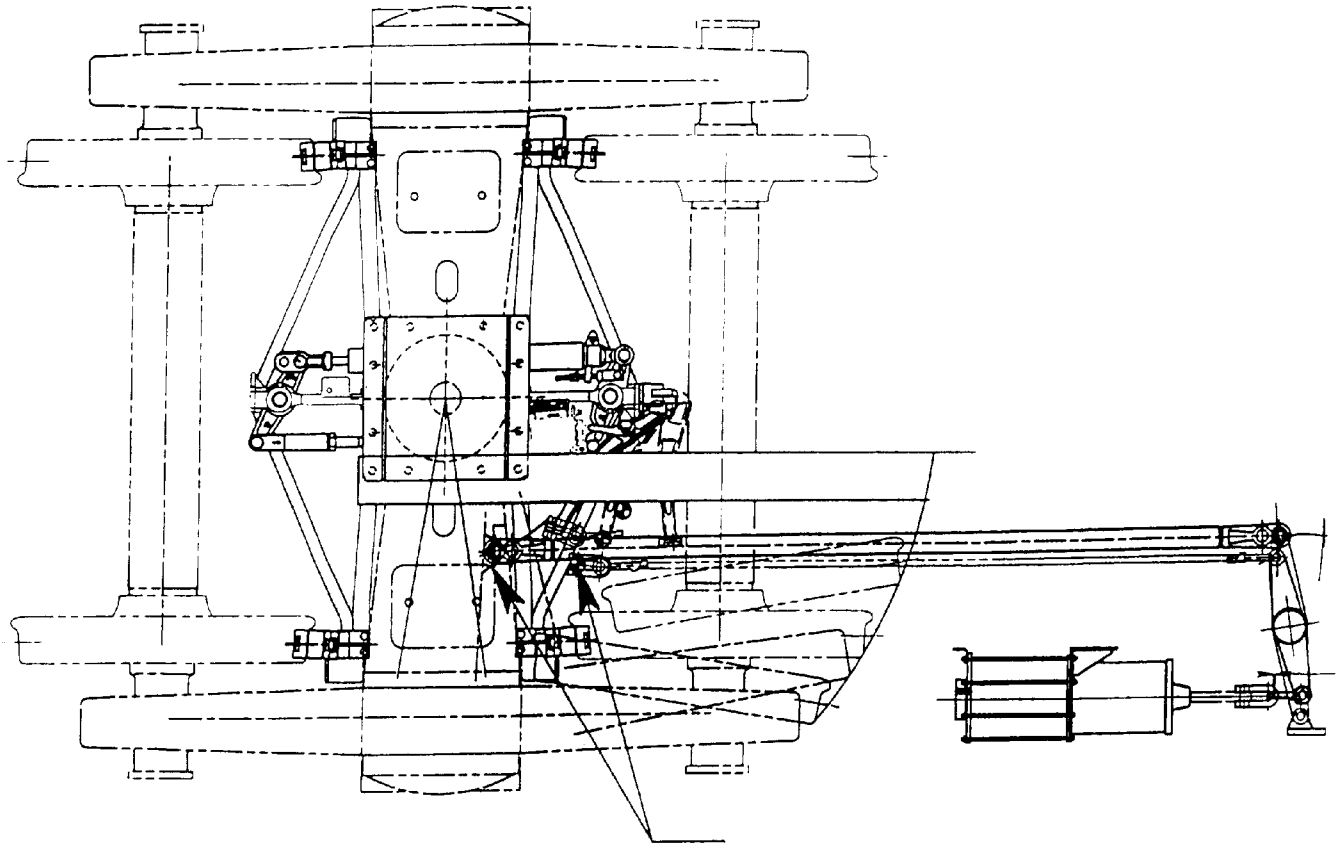
FIGS. 42 and 43 show compensating positions of the parking brake configuration as a train moves along curved sections of track
Figure 43:
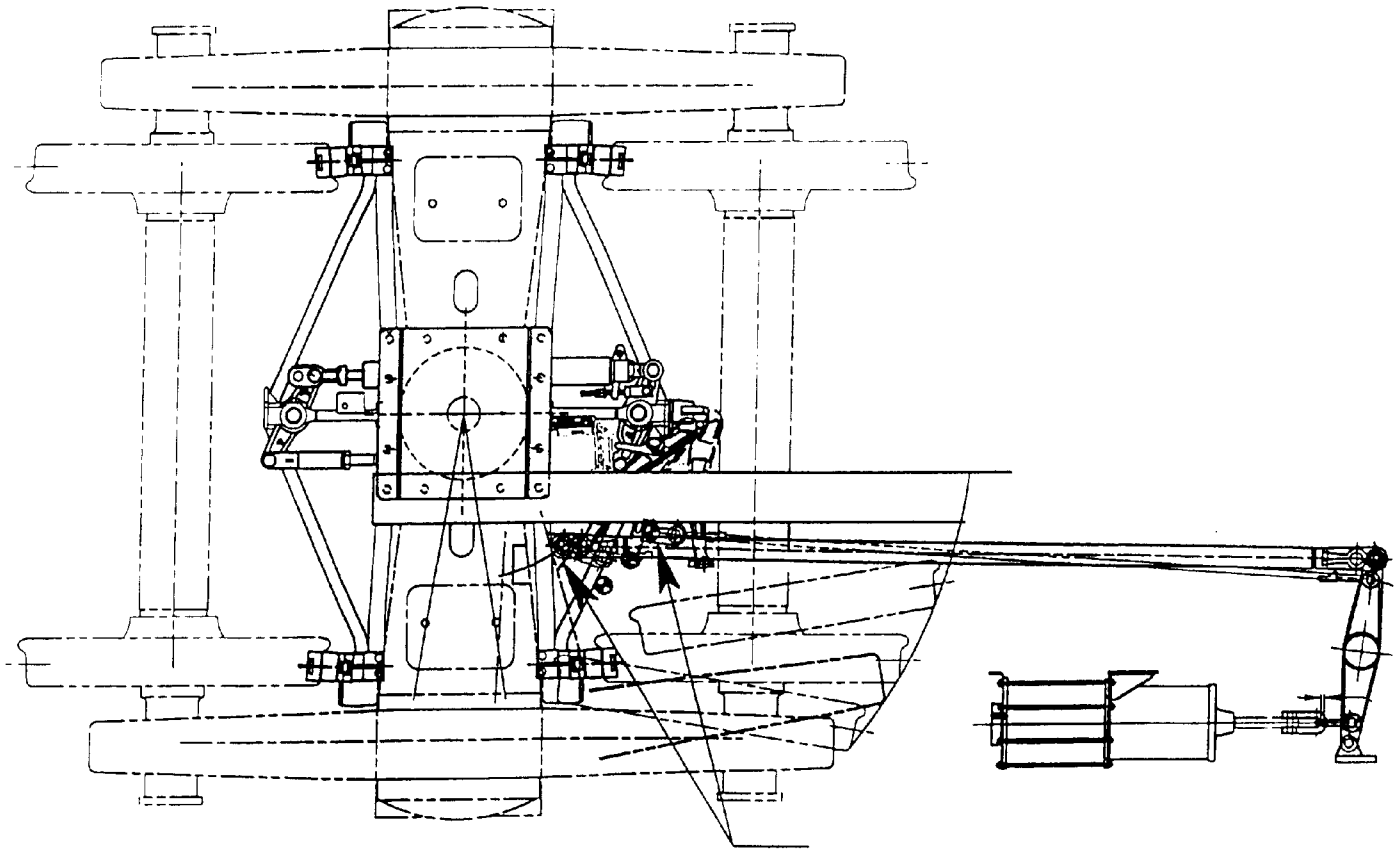
Figure 44A:
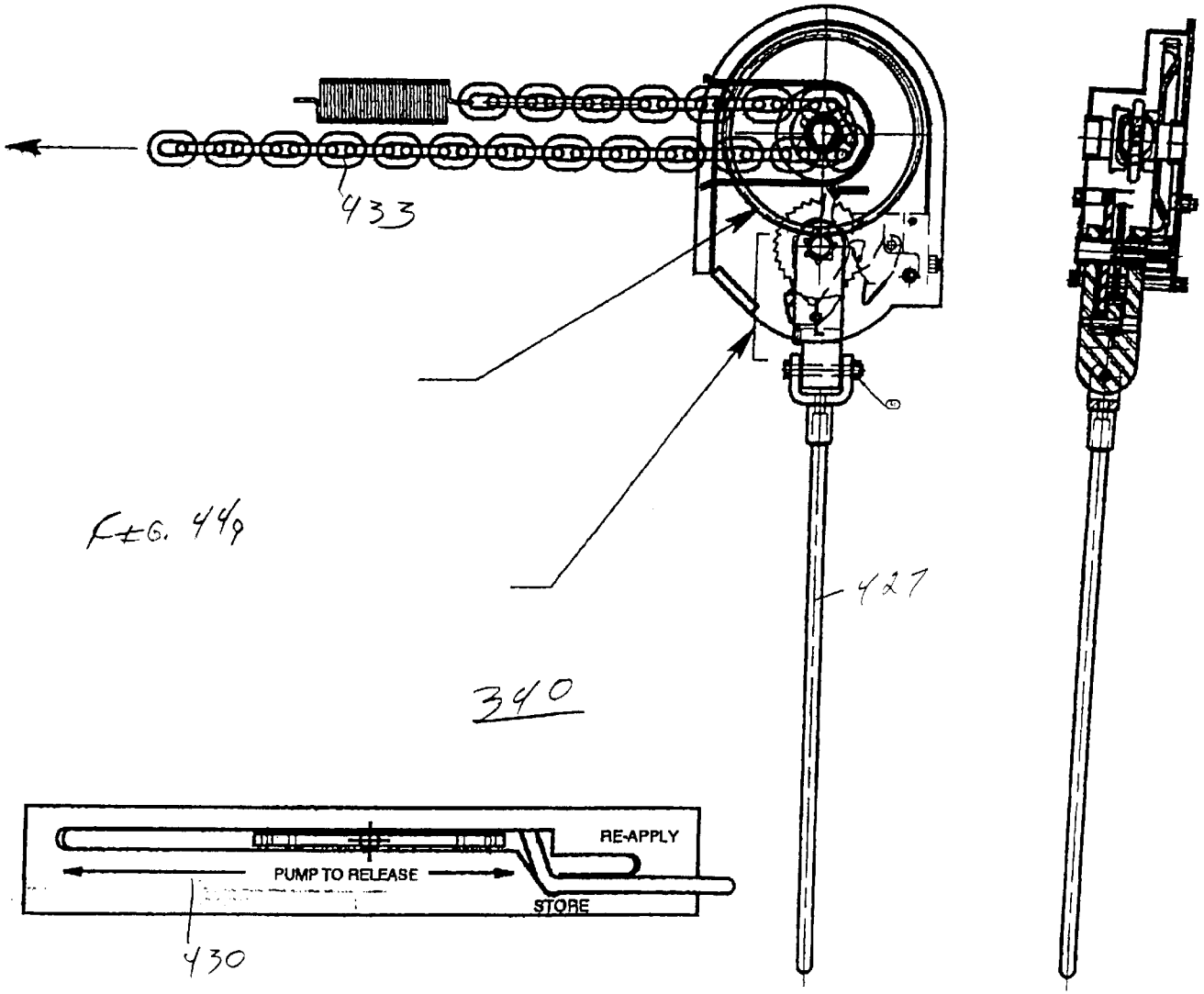
FIGS. 44*a*–44*f* are schematic representations of an emergency manual release mechanism according to the present invention.

A spring applied parking brake 300 of the invention as presently contemplated is shown in FIGS. 40*a* and 40*b*. In operation, the spring applied air released actuator 303 will, if not held released by an pressure in its actuation chamber attempt to pull on the application lever 306 shown in FIG. 41 and apply the spring brake. The application lever 306 will, when pulled to the left by the spring actuator, pivot about its center 312 and pull on the application rod 315. This rod is connected through a suitably flexible connection to the end of the handbrake lever of a conventional TMX type truck 318 mounted brake assembly, shown to the left in FIGS. 40*a* and 40*b*, and will when pulled by the application lever, move the handbrake lever to the right to application lever, move the handbrake lever to the right to the position shown in the target circle 321, which is the fully applied position. Note, however, that the pivot point of the application lever is not fixed, but is rather carried by a somewhat longer lever which lies beneath the application lever in the Figure. This longer lever is the compensation lever 309.

The purpose of the compensation lever 309 is to reposition the pivot of the application lever 306 in such a manner as to compensate for the changing position of the TMX compensation rod 328 end, as the truck 319 swivels due to the car being placed on curved track, as shown in the dashed lines for the car wheel 324. This is done is by linking the compensation lever's 309 upper end with an appropriate point on the truck bolster 327, so chosen such that as the bolster rotates in such a direction as to move the TMX assembly (and hence the handbrake lever's end) to the right, the compensating lever will swivel clockwise about its lower end, which is fixed to the carbody 330. This will in turn move the pivot point of the application lever 306 to the right a lesser distance, sufficient to maintain the separation between the upper end of the application lever and the connection point on the TMX handbrake lever essentially constant, without requiring the lower end of the application lever to move.

Thus the ability of the spring applied brake actuator to effect a brake application is unchanged by truck rotation and the need to provide slack in the rigging to keep the brake released under all conditions of truck swivelling is eliminated. The above argument also applies to the case where the truck swivels in a direction to move the TMX lever end to the left. All three cases of truck positioning relative to the car are shown in FIGS. 40*a,* 42, and 43.

Pulling on the application lever then, will apply the spring brake with equal force and piston travel at all conditions of truck swivel, as shown most clearly in FIGS. 40*a,* 42 and 43. The spring brake double check 220, as already mentioned, provides an interlock to prevent applying the spring brake 216 on top of service brake in an emergency or breakdown situation. FIGS. 40*a,* 44*a* and 44*f* also shows, in principle, the method by which the spring applied parking brake 300 may be manually released. It can be seen in those figures that a device 340 is provided which can pull the plunger of the spring brake actuator out, overcoming the spring and releasing the brake, as morefully described hereinafter.

Figure 45A:
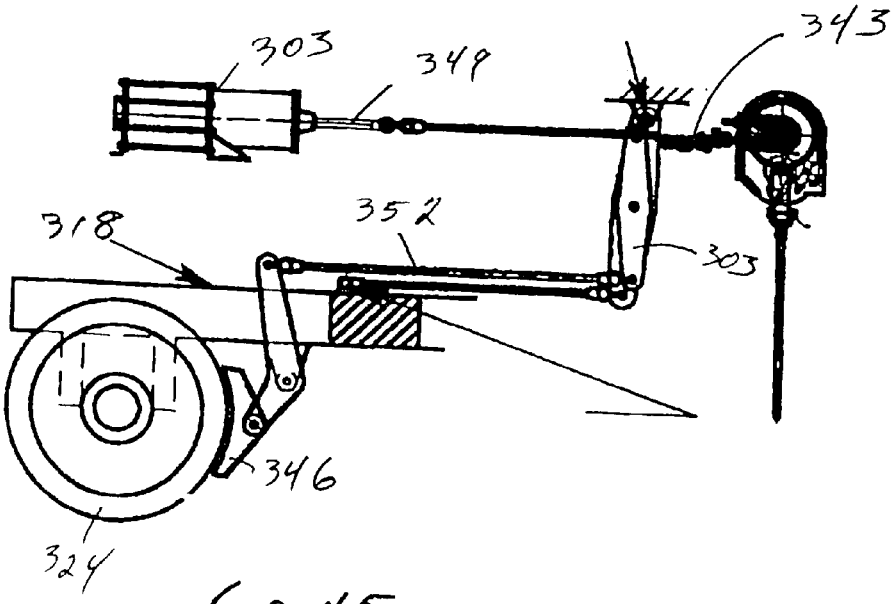
FIGS. 45*a*–45*c* are simplified representations of the operation of the parking brake according to the present invention.
Figure 45A:
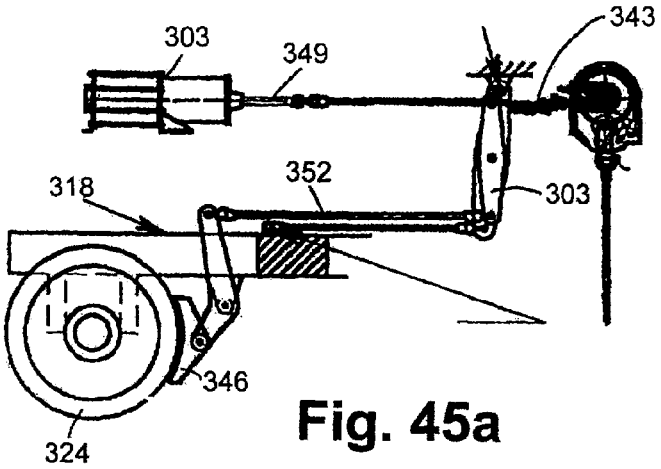
Figure 45B:
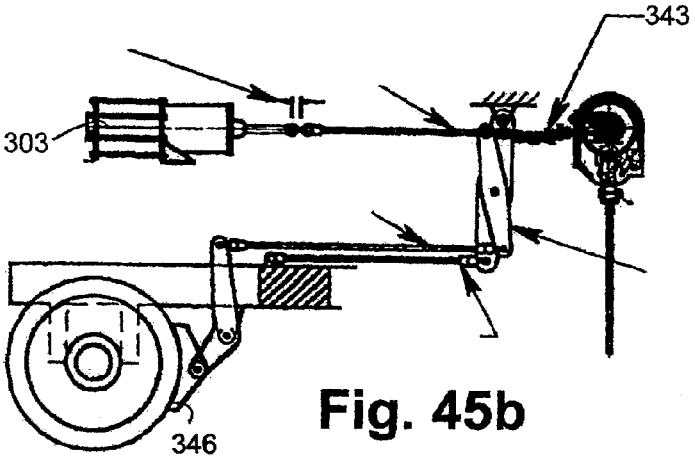
Figure 45C:
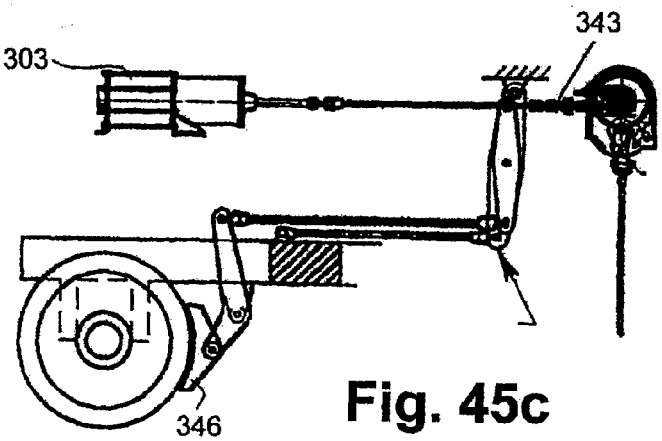
Figure 47:
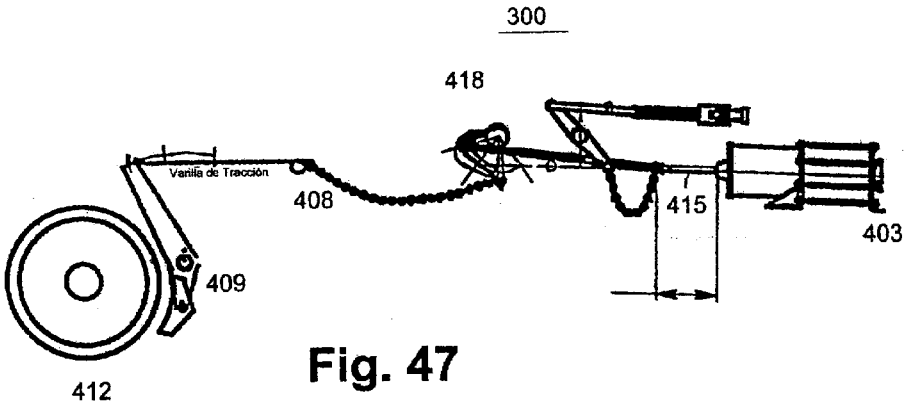
Figure 48:
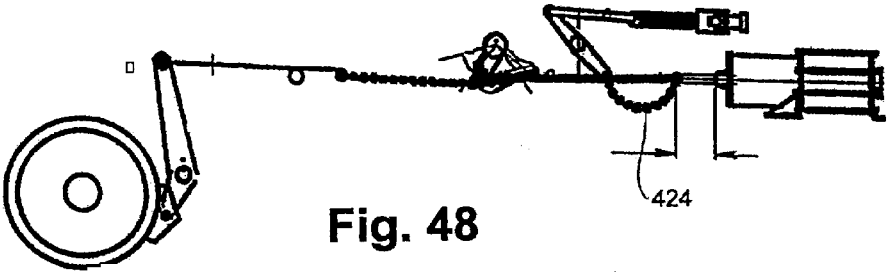
Figure 49:
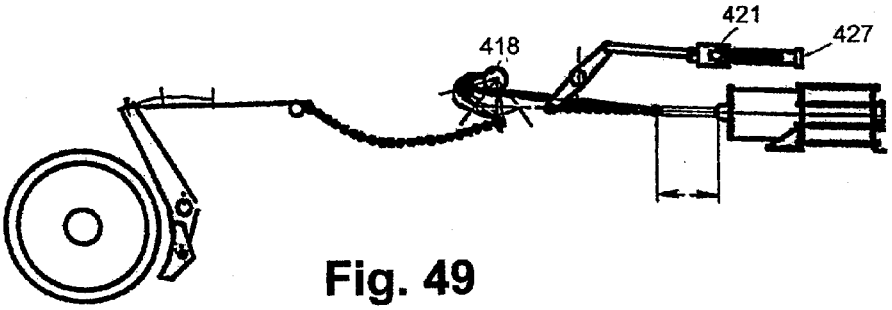
Figure 50:
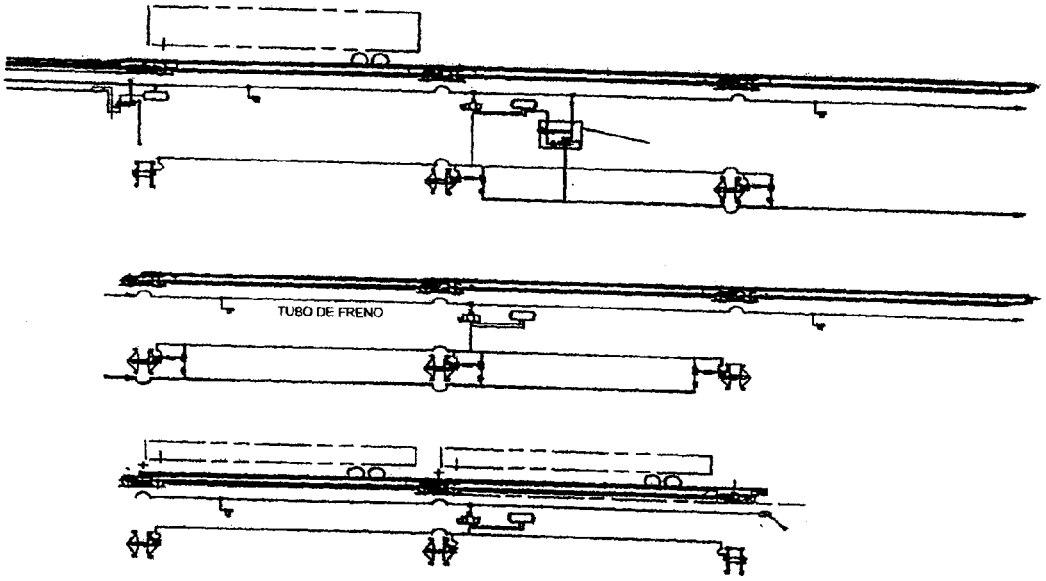
Figure 51:
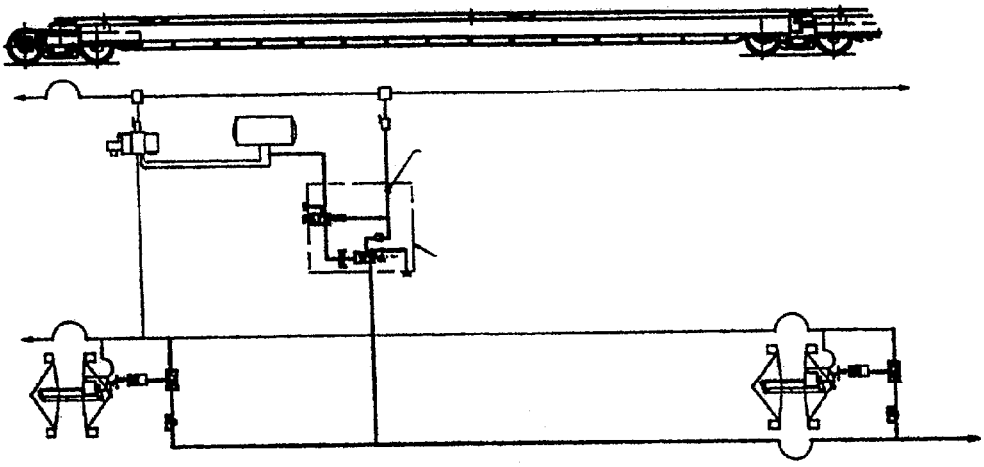
Figure 52:
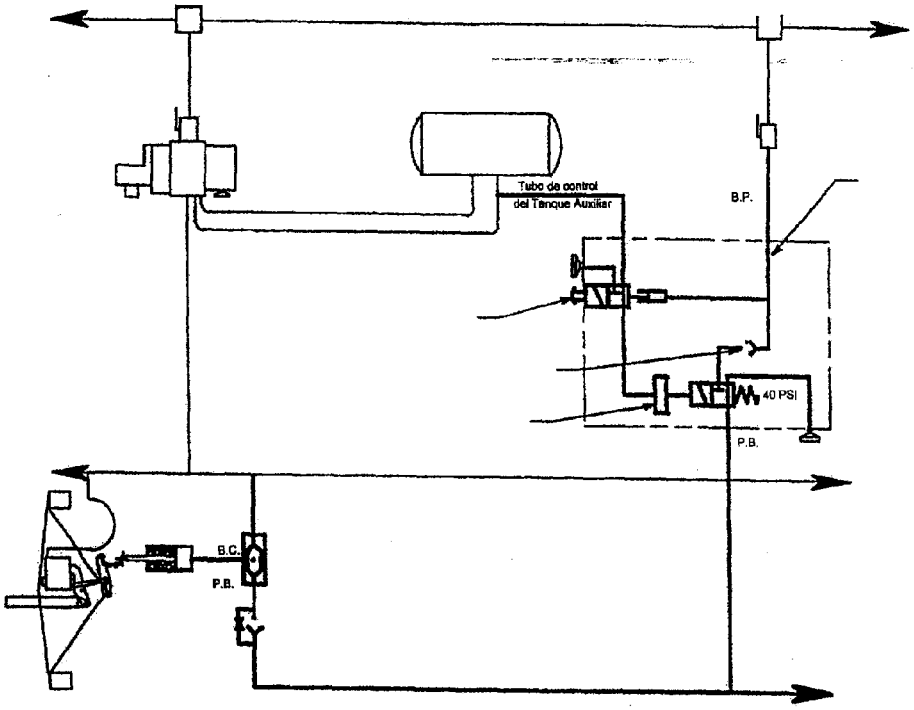
Figure 53:
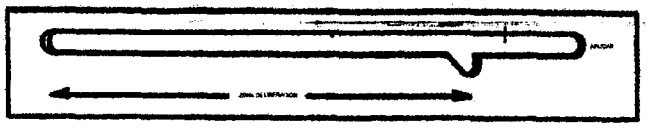
Figure 54:
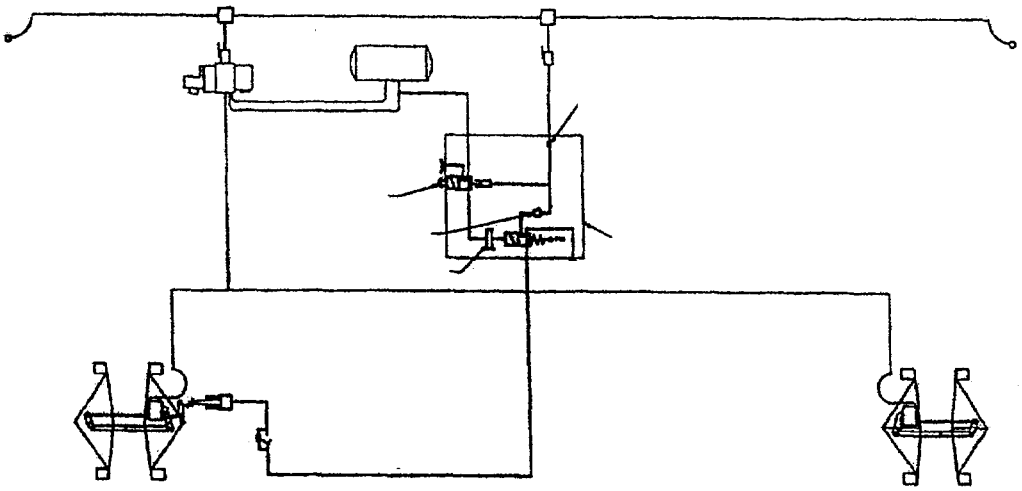
Figure 55:
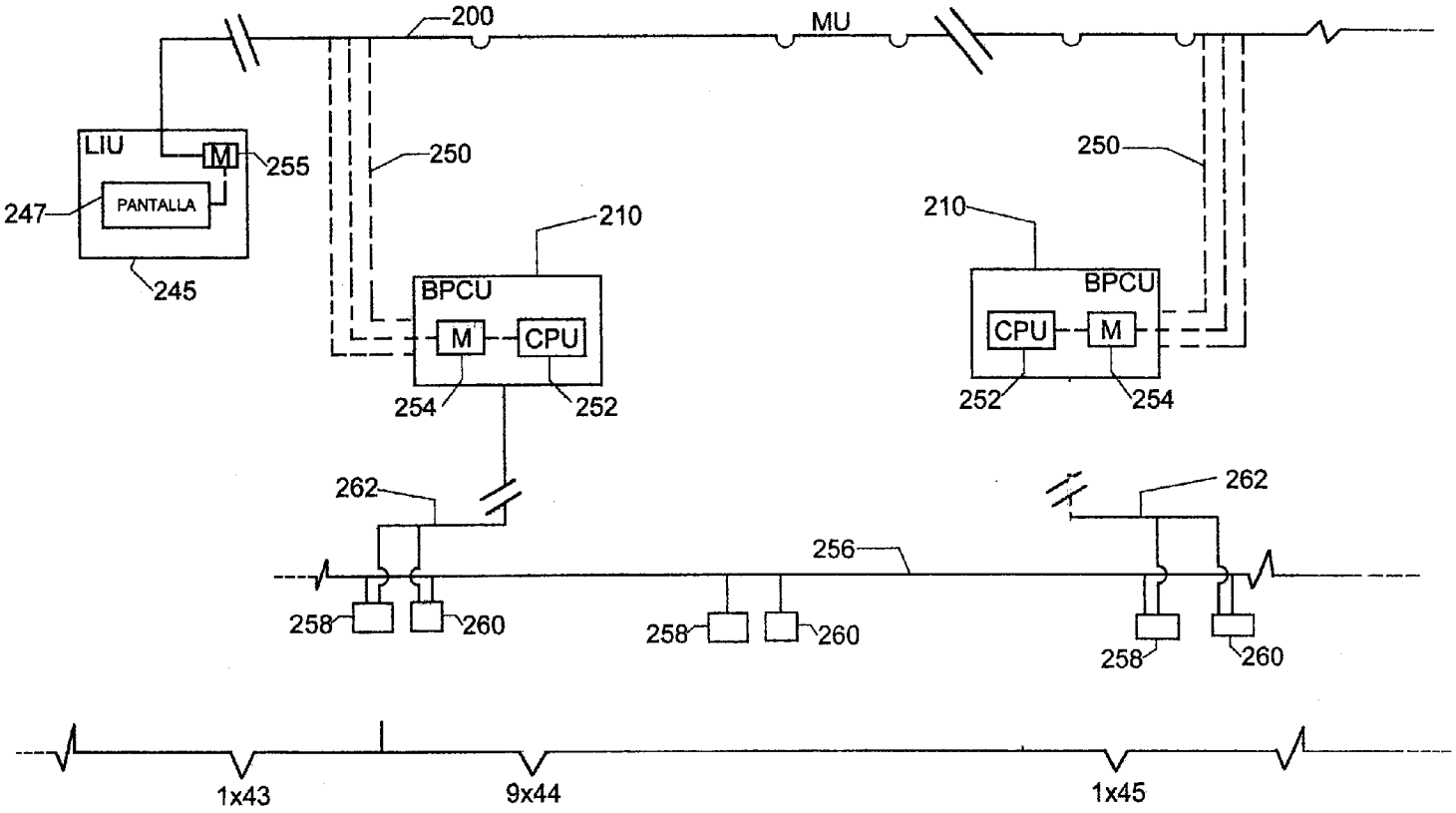

Referring to the FIGS. 45*a*–45*c* in detail, the positions shown therein are the normal functioning of the automatic spring-applied parking brake. As shown in FIG. 45*a,* whenever the car's air brake system is fully charged, the parking brake actuator 303 will be pressurized, moving it to the release position shown. This results in the parking brake release chain 343 being in a slack position, and the brake shoe 346 is disengaged from the car wheel 324. As long as brake pipe pressure remains above a predetermined pressure, such as 40 psi nominal, as it will in all normal train operating circumstances, the actuator 303 will remain charged at or above this pressure.

Figure 44C:
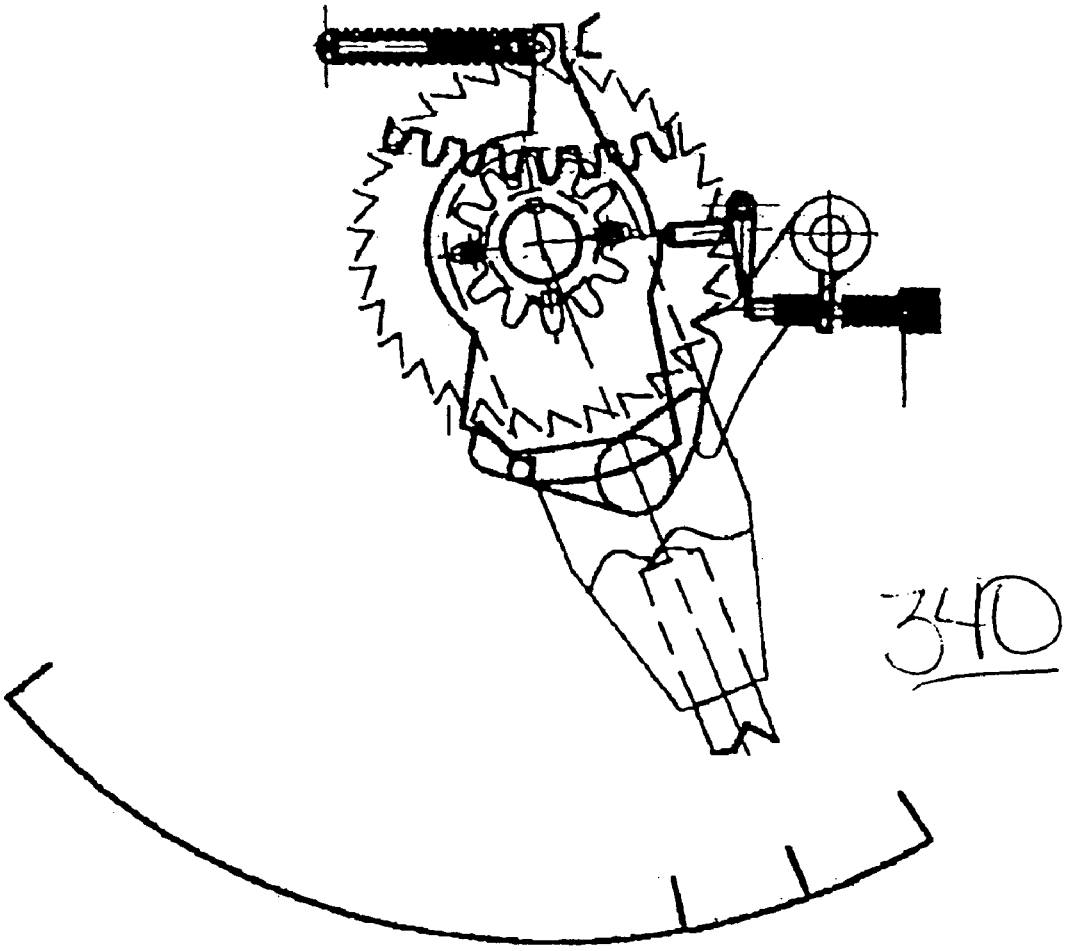
Figure 44D:
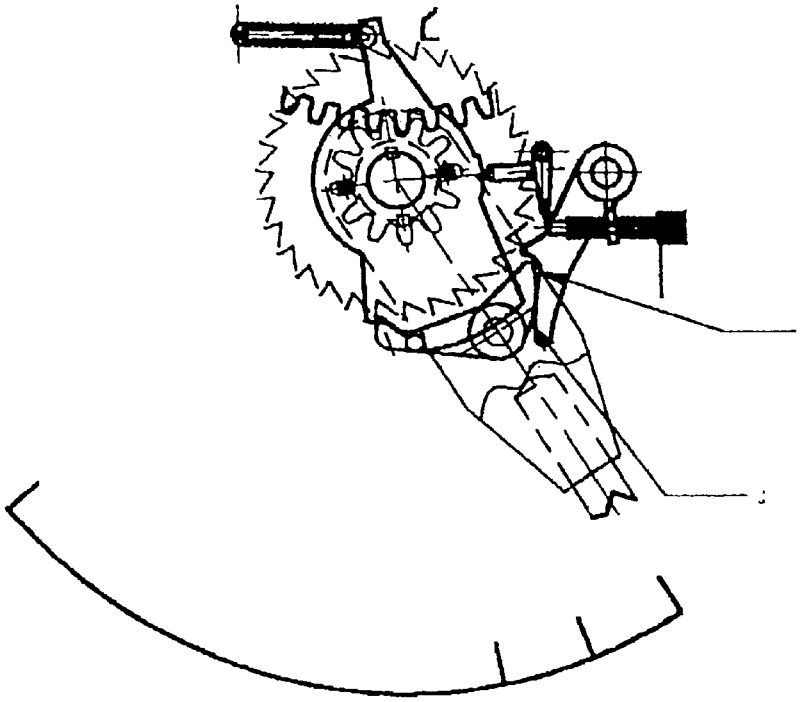
Figure 44E:
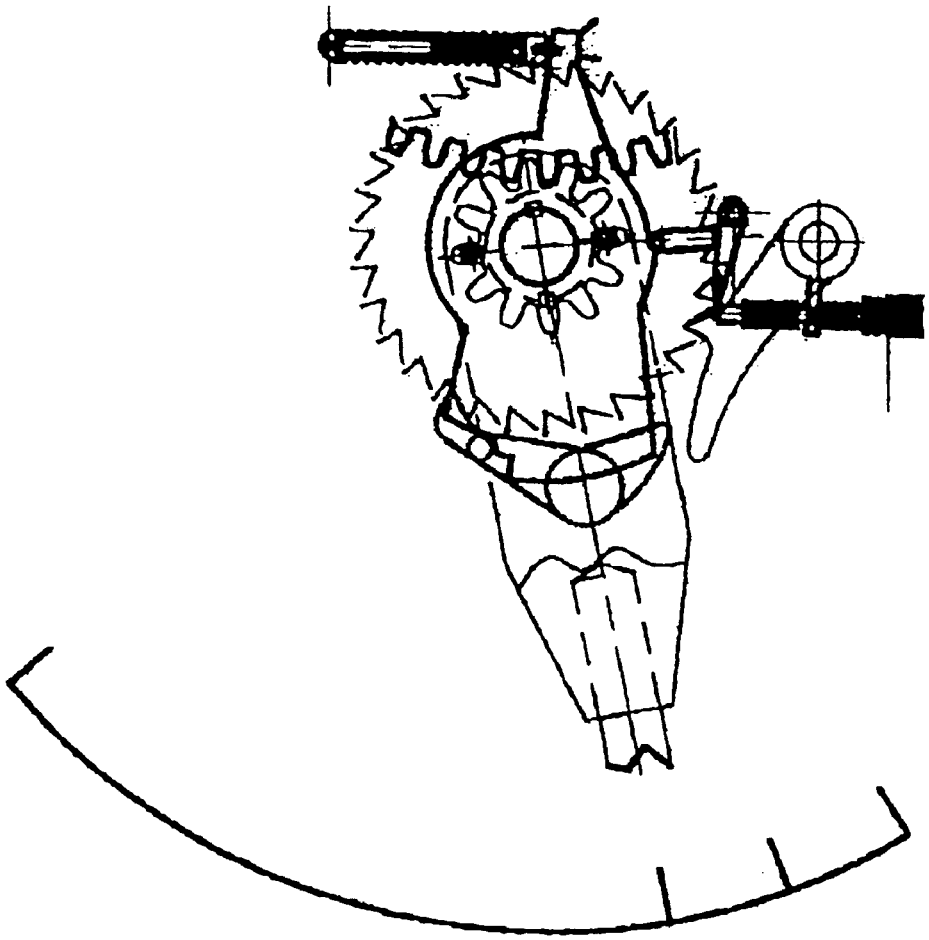
Figure 44F:
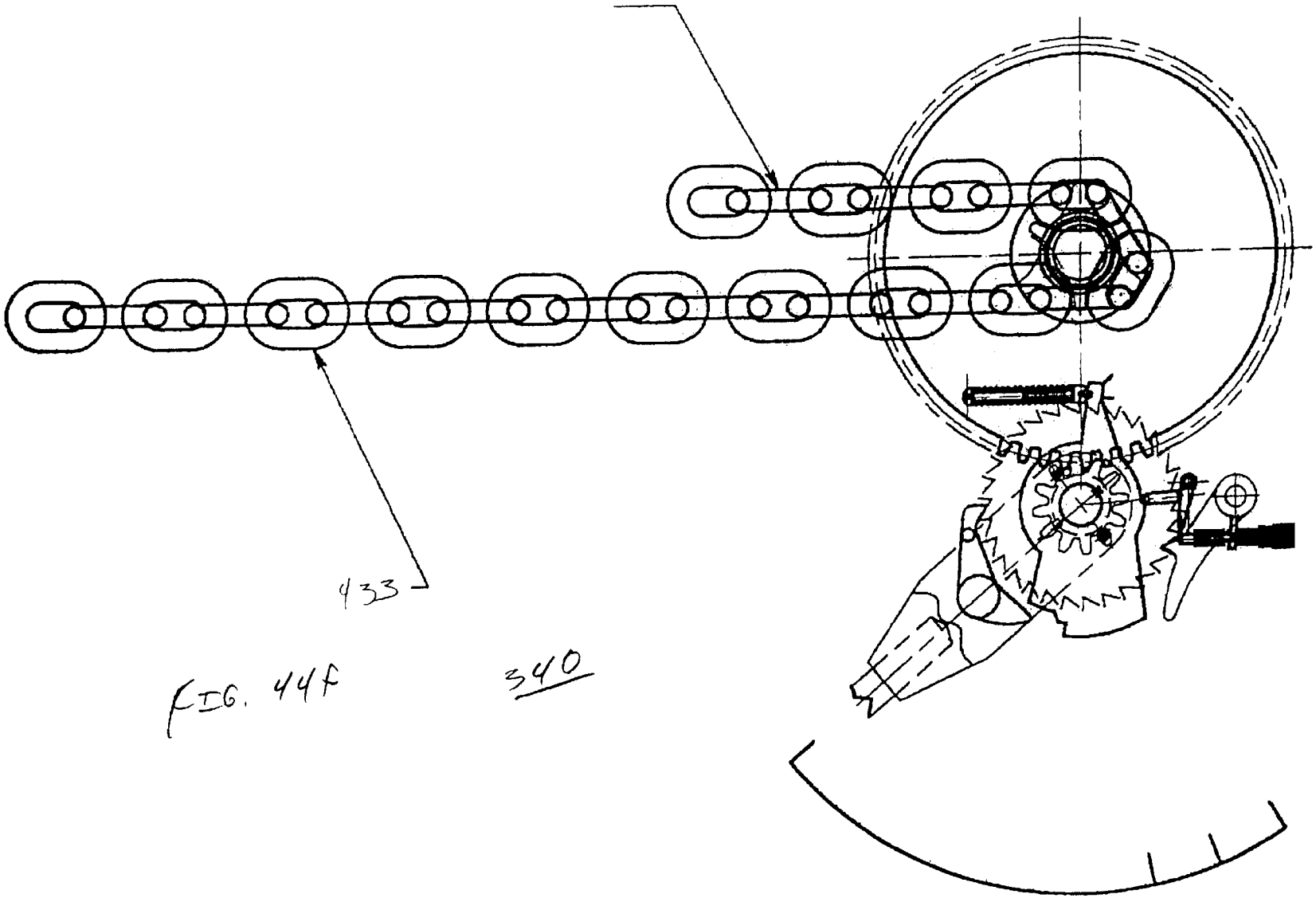
Figure 44B:
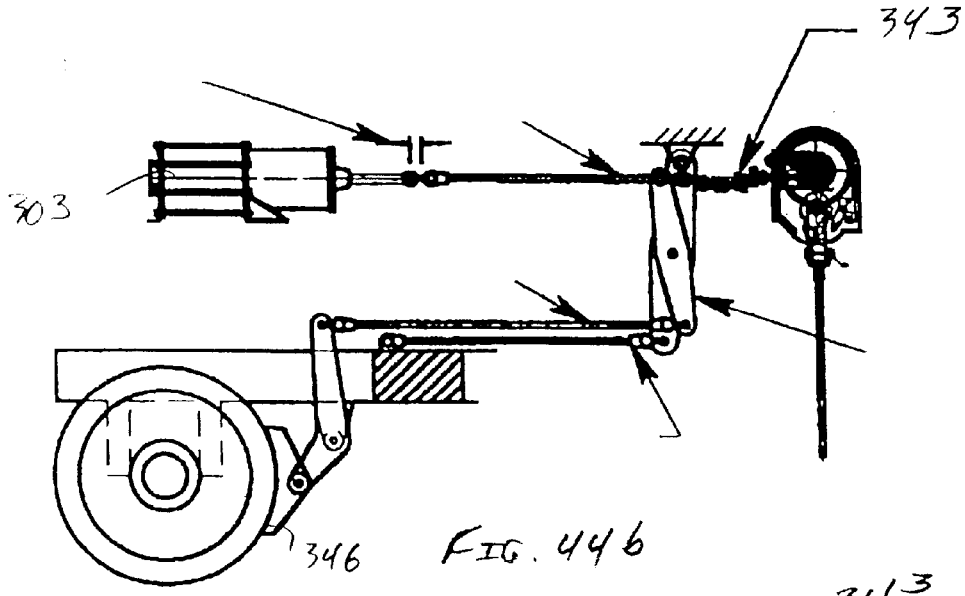
Figure 44C:
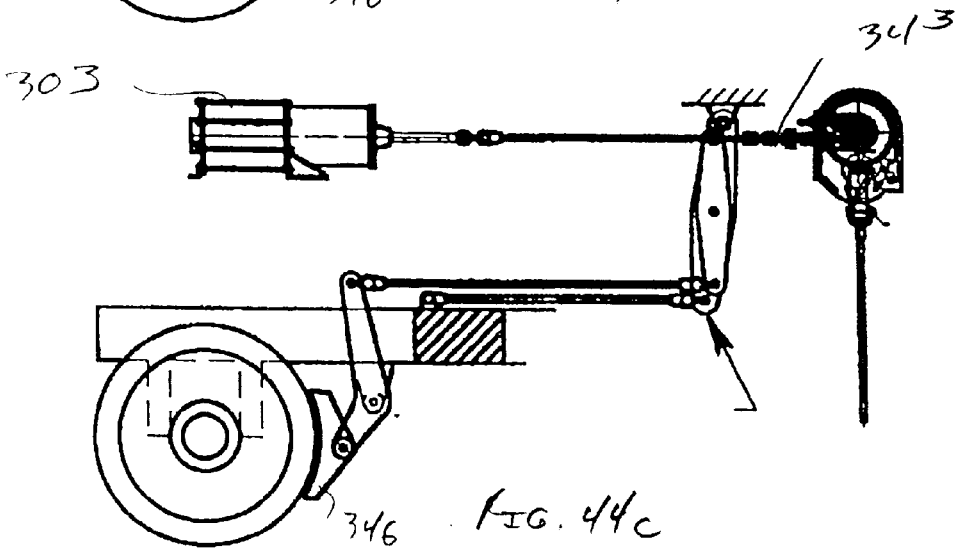

Reduction of brake pipe pressure below the predetermined low value will permit the parking brake 300 to function, but will not in itself cause application of the parking brake. This is due to the interlocking of the pneumatic braking system with the parking brake, which only allows the parking brake cylinder pressure to reduce to a value equal to the value of the car's auxiliary reservoir. When this auxiliary reservoir pressure is lost, the piston of the parking brake actuator will be withdrawn, resulting in the brake equipment being positioned as shown in FIG. 44*b*. In this instance, the actuator rod 349 rotates the application lever 303, thereby causing parking brake pull rod 352 to pull up on the handbrake lever and move the brake shoe 346 to frictionally engage the car wheel 324.

Thus only when normal air brake cylinder pressure is lost is the parking brake 300 permitted to apply, and then only to a degree approximating the loss of normal full service brake cylinder pressure. Use of the auxiliary reservoir rather than the brake cylinder pressure to control the parking brake provides a distinct advantage. This is that the brakes may be released for switching purposes using the normal brake cylinder release valves without causing the spring brake to apply. This permits normal switching operations to be carried out without either the air brake or the parking brake being applied, so long as the auxiliary reservoir pressure is maintained. After switching, should it be desired to apply the parking brake 300, for example to hold the car on a grade, a simple pneumatic valve (not shown) may be operated from either side of the car which connects the parking brake exhaust to the normal brake cylinder, which is at atmospheric pressure. The parking brake will thus apply. Restoration of brake pipe pressure will, however, return this valve to its normal position. In any case, should the auxiliary reservoir pressure be lost, the parking brake will apply. At this point, in most cases the car would be on either a yard track or a customer siding, awaiting its next move by a locomotive.

Figure 47:
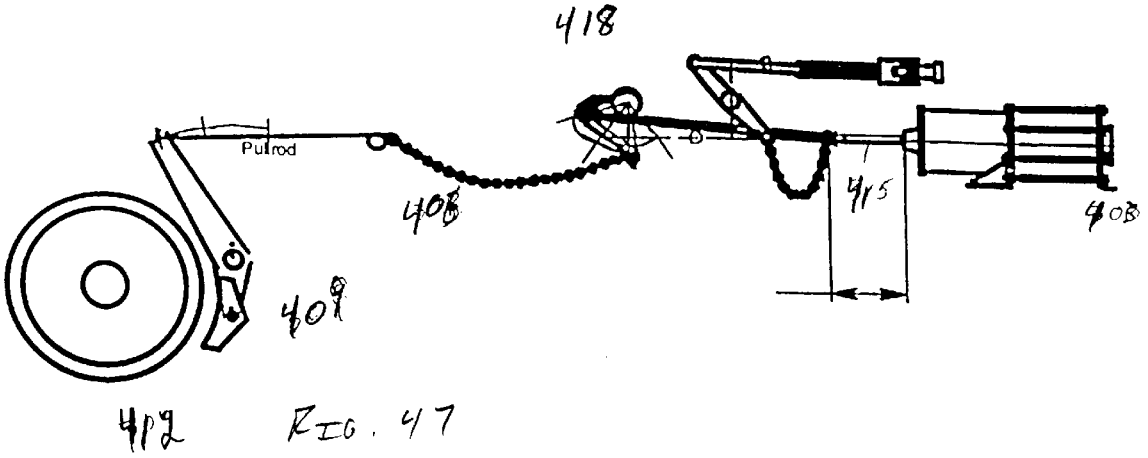
FIG. 47 shows an alternate embodiment of the spring applied, air released parking brake of the present invention in a manually released, no air on car position.

When that move is to be made, the normal connection and charging of the brake system releases the parking brake as described above. Should it be desired to move the car without restoring the air brake, it is necessary to manually pump off the parking brake using the device shown in FIGS. 47–49. The operator actuates the manual release mechanism 421 to take up the slack in the manual release chain 424 to thereby pull the actuator rod 415 back to a full release position. This, in turn, pulls out the actuator piston and rotates the application lever, slacking the parking brake pull rod 406 and disengaging the shoe 409 from the wheel 412. A single motion of the manual operating handle 427 can trip the release mechanism 421 after the car has been moved, allowing the actuator 303 to reapply the parking brake.

Figure 48:
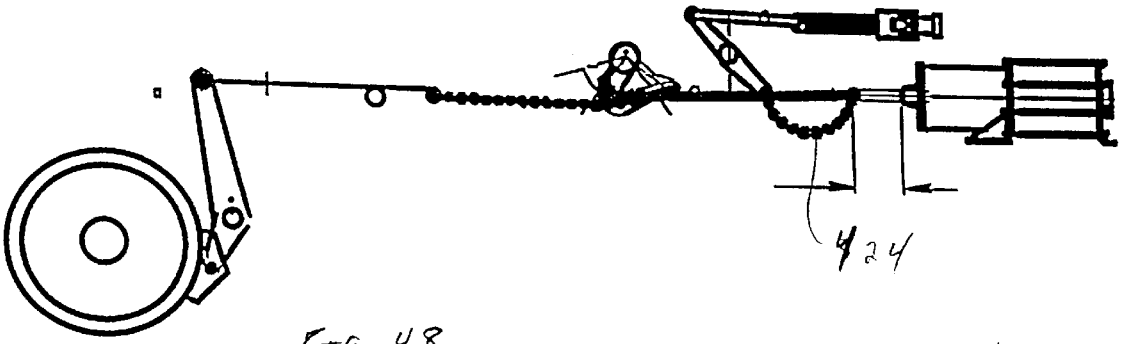
FIG. 48 shows the embodiment of the spring applied, air released parking brake of the present invention in FIG. 47 showing the automatic parking brake function restored by normal recharge of the brake system.
Figure 49:
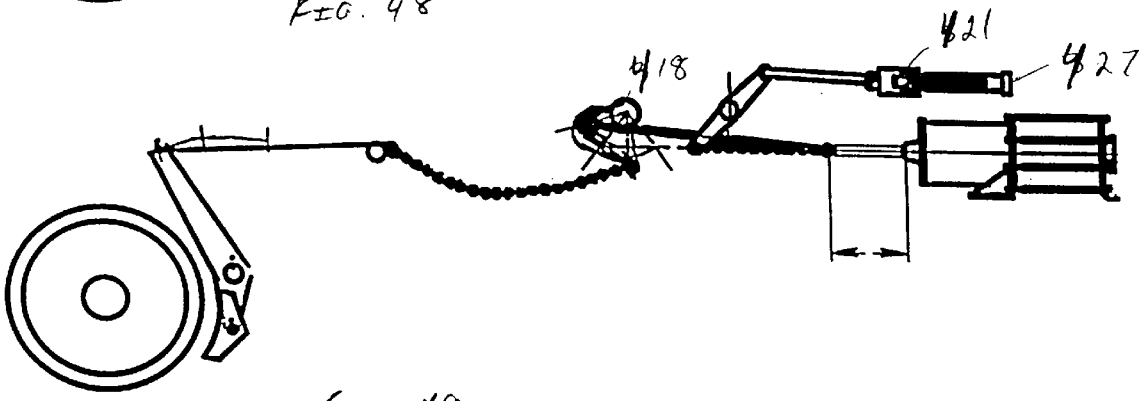
FIG. 49 shows a top view of the a release device linkage and bell crank for the spring applied, air released parking brake shown in FIG. 47.

In the event that the parking brake was pumped off, after the car is taken into a train and it's brake pipe charged, the disabled parking brake is automatically re-enabled as shown in FIGS. 48 and 49. Recharge of car brakes moves actuator piston fully out, slacking the release chain 424 thus removing all force from the release mechanism 421. This causes the device's holding pawl (described below) to trip, preventing tension from being applied to the release chain 424 when the actuator 403 next withdraws to apply the parking brake. Thus, in this embodiment no manual action is required to restore the automatic parking brake function.

As discussed above FIGS. 44*a*–44*f* show the operating positions of the manually operated release mechanism 340, which is in some respects similar in operation to an automotive bumper jack, with the exception that there is no function selection device on it. The functioning of the device as outlined in FIG. 44 depends only on the position of the operating handle 427, which is spring-returned to its storage position when not in actual use by an operator.

In the position diagram shown in FIGS. 44*a*–44*f* for the manual override device for the spring applied air released parking brake according to the present invention. Pumping the handle 427 in the release zone 430 winds a chain 433 through the action of two pawls: a holding pawl 436, which can prevent the extension of the release chain 433, and a jacking pawl 439 which moves with the handle 427 and ratchets over the ratchet wheel 442 when the handle is pushed to the right (in the figure), this forces the chain to retract when the handle is pulled to the left and the ratchet pawl 436 engages. Thus the operation of the handle in the release zone 430 will move the release chain to retract on the pull stroke, and the holding pawl 436 will prevent extension of the chain 433 during the push stroke. When the chain is fully retracted, the spring brake actuator piston rod will be pulled by the connecting linkage fully to its release (fully extended) position, thus releasing an applied parking brake without restoring air to the parking brake actuator's release piston.

Figure 46:
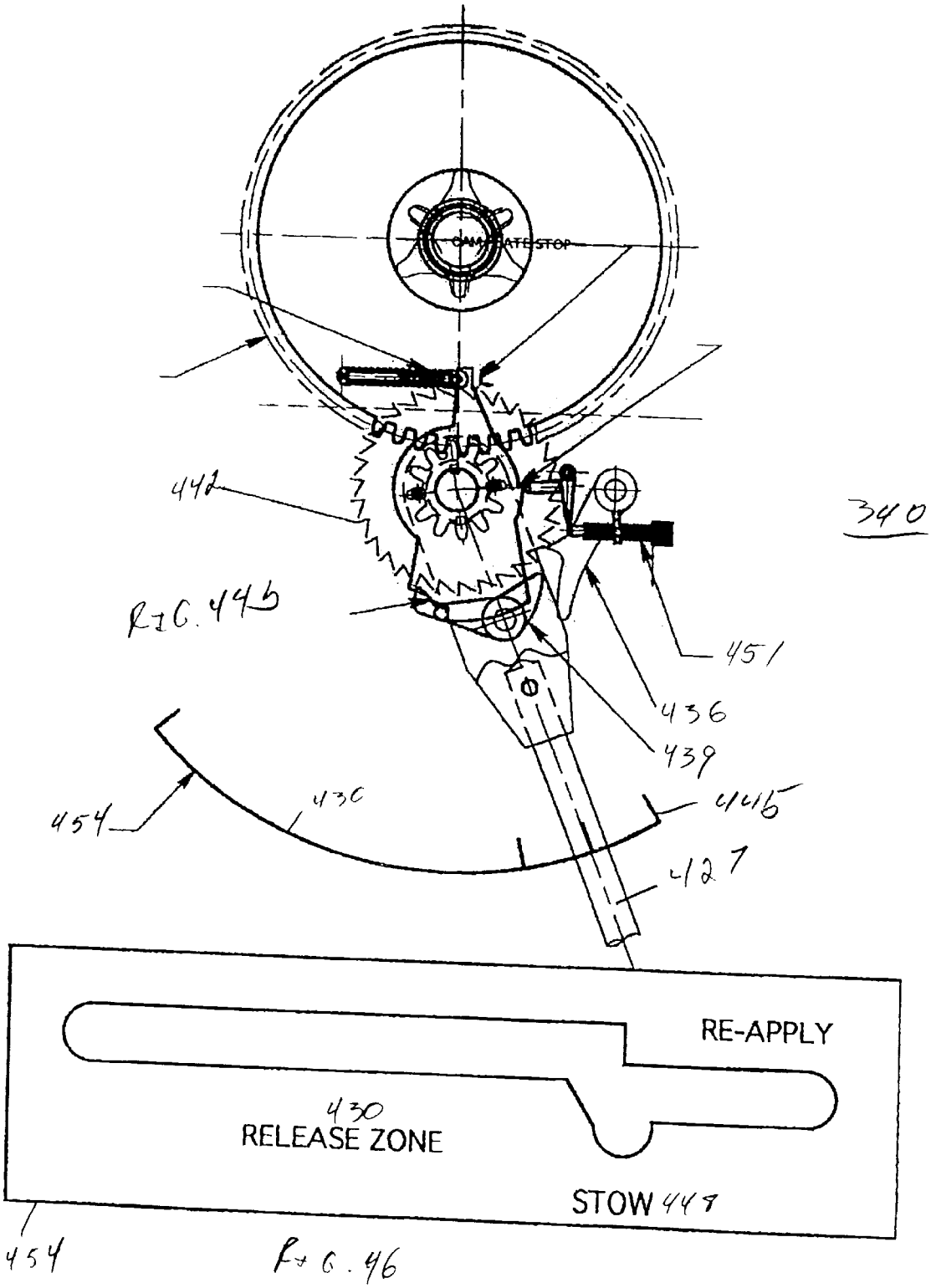
FIG. 46 shows a preferred embodiment of an escutcheon plate used to indicate and limit handle position and function to an operator for the present invention.

When the handle is forced rightward to the application position 445, the jacking pawl 439 will remain disengaged and the holding pawl 436 will be forced out of engagement with the ratchet wheel 442, regardless of load. This will permit the spring brake to pull the chain out as far as necessary to allow full spring brake application. In the storage position 448, the jacking pawl 439 is lifted out of engagement with the ratchet wheel 442, and the holding pawl 436 is urged out of engagement by a pawl release spring 451, which is not strong enough to overcome the friction keeping the holding pawl engaged if it is holding a high load, as would be imposed by manual release of the applied spring brake 300. In the storage position (manually released or overridden condition), when air pressure is supplied to the spring brake actuator, relieving the load on the holding pawl 436, this pawl will retract under the influence of the previously mentioned pawl release spring 451. When the air is later released to cause an automatic application of the parking brake, the brake will apply because the disengagement of the holding pawl prevents the release mechanism from interfering with automatic operation of the spring brake. FIG. 46 shows a preferred embodiment of an escutcheon plate 454 used to indicate and limit handle position and function to an operator.

There are two methods of employing the devices making up the system. In the first, directed primarily at the multi-platform car application, both application and release of the parking brake are automatic as described above, while in the second, release is automatic, but application, which requires only the relatively effortless single movement of a simple control, is only manually initiated. This latter mode of employment prevents a potential problem of an automatically applied system, which is that it may be applied when not desired, which can result in wheel damage if the car was then moved without first charging the brakepipe.

While this is not a problem with a car in, basically, "liner service" where it is shuttling between specific terminals staffed with personnel familiar with the equipment, it could become a problem for cars in general service, which are handled not only at designated points, but also switched between trains at trainyards of different railroads at widely varying locations, where people may only be familiar with the standard manually applied and released handbrake. In this latter case, operating personnel would not be looking for parking brakes applied by an automatic system or device, and might easily move cars with no air assuming that no brake would be applied.

In this latter, general interchange car case, it is desirable that the operation of the equipment be such that the parking brake is not applied automatically. When a parking brake is desired, however, it should be possible to apply it from a position on the ground, with minimum of human effort. Release should be automatically made, in normal train operation, as a result of release of a normal air brake application, and a manual override device should be capable of releasing an applied parking brake when no air is available. The override device should also provide for manual re-application of the parking brake again without air on the car, in order to provide for the movement of cars in emergency circumstances where air cannot be provided for the normal functioning of the brake system.

Multiplatform or "Liner Service" Application

Figure 50:
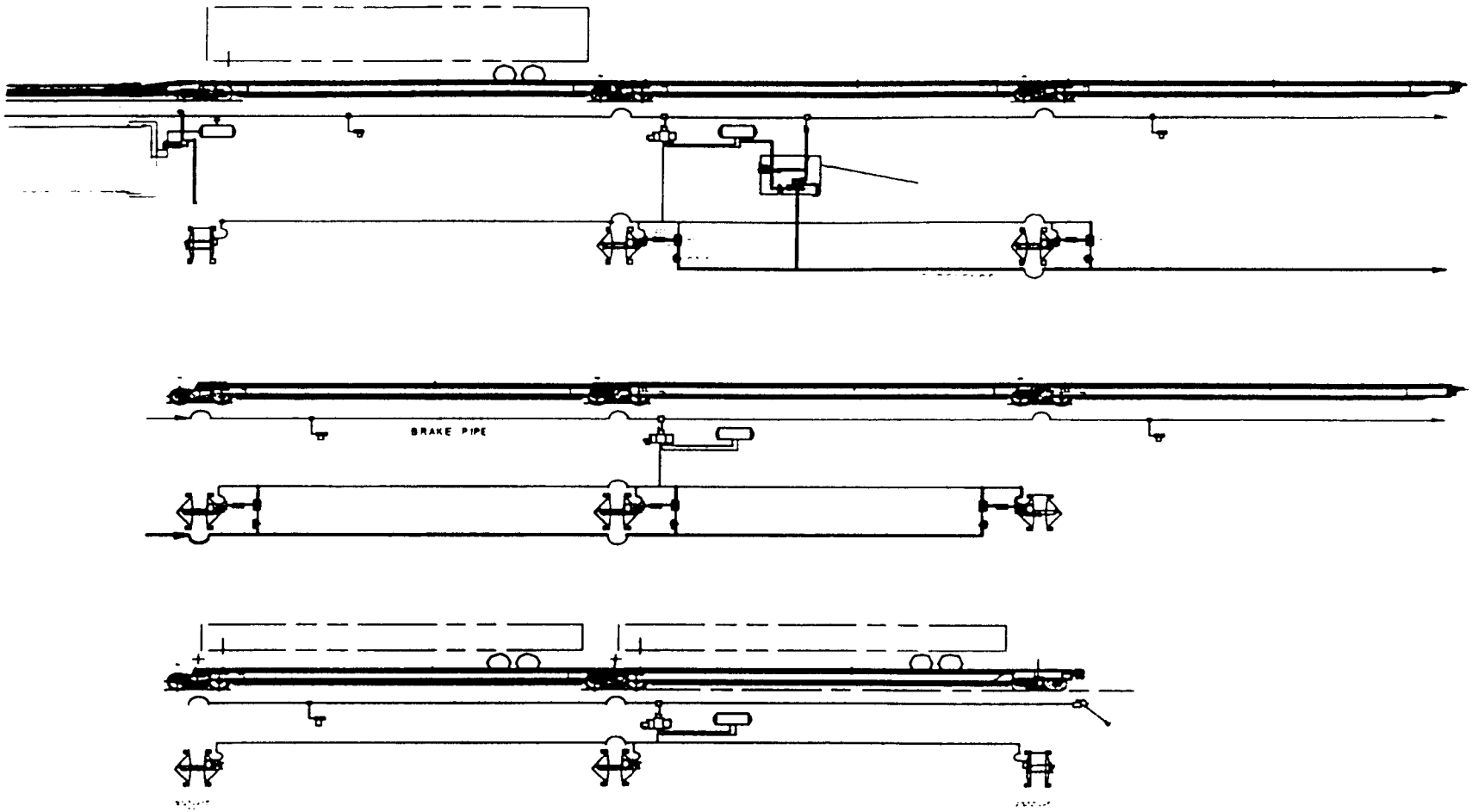
FIG. 50 show an eight platform articulated train having an automatic spring applied parking brake according to the present invention.

For the "Liner Service" type equipment, a somewhat more sophisticated system is possible, based as stated, on the fact that only a limited number of persons need be educated to the operation of a parking brake system that is different in operation than the standard Handbrake. The mechanics of such a system are described above. The pneumatic means by which control of this system may be automatically realized is described below. A schematic representation of a train for this service is shown in FIG. 50.

The figure shows an eight platform articulated train arranged to load from its left end. The car is equipped with a conventional ABDX brake System, TMX Truck Mounted foundation brakes and the proposed automatic spring applied parking brake system, which is effective on the second through sixth truck.

Figure 51:
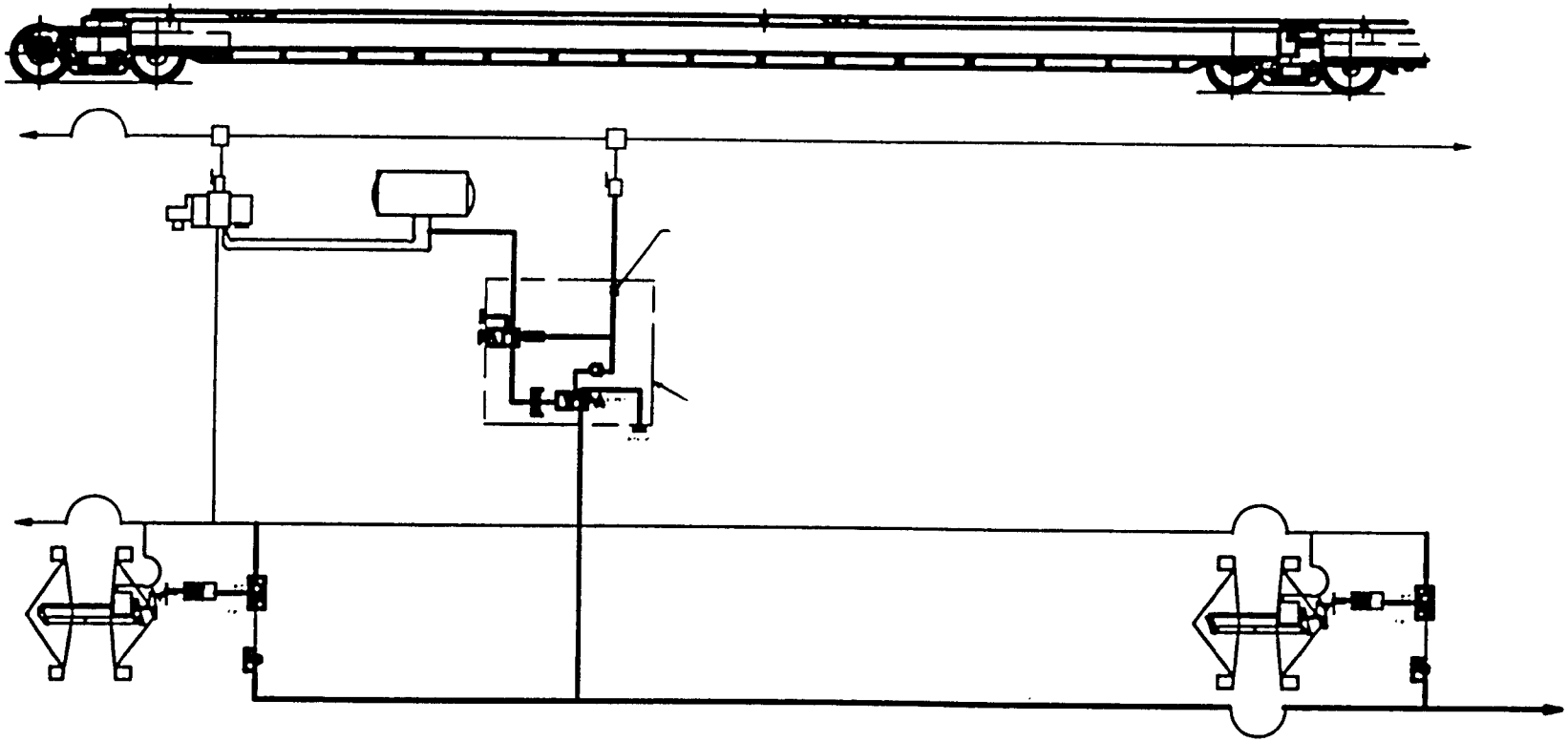
FIG. 51 is a schematic representation of air piping utilized for the spring applied parking brake.

FIG. 51 is a closer view of the second platform which includes the operating controls for the parking brake. This figure details the additional piping required to add the spring brake release pipe, and control its charging and discharge so as to prevent application of the parking brake during normal operation of the multi-platform car in both train movement and yard switching operations. The function of the additional pneumatic parts is explained in connection with FIG. 52 below.

This figure shows the several valves required for operation of the system in detail, and is the reference for the operation description that follows.

Automatic Release

When the brake pipe is charged, the Control Valves are shifted to release position, which exhausts the Brake Cylinder Pipe to atmosphere and charges the auxiliary and emergency reservoirs from brakepipe. A Control pipe, running from the Auxiliary reservoir to a the Automatic Application Valve will shift this valve to its Release position when auxiliary reservoir pressure rises above 40 psi. In the Release position, the valve connects the brake pipe (which flows through a Protection Choke and the backflow Check valve) to the Parking Brake Release pipe, which runs through all the platforms equipped with automatic Parking Brakes, as shown in FIGS. 50 & 51. This pipe will then be charged from the brake pipe via the above mentioned choke and check valves. Note that no air other than the tiny volume to pilot the Application valve is taken from the Car's Auxiliary Reservoir, thus there is no possibility of the Parking Brake system interfering with normal brake operation when a brake application is called for.

At the several Parking Brake Release Cylinders, air from the Parking Brake Release Pipe flows through the Application Rate Control Check, enters the Parking Brake Interlock Double Check valve, shifts it to it's upper position, and flows into the Parking Brake Actuator, compressing it's application spring and, at a pressure of 45 psi or above, fully releasing the parking brake.

Automatic Service or Emergency Brake Operation

When the Train brake is applied in either Service or emergency, the brake cylinder pipe associated with each control valve (including that on the car with the Parking Brake Control Manifold) will be charged to the desired pressure and brakes will apply. Since the Parking Brake Interlock Double Check Valve is already in its upper position, the rise of pressure in this pipe will not be diverted into the Parking Brake Actuator, and there will be no interference with the operation of the service brake. In the event of an Emergency brake application, this remains true, and there will be no action by the Parking Brake Application Valve, as the Auxiliary reservoir pressure will remain well above the 40 psi operating point of this valve.

Switching—Brake Cylinder Release Valve Operation

If train crew personnel operate the brake cylinder release valves on the individual platforms in order to permit switching of the cars, this action will not affect the parking brake, and it will remain released so long as the Auxiliary reservoir has not lost its charge.

Switching—Manual Parking Brake Application

In normal trainyard operations, it would be desirable for the trainman to operate the handbrake after final spotting of a car had been done, and the Manual application valve shown on the figure permits this whenever desired. When there is no brake pipe pressure present as is the case during switching, pressing the manual operator on this valve will exhaust the Parking Brake Release Pipe, and cause all Parking Brake actuators to retract under the influence of their Power Springs, pulling the handbrake pull rod and applying the parking brake in the same way that a handbrake would be applied. Note, however, that since multiple parking brake locations are controlled from a single Parking Brake Control, this action is both much easier physically than applying the same number of handbrakes would be, and is much more economical of time. Only a single location need be operated by the trainman to apply all brakes on an articulated car.

Automatic Parking Brake Application

If an articulated platform equipped with the system in this "liner" configuration is parked by its delivering locomotive, with no necessity for switching and the attendant operation of Brake Cylinder Release Valves, then the train will simply be parked with the automatic brake applied in Emergency, and the service brake will hold the train until brake cylinder leakage reduces its holding power. As the brake cylinder and Auxiliary reservoir remain connected during this entire period, the cylinder leakage will also reduce the pressure in the Auxiliary Reservoir. When the Auxiliary reservoir pressure has fallen to a point below 40 psi (normally a matter of several hours or days) the automatic application Valve will switch back to the position shown in FIG. 52, exhausting the Parking Brake Release Pipe, and causing all Parking Brake actuators to apply their respective brakes, thus continuing to hold the train for an indefinite period, regardless of leakage. This mode reduces to essentially zero time and zero effort the Trainman's task in applying parking brakes.

Automatic Parking Brake Release

Figure 52:
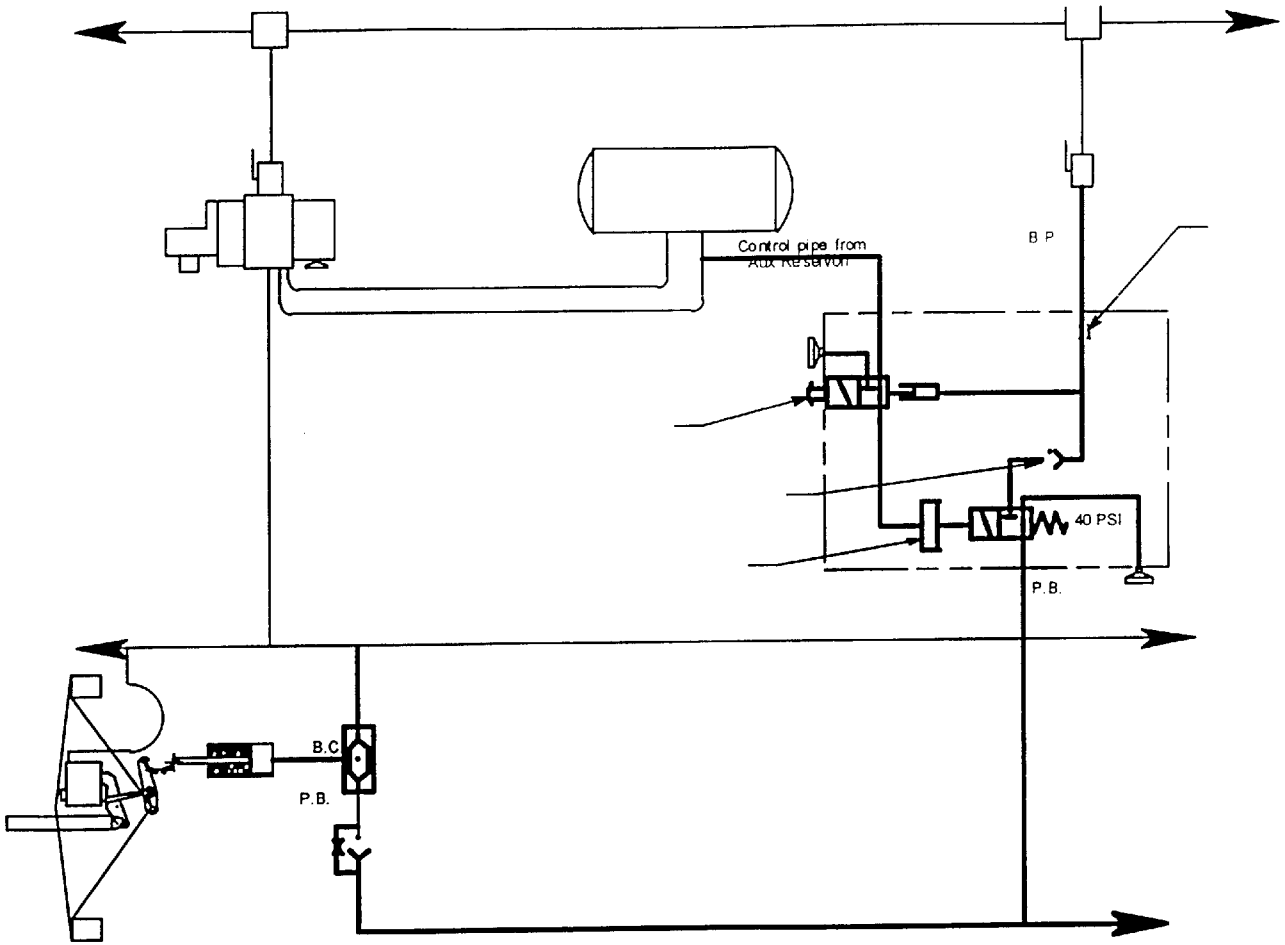
FIG. 52 is a schematic representation of a control system for the spring applied parking brake.

Still referring to FIG. 52, whether the parking brake has been set by operation of the Manual Application Valve, or has set itself as a result of insufficient brake cylinder pressure, the act of recharging the brake pipe will fully release the Parking Brake. When brake pipe pressure is restored, this pressure flows through the protection choke and the Backflow Check, but initially is prevented from charging the Parking Brake Release Pipe by the closed Automatic Application Valve. Brake pipe pressure is present on the pilot piston of the Manual Application Valve, and at about 20 psi, will force this valve to revert to its normal position, as shown in the figure. In the event that the parking brake had applied without manual operation of this valve, it would be in the normal position at this time in any case.

In either case, Auxiliary Reservoir pressure will pass through the Manual Application Valve to the control port of the automatic application valve, and when this pressure exceeds 40 psi, pilot the Automatic Application Valve to its Release Position. In this position, the Parking Brake Release the pipe will recharge from brake pipe, and the parking brake cylinders will likewise charge and release, permitting normal operation of the train.

Emergency Manual Parking Brake Release

While it is intended that the parking brake should never be released other than by the recharging of brake pipe, as outlined above, there will be occasions, particularly in cases of equipment failure, when manual release of an applied parking brake without any use of air, will be desirable. For this reason, the Brake Release Jack described below has been developed. The operation of this device, and the connection of the parking brake apparatus both to the release Jack and to the handbrake chain of a car is outlined above in connection with FIGS. 44*a*–44*f*.

As these figures show, the Manual Release Mechanism, or Release Jack, is connected to the Pull Rod of the Spring Brake Actuator in such a was as to draw the rod out of the cylinder when actuated by operating the handle of the Jack. The operation of the Jack is entirely dependent on the position of it's operating handle, as shown and described above.

Referring to FIG. 49 in particular, note that with the handle in the Storage Position, the jack will be automatically released when air pressure is restored to the actuator, so that manual release will not prevent operation of the automatic parking brake the next time it's use is called for.

The handle of the release jack is intended to protrude close to, but not beyond, the edge of the car at the lower sill level, and to project through an Escutcheon Plate, which will indicate the positions referred to above to the operator, and both limit the travel of the handle, and locate precisely the relatively narrow limits of the "STOW" position. A front view of this plate is shown in FIG. 46.

Spring Applied Parking Brake Applied to Interchange Car

To apply the principles outlined above to a standard interchange car requires recognition that such a car will almost never be in a service where automatic parking brake application, as outlined above, is desirable. Instead, the normal procedure would be to bring the car to a yard from which it would likely be handled in switching service with no air brake connected. At the same time, a trainman would be expected to set the parking brake on a car once it was placed on a siding or left in a location where it was intended to remain until moved by a locomotive. These operating differences require only slight modification to the means and methods set out above.

Figure 53:
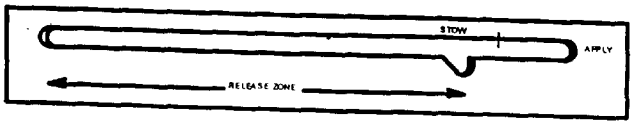
FIG. 53 is an alternative embodiment for an escutcheon plate according to an alternative embodiment of the spring applied parking brake.

In particular, to accommodate the general service car, three alterations, all simple and easily accomplished, are made to the system described above:

First the Release Jack is changed so as to eliminate the option for automatic application provided by the "STOW" position, as shown in FIG. 53.

Second, the linkage between the Actuator and Jack is changed so that extension of the actuator will force the jack to take up; thus once the parking brake cylinder has extended to release, the release jack will ratchet up automatically and prevent application of the parking brake even when the Actuator is vented.

Third, the Manual Application Valve must be linked to jack handle movement such that when the handle is moved completely to the right, not only will the ratchet dog be disengaged, the actuator will be vented, and will remain vented until brake pipe pressure is restored.

Figure 54:
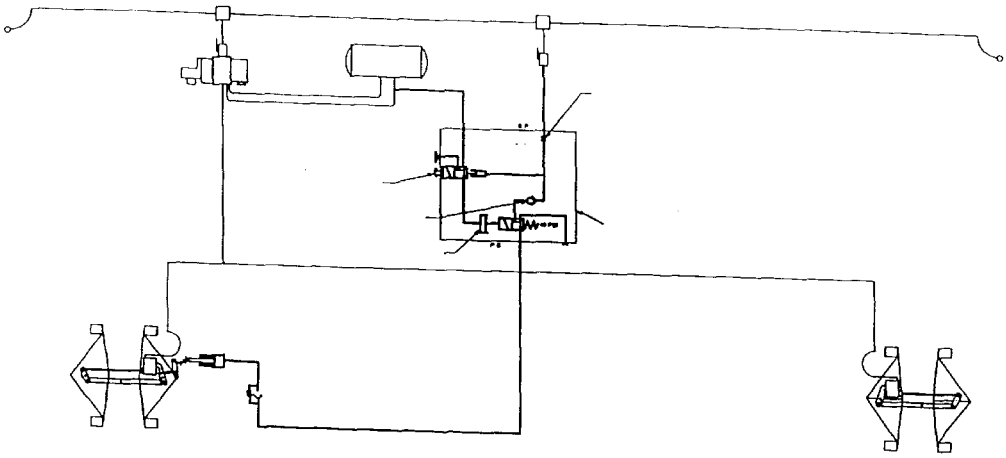
FIG. 54 is a pneumatic diagram for the alternative spring applied parking brake.

With these changes any car could be equipped with the system as shown in FIG. 54.

Regarding FIG. 54, there are few differences with the previous diagram, the principal ones being that the Interlock Double check valve to the Actuator Cylinder is not required, because the Parking Brake can not be automatically operated, thus there is no possibility of having both parking and pneumatic brakes unintentionally applied simultaneously on a single car. Ideally, the additional operating valves for the parking brake could be housed in a filing piece on the Control Valve.

The advantage of the Spring Applied Parking Brake on the general service car would be that the time and effort to apply and release the brake would be minimized, and the problem of overheated and slid flat wheels due to handbrake left applied would be eliminated. Thus injuries to personnel and maintenance costs would both be reduced. It must, however, be pointed out that if a parking brake was set and the car then moved in the yard without either charging the brake pipe or operating the Jack to force release of the spring brake (two or three pumps would probably be sufficient); the wheels might still be slid. The overheated wheel problem, on the other hand, only occurs on a charged train and would thus be fully addressed by this application.

Health Monitoring

There are only two train borne defects which can lead to derailment; overheated wheels, which may break, and overheated journal bearings which may either seize or burn off. The primary purpose of the health monitoring system is to prevent these two serious defects and their consequences. The system can communicate system status to the train crew by either illuminating defect indicator lights at the appropriate location of the defect, or via electronic communication to a display in the operating cab, depending on railroad preferences. The conditions monitored are the temperatures of all bearings, and whether brakes are dragging. In checking bearing temperature for potential failure, enough electronic logic is provided to sense both rate of temperature rise, temperature differences within a truck, and excedence of a predetermined maximum temperature by any bearing. The system's logic will also detect a faulty sensor, and signal this defect in a different manner than is used for an actual equipment defect. This could be a light of a different color or a specific electronic message.

Sticking brakes are monitored by detecting the position of the brake cylinder on each truck with a proximity switch, so that should dragging brakes occur, this will be immediately indicated by signaling the fact that one or more brake cylinders are not in release position when they should be. If desired, a pressure switch could also be added at each control valve, set to determine the fact that at least fifty percent of a full service brake application was in effect. This would permit monitoring both the fact that the brakes are not released (stuck "off") and that pressure sufficient to cause effective brake application is being supplied. This logic could be used to indicate that brakes properly apply and release on each car, within the meaning of the power brake law for initial terminal inspection.

Locomotive Interface Unit

One of the difficulties in constructing an integral train, is how to apply a standard locomotive with its limited connections to the train (usually only the brake pipe pneumatic interface) to convey and receive the somewhat greater amounts of information required by a health monitoring system and electronically assisted brake system.

Figure 55:
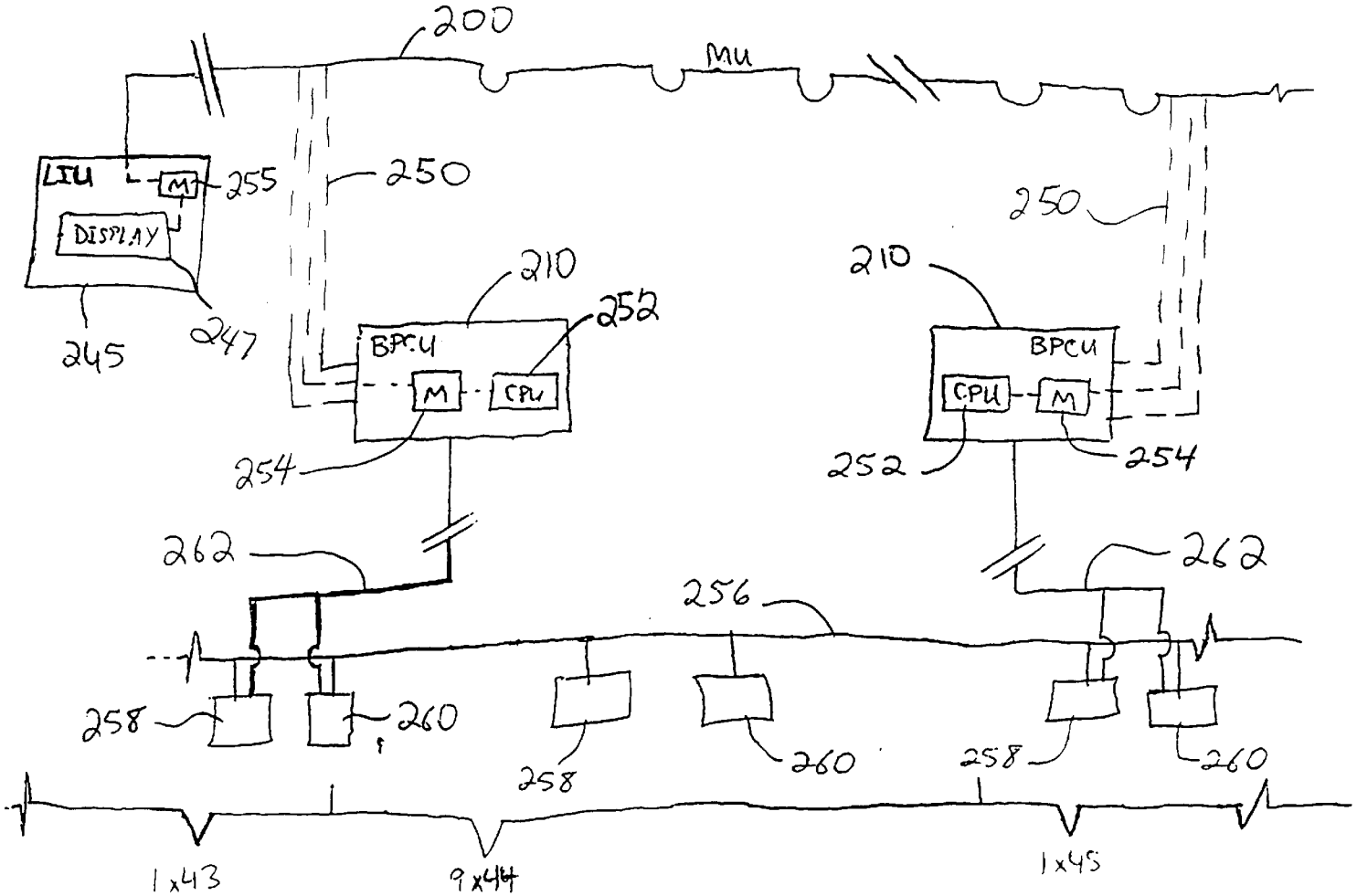
FIG. 55 is a schematic diagram similar to FIG. 34 but showing a preferred embodiment of an electrical communication scheme for a train health monitoring system.
Figure 1:
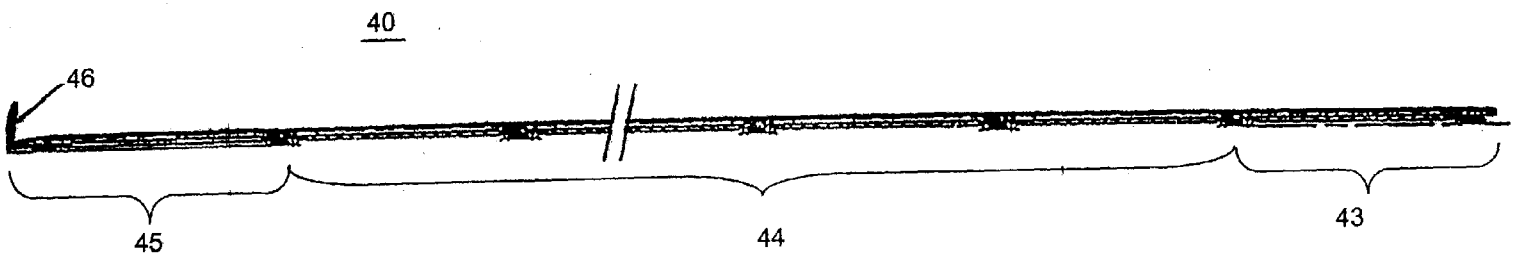
Figures 2, 3, 4, 5:
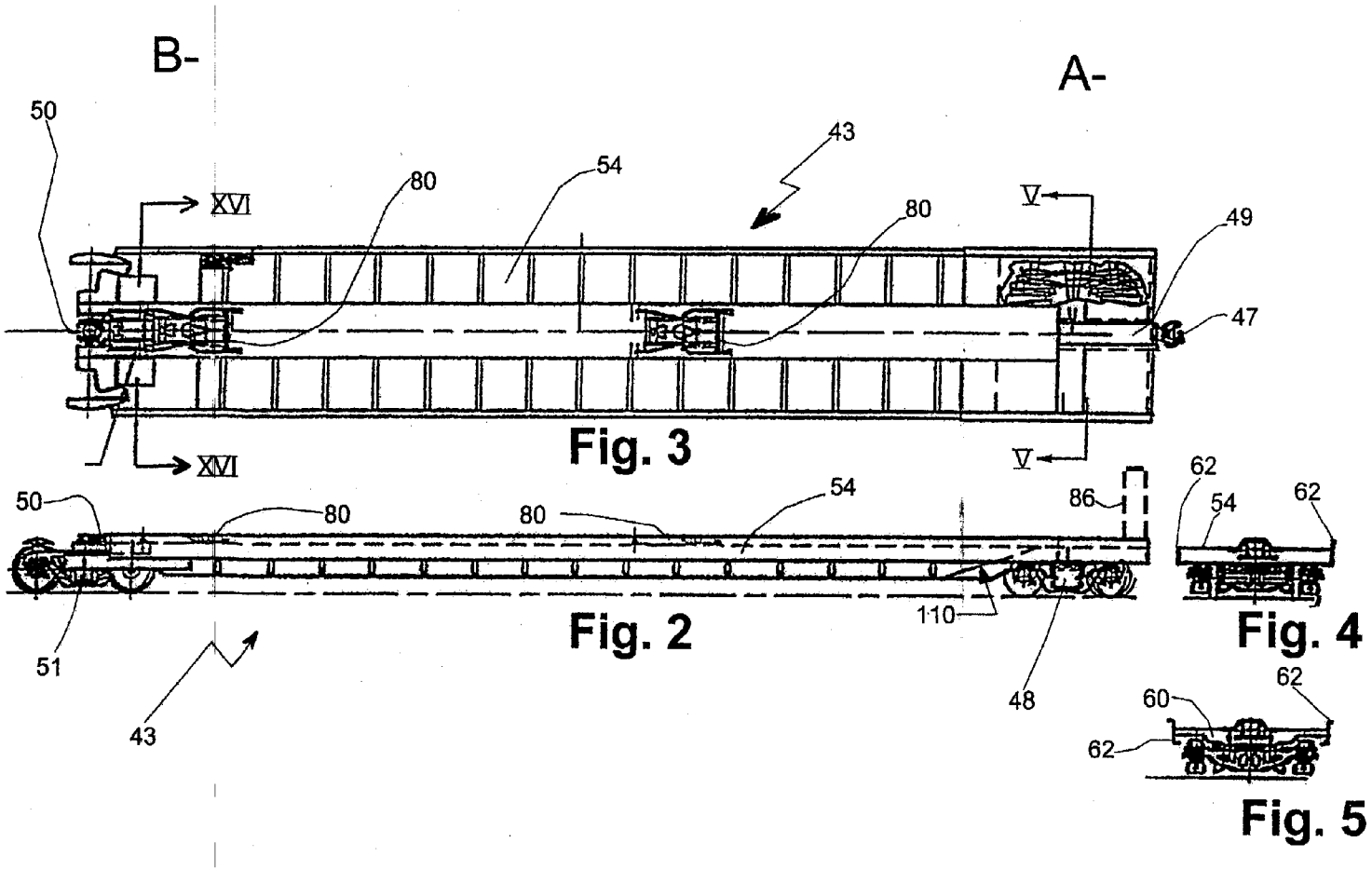
Figures 6, 7, 8, 9, 10:
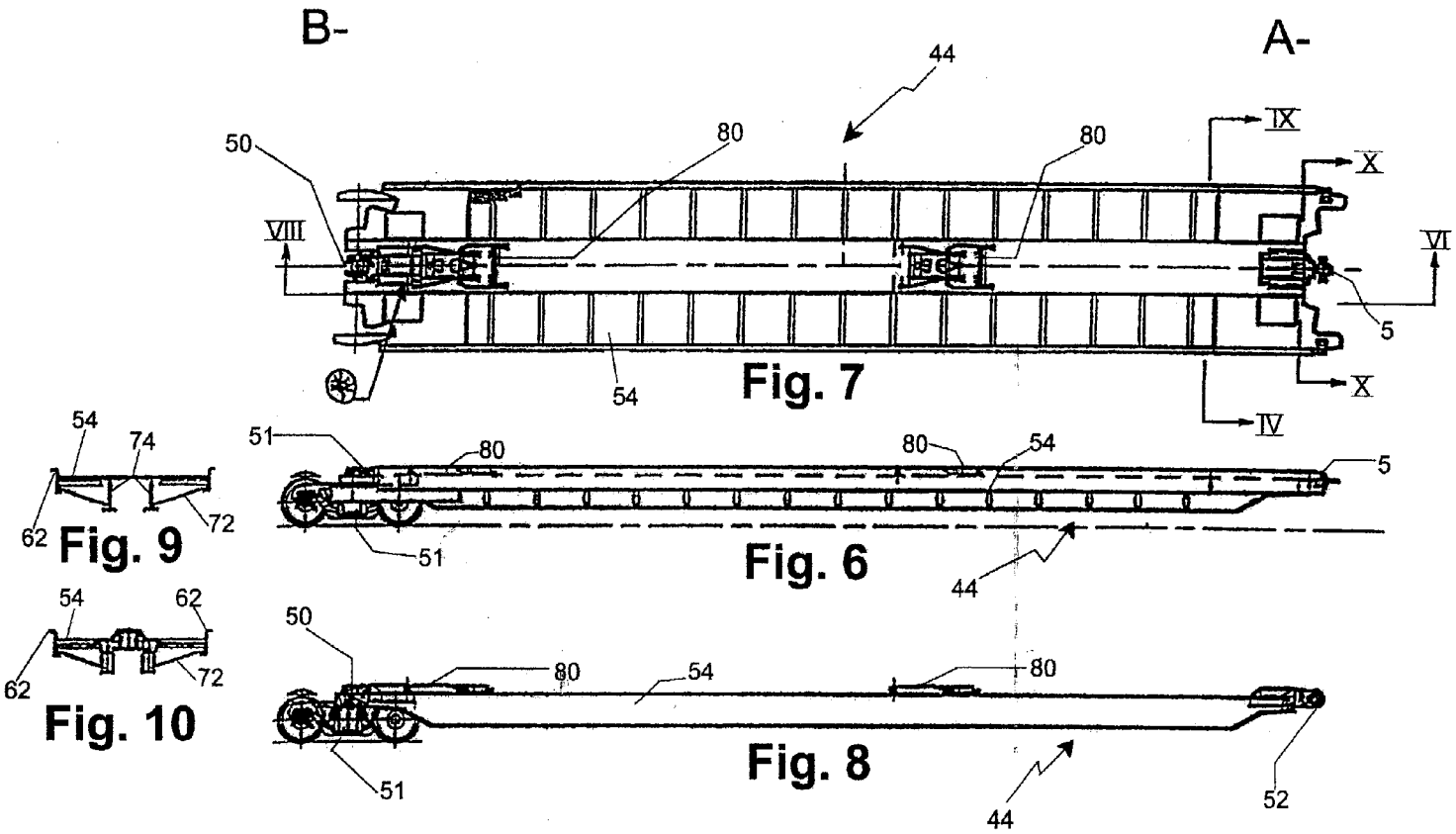
FIG. 9 is a section view taken along the line IX—IX in FIG. 7.
Figures 11, 12, 13, 14:
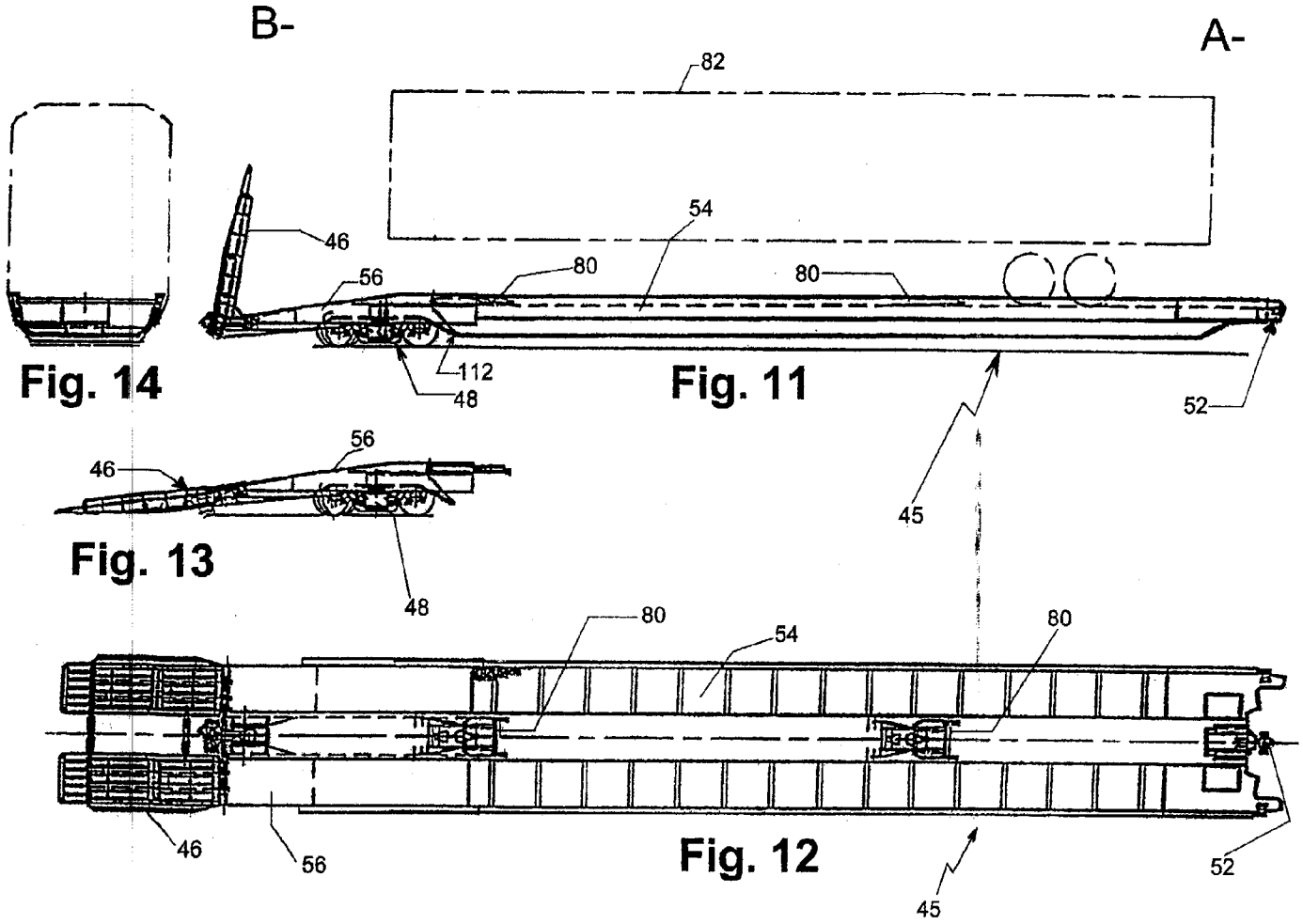
Figure 15:
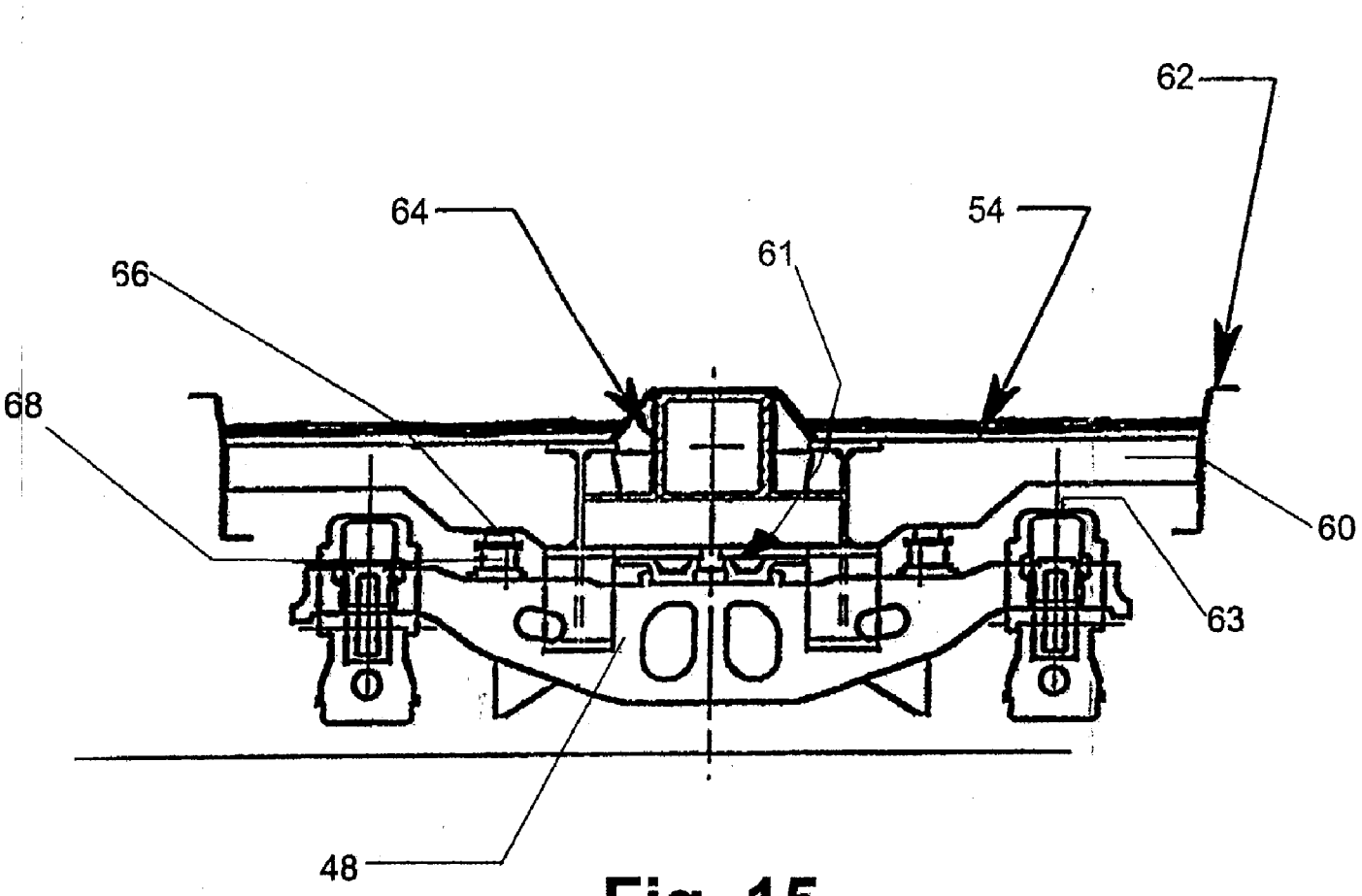
Figure 16:
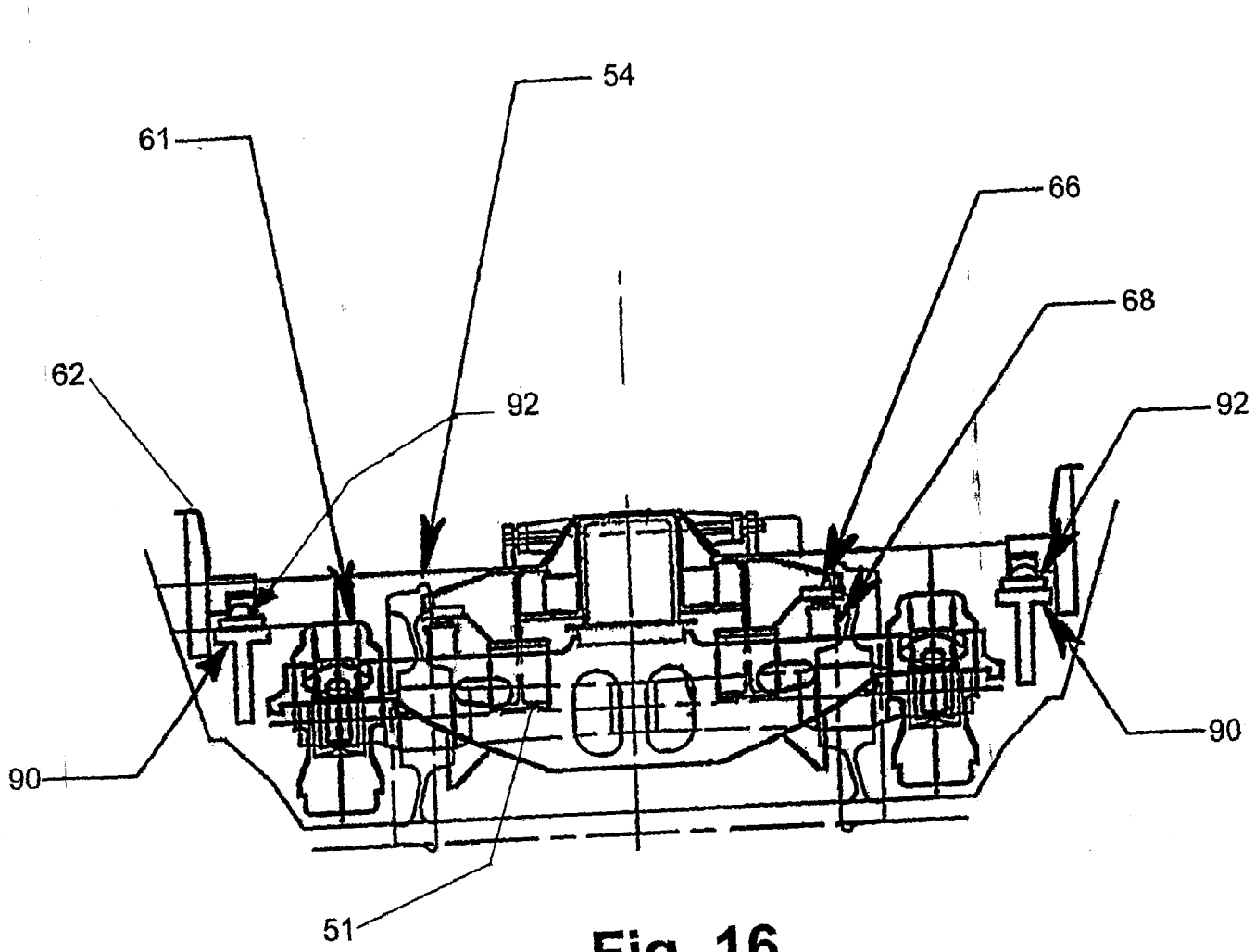
Figure 17:
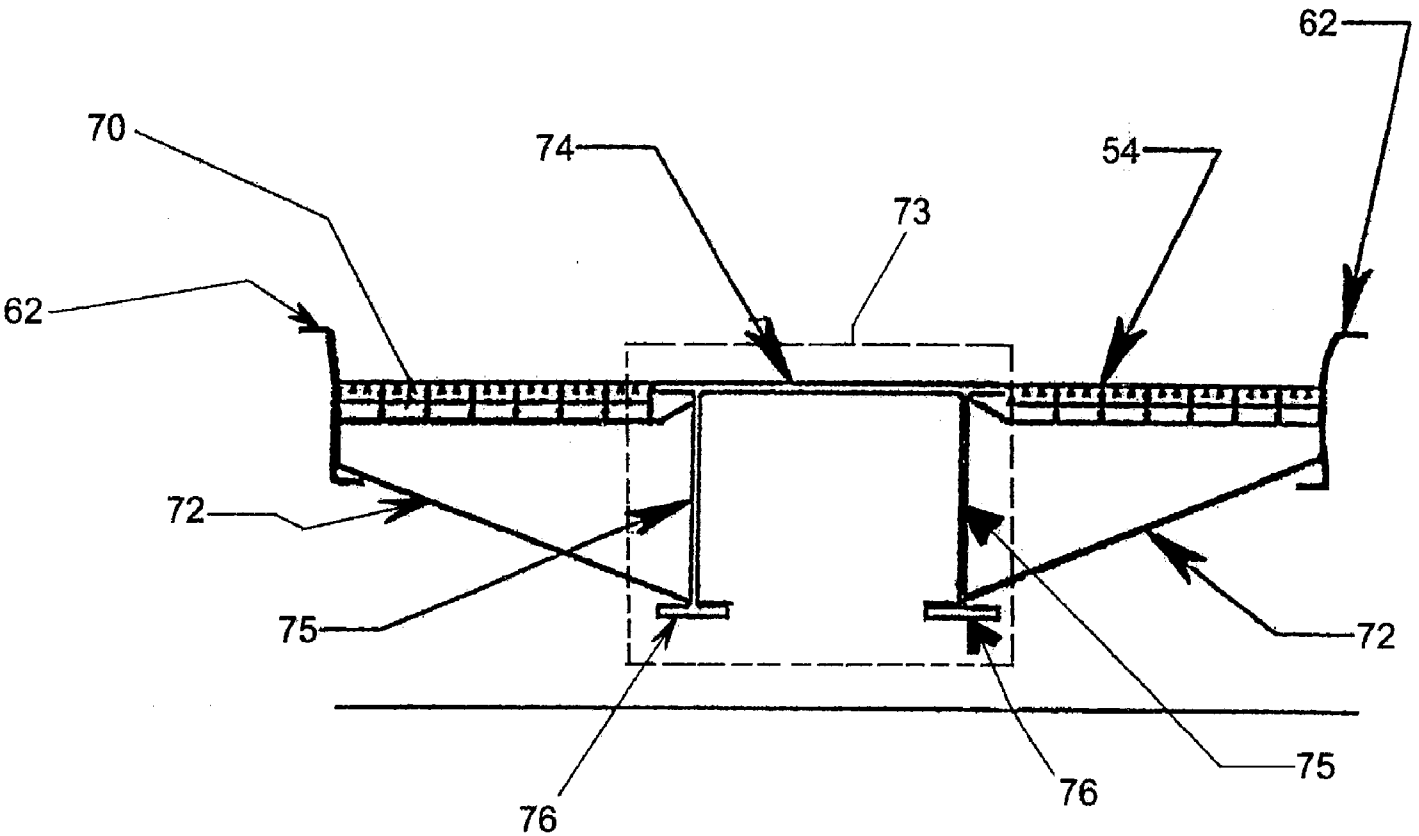
Figure 18:
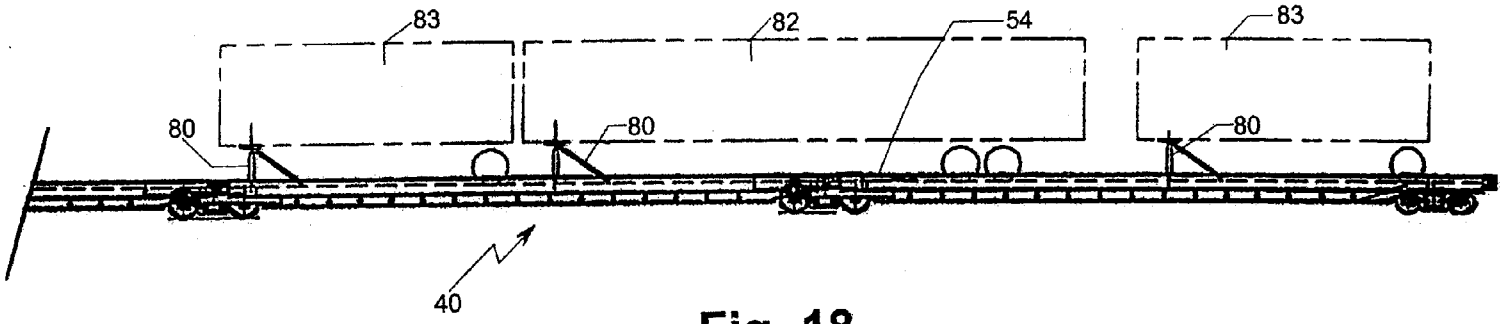
Figure 20:
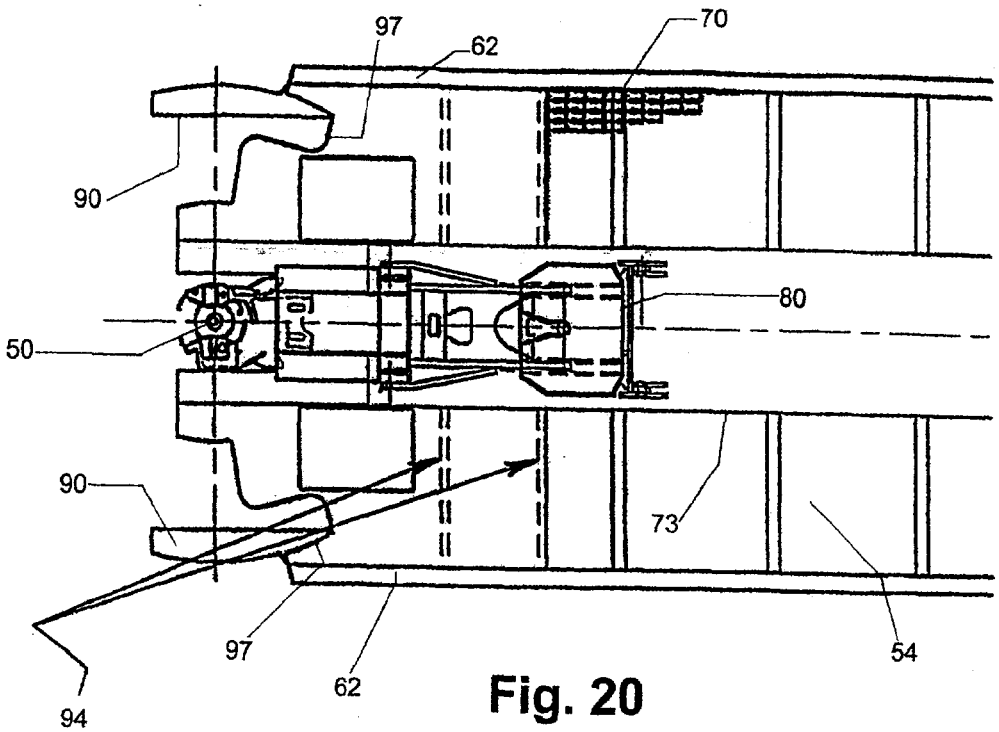
Figure 19:
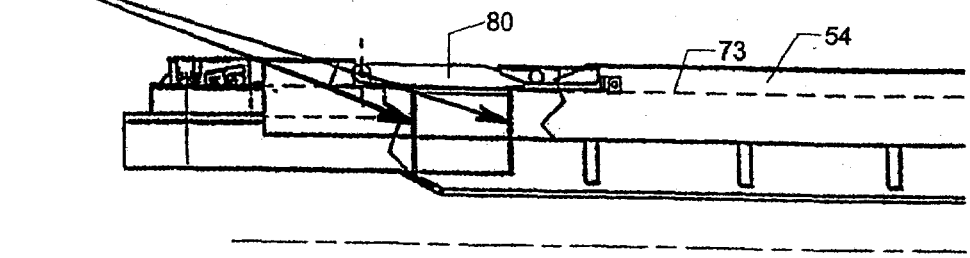
Figure 21:
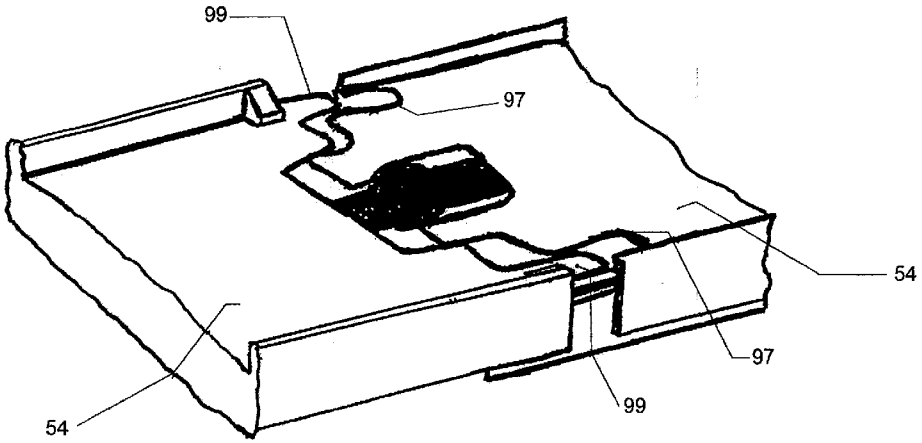
Figures 22, 23:
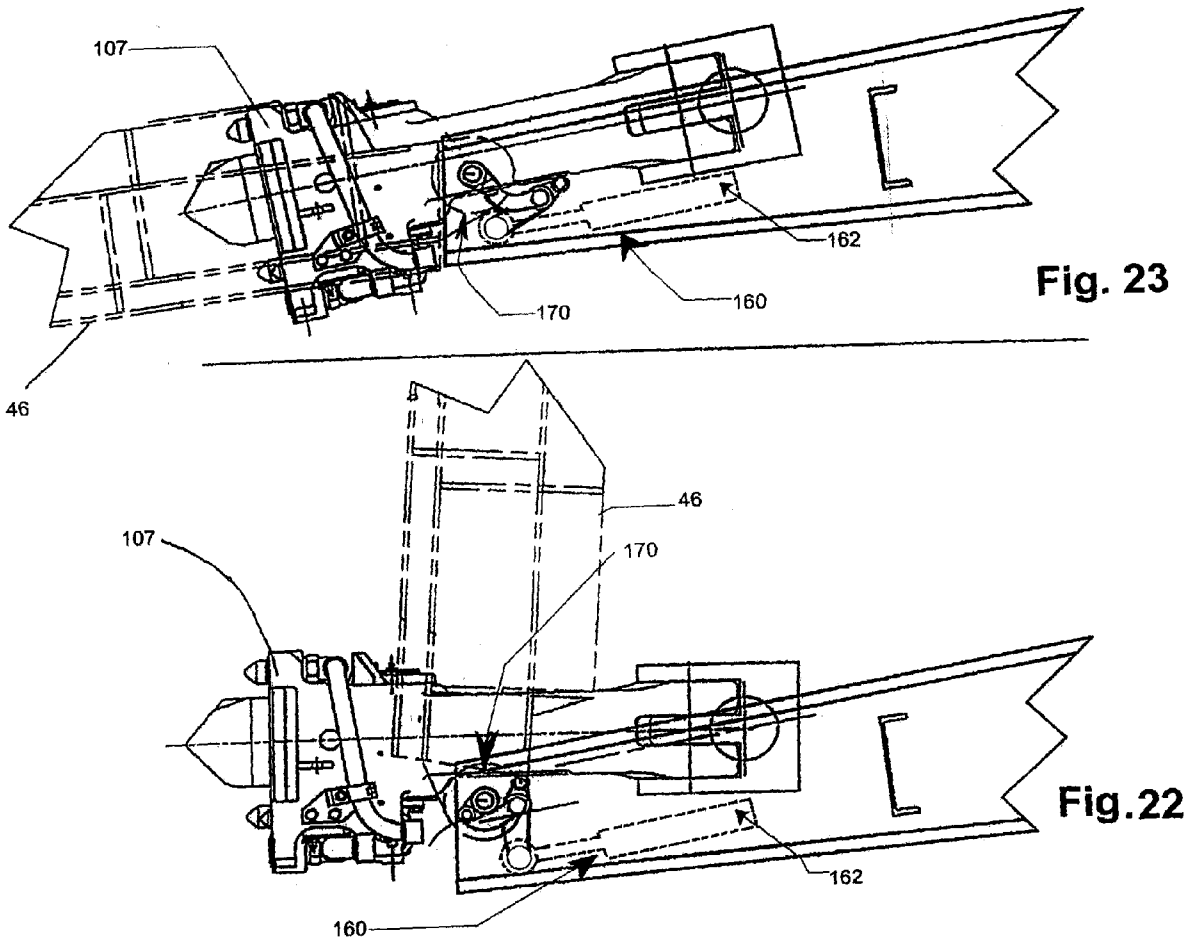
Figure 25:
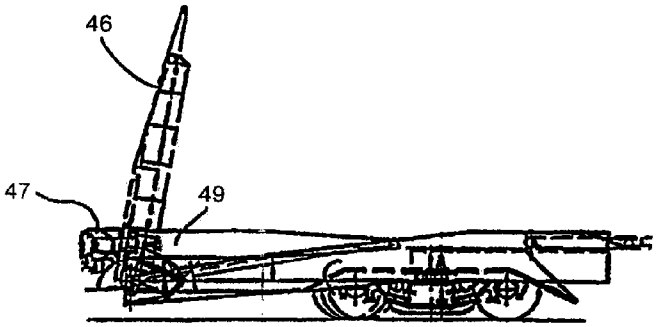
Figure 24:
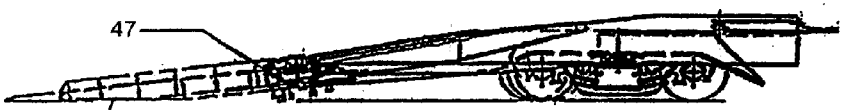
Figure 27:
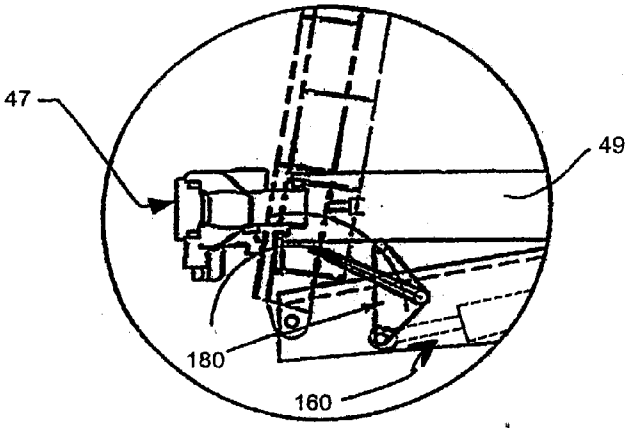
Figure 26:
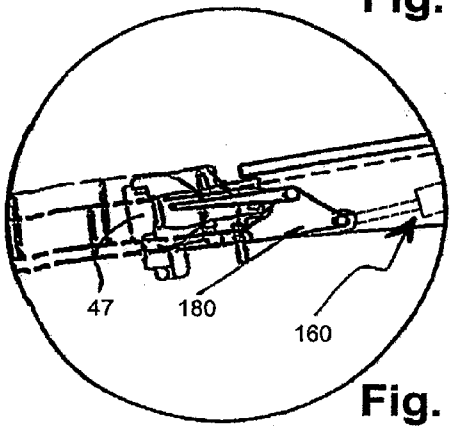
Figure 30:
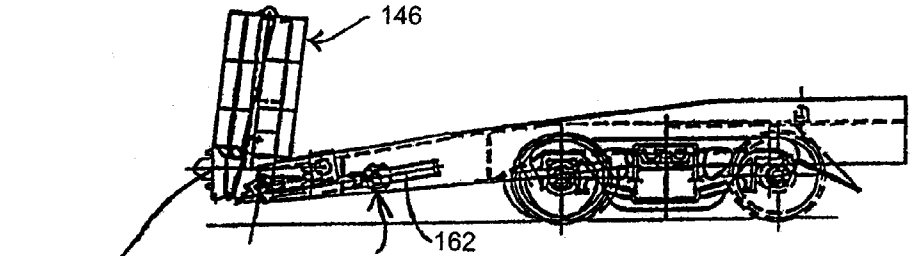
Figure 29:
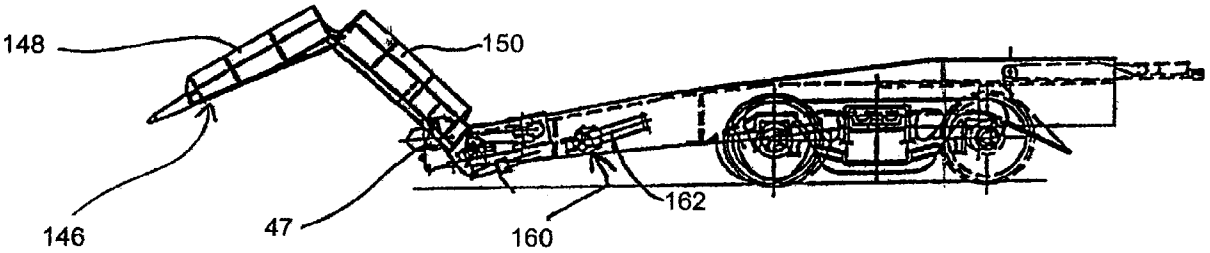
Figure 28:
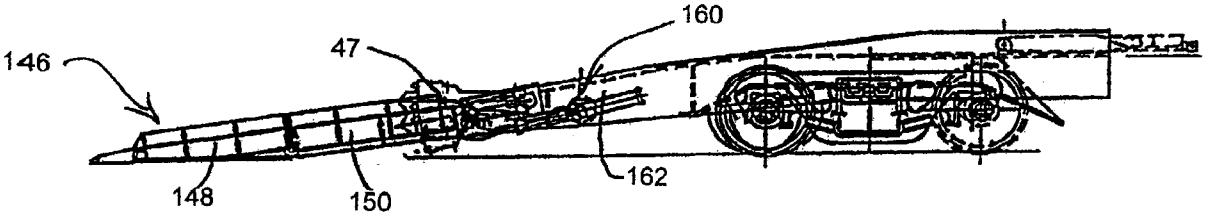
Figure 31:
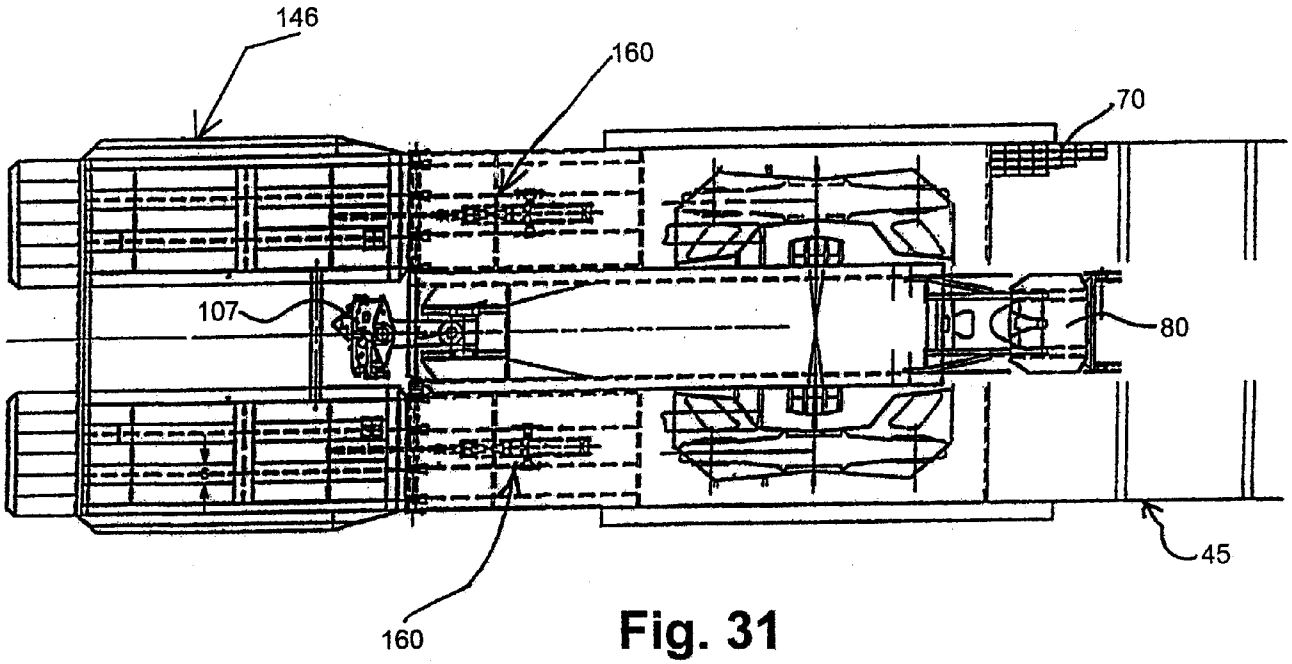

Referring to the simplified schematic in FIG. 55, the intermodal train solution to this problem is to provide the ramp 45 and adapter 43 platforms of each segment 40 with a small computer 252 and modem 254 mounted in the BPCU 210, operating at relatively low frequency over the brake application and release wires, which are located within the MU cable 200, and to provide trainline wire connections from the locomotive into the nearest of these computers. Since the commands to the brake system are made only at the end platforms in any case, only the health monitoring system need use electronic communications. Thus, a simple single wire 256 (plus ground wire) communication system to the health monitoring node on each platform should be all that is necessary to take the information from all 11 platforms 43, 44, 45 of a segment 40 into the small computers 252 at the two segment ends. From these ends, connections to a locomotive or control cab can be made by simply plugging a jumper cable 250 into the locomotive 27 MU cable 200 using the positive and negative wires on the conventional 72 VDC locomotive battery as a power source, and communicating into the locomotive over whatever spare trainline wires might be designated by the individual railroad.

It's assumed that digital communication into a single wire would be through modem 255, which would be part of the stand-alone locomotive interface unit (LIU) 245 in the cab of the locomotive. The LIU 245 would include a display 247 and connections to the gage test fittings for the equalizing reservoir and brake pipe gages of the locomotive's control console. As the differential between brake pipe and equalizing reservoir determines whether the application magnet, release magnet or no magnet should be energized by the BPCU 210 on each segment 40, this provides all of the information and communications capability that should be necessary. It also makes the equipping of any locomotive for service on an intermodal train an operation of but a few minutes, requiring no more skill than is required to plug in a box and connect two small pneumatic tubes to the gage test fittings (which are already there) for this type connection. In the event that the locomotive brake valve is not equipped for graduated release, this feature could easily be added to the 26 brake valve.

The communication between the LIU 245 and the intermediate train segments 40 would be by digital communication over trainline wires in the MU cable 200 from the LIU 245 to the BPCU 210 on the segment end adjacent the locomotive, then from one BPCU 210 to the other BCPU 210 on that segment. As described above, individual wheel bearing temperature sensors 258 and brake cylinder position sensors 260 can be provided on each truck to detect the requisite information for the small computers 252 in the BPCUs 210. The individual sensors 258, 260 would be cabled 262 to the BPCU 210 electronics separately, and this cable 262 preferably would not pass from segment to segment, or to the locomotive like the application and release wires. Since detachable plugs would only interrupt the communications wire between the locomotive and between the segments but not the sensor cabling 262, this path, with no more than 10 plugs, would be very low in resistance and would not require high voltage for reliable communications. The communications protocol should address each segment for monitoring purposes (brake control being a physical circuit) probably by a pre-assigned number or address. The BPCU 210 on each segment would have a memory to store that segments individual platforms, addresses current data. Thus, manually programming a locomotive interface unit 245 to communicate with a 110 platform intermodal train would only require the setting of 10 addresses which could be manually done or performed automatically on a daisy chain, front-to-rear basis.

A typical LIU 245 display screen 247 could simply indicate whether or not there were any exceptions to normal operation. If an exception exists, the operator could request further information. The screen 245 can also display the conditions of the brake monitoring system which in the absence of exception, shows the conditions as either low brake rate, released or applied. In the LIU 245 logic, (which has the equalizing reservoir and brake pipe pressure information) it will be a simple matter to determine the command status of the brakes. The logic would then report brake cylinders not released as "low rate braking" if a brake command was in effect, "brakes applied" if no brake was released and fifty percent pressure was in effect, and "brakes dragging" if a release was commanded and sufficient time had elapsed since the release command to cause all pistons to withdraw, but one or more had failed to do so. "Brakes released" would be reported when no pistons were out of release position.

When "brakes dragging" is reported on an alarm or exception basis, this indication would have to be acted upon in accordance with rules determined by the railroad. As this system requires very little in the way of sending the brake apply and release signals, and communication is only necessary on demand from the car borne electronics to the 11 platforms, it should not be necessary to require anything more substantial than a party-line telephone system from locomotive to individual segments, and with an automatic monitoring sub-system on each segment. Further, communications would always be initiated by the locomotive asking the segments one at a time if exceptions existed. Only if an exception was found would further inquiries be placed, thus communications could be at a low rate without sacrificing response time.

Although certain embodiments of the invention have been described in detail, it will be appreciated by those skilled in the art that various modifications and alterations would be developed in light of the overall teaching of the disclosure. Accordingly, the particular embodiments and arrangements disclosed herein are intended to be illustrative only and not limiting as to the scope of the invention which should be awarded the fall breadth of the following claims and in any and all equivalents thereof.

What is claimed is:

1. A brake for a vehicle, the brake comprising:

a brake shoe adapted to engage a wheel of the vehicle;

an application rod having a first end operably connected to the brake shoe and a second end operably connected to a first portion of an application lever;

a valve connected to a second portion of the application lever; the application lever having a pivot point between said first and second portions; and means for Compensating the pivot point of the application lever, said compensating means repositioning the pivot point of the application lever as the vehicle is make a turn.

2. The brake as recited in claim 1, wherein said compensating means comprises:

a compensation rod having a portion connected to the vehicle proximate the wheel such that the compensating rod is moved as the wheel is making the turn; and a compensation lever having a first end connected to an opposite portion of the compensation rod and a second end wherein the compensating lever is connected to the application lever at the pivot point such that the compensation lever and the application lever rotate about the pivot point as the vehicle is making the turn.

3. The brake as recited in claim 2, wherein said compensating means limits the repositioning of the pivot points.

4. The brake as recited in claim 1, wherein the valve is a pneumatic valve, such that the brake is activated when a pressure within the pneumatic valve drops to a predetermined pressure level.

5. The brake as recited in claim 4, wherein the predetermined pressure level is 40 psi.

6. The brake as recited in claim 1, further comprising means for manually releasing the brake.

7. The brake as recited in claim 6, wherein said manual release means comprises:

a chain having a first end connected to the second portion of the application lever and a second end connected to a ratchet mechanism; and an operating handle operably connected to the ratchet mechanism such that manual translation of the operating handle manipulates the ratchet mechanism to cause translation of the chain whereby the application lever pivots about the pivot point to pull on the application rod to disengage the brake from the wheel of the vehicle.

8. A rail vehicle having a car body and at least one wheel truck, the wheel truck having a bolster rotatably mounted to the car body, a plurality of wheels which engage a railed track such that the bolster rotates as the rail vehicle makes a turn, and a brake shoe for frictionally engaging at least one of said plurality of wheels, a parking brake comprising:

an application rod having a first end operably connected to the brake shoe and a second operably connected to a first portion of an application lever;

a first pneumatic valve connected to a second portion of the application lever, such that operation of the pneumatic valve engages the brake shoe to said at least one car wheel; and means for compensating a position of the application lever as the bolster rotates.

9. The rail vehicle as recited in claim 8, wherein the first pneumatic valve is operated when a pressure within the pneumatic valve reaches a predetermined level.

10. The rail vehicle as recited in claim 9, wherein the predetermined pressure level is 40 psi.

11. The rail vehicle as recited in claim 8, wherein said compensating means comprises:

a compensating rod having a portion connected to the bolster proximate the wheel such that the compensating rod is moved as the wheel is making the turn;

a compensation lever having a first end connected to an opposite portion of the compensation rod and a second end wherein the compensating lever is connected to the application lever at the pivot point such that the compensation lever and the application lever rotate about the pivot point as the vehicle is making the turn.

12. The rail vehicle as recited in claim 11, wherein said compensating means limits the repositioning of the pivot points.

13. The rail vehicle as recited in claim 11, further comprising means for manually releasing the brake.

14. The rail vehicle as recited in claim 8, wherein said manual release means comprises:

a chain having a first end connected to the second portion of the application lever and a second end connected to a ratchet mechanism; and an operating handle operably connected to the ratchet mechanism such that manual translation of the operating handle manipulates the ratchet mechanism to cause translation of the chain whereby the application lever pivots about the pivot point to pull on the application rod to disengage the brake from the wheel of the vehicle.

15. The rail vehicle as recited in claim 14, further comprising an escutcheon plate attached to the car body proximate the operating handle such that the operating handle moves along a slat in the escutcheon plate, wherein the escutcheon plate includes means for indicating the positions of the operating handle.

16. The rail car as recited in claim 8, further including a second pneumatic valve connected to the first pneumatic valve such that said first pneumatic valve is not operated until said operated pressure with the second valve falls below a predetermined level.

17. The rail car as recited in claim 16, wherein the predetermined pressure level is 40 psi.

* * * * *

UNITED STATES PATENT AND TRADEMARK OFFICE

CERTIFICATE OF CORRECTION

PATENT NO. : 6,491,352 B2
DATED : December 10, 2002
INVENTOR(S) : Thomas Engle

It is certified that error appears in the above-identified patent and that said Letters Patent is hereby corrected as shown below:

Title page should be deleted to be replaced with the attached title page.

Drawing sheets consisting of Figs. 1 - 55, should be deleted to be replaced with the drawing Figs. 1 - 55, as shown on the attached pages.

Signed and Sealed this

Twenty-ninth Day of April, 2003

JAMES E. ROGAN
*Director of the United States Patent and Trademark Office*

(12) United States Patent
Engle

(10) Patent No.: US 6,491,352 B2
(45) Date of Patent: Dec. 10, 2002

(54) SPRING APPLIED PARKING BRAKE FOR RAIL CARS

(75) Inventor: Thomas Engle, Clayton, NY (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/809,703

(22) Filed: Mar. 15, 2001

(65) Prior Publication Data

US 2001/0050027 A1 Dec. 13, 2001

Related U.S. Application Data

(63) Continuation-in-part of application No. 09/255,204, filed on Feb. 22, 1999.

(60) Provisional application No. 60/189,578, filed on Mar. 15, 2000.

(51) Int. Cl.[7] ..... B60T 13/00

(52) U.S. Cl. ..... 303/8; 303/127; 188/107; 188/170

(58) Field of Search ..... 303/7, 8, 9, 127; 188/107, 170, 166, 3 R, 112 R, 3 H

(56) References Cited

U.S. PATENT DOCUMENTS

| | | | | | |
|---|---|---|---|---|---|
| 2,270,431 | A | * | 1/1942 | Freeman | 188/170 |
| 2,568,722 | A | * | 9/1951 | Dewandre | 303/2 |
| 3,612,619 | A | * | 10/1971 | Hayes | 180/286 |
| 3,621,956 | A | * | 11/1971 | Suckow | 188/170 |
| 3,635,317 | A | * | 1/1972 | Crabb et al. | 137/596 |
| 3,650,568 | A | * | 3/1972 | Poplawski | 188/170 |
| 3,842,950 | A | * | 10/1974 | Fontaine | 188/170 |
| 3,926,282 | A | * | 12/1975 | Tanaka et al. | 188/106 F |
| 4,052,109 | A | * | 10/1977 | Nagase et al. | 303/15 |
| 4,456,413 | A | | 6/1984 | Pavlick | |
| 4,607,729 | A | * | 8/1986 | Stalmeir et al. | 188/106 F |
| 4,652,057 | A | | 3/1987 | Engle et al. | |
| 4,718,351 | A | | 1/1988 | Engle | |
| 4,718,800 | A | | 1/1988 | Engle | |
| 4,746,171 | A | * | 5/1988 | Engle | 188/107 |
| 4,973,206 | A | | 11/1990 | Engle | |
| 4,978,178 | A | * | 12/1990 | Engle | 188/107 |
| RE34,040 | E | * | 8/1992 | Rains | 188/107 |
| 5,172,958 | A | * | 12/1992 | Sell | 188/170 |
| 5,216,956 | A | | 6/1993 | Adams | |
| 5,222,443 | A | | 6/1993 | Engle | |
| 5,246,081 | A | | 9/1993 | Engle | |
| 5,564,341 | A | | 10/1996 | Martin | |
| 5,722,736 | A | | 3/1998 | Cook | |
| 5,738,416 | A | * | 4/1998 | Kanjo et al. | 303/7 |
| 6,039,158 | A | * | 3/2000 | Fox et al. | 188/162 |

* cited by examiner

*Primary Examiner*—Christopher P. Schwartz
*Assistant Examiner*—Devon Kramer
(74) *Attorney, Agent, or Firm*—Buchanan Ingersoll, P.C.

(57) ABSTRACT

An integral intermodal train is provided for carrying standard over-the-highway semi-trailers. Each segment can have a plurality of platforms and may be loaded or unloaded independently of any other segment using a self contained, roll-on/roll-off system. Several sub-systems to speed performance and enhance reliability, such as an electronic assisted air brake, health monitoring, trailer tie-down and locomotive interface subsystems, can be provided on each segment. A spring applied parking brake is provided for the segments and operably connected to the train pneumatic brake systems. In a preferred embodiment the brake is automatically applied when brake pipe pressure falls below 40 psi nominal. The pneumatic valving for the parking brake prevents application of the valve in an emergency braking situation, until the pressure has bled off in normal system leakage, preventing wheel damage. A handle is provided for manual application and release of the parking brake when desired.

17 Claims, 43 Drawing Sheets

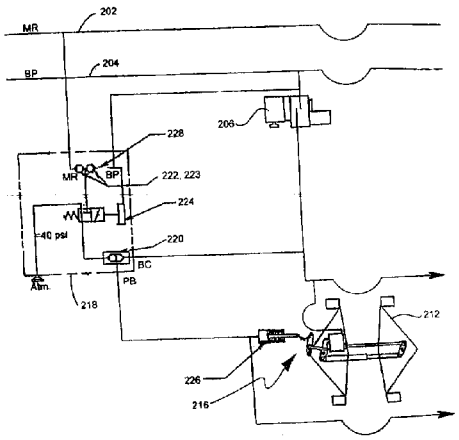

A-
B-
VI
X
X
IX
IV
VIII
5
44
80
80
54
50

5
54
44
80
80
51
51

52
80
44
54
80
51
50

72
74
54
62

62
72
54
62

A-
B-
82
54
80
52
45
112
48
56
46

162
160
170
46
107
162
170
160
107
46

230
232
234
236
238
240

UNITED STATES PATENT AND TRADEMARK OFFICE

CERTIFICATE OF CORRECTION

PATENT NO. : 6,491,352 B2
DATED : December 10, 2002
INVENTOR(S) : Thomas Engle

It is certified that error appears in the above-identified patent and that said Letters Patent is hereby corrected as shown below:

Column 23,
Line 31, change “make” to -- making --.

Column 24,
Line 8, after “second” insert -- end --.

Signed and Sealed this

Eighth Day of June, 2004

JON W. DUDAS
*Acting Director of the United States Patent and Trademark Office*